US010247525B2

(12) United States Patent
Bitar et al.

(10) Patent No.: US 10,247,525 B2
(45) **Date of Patent: *Apr. 2, 2019**

(54) ELECTRICAL DISCHARGE SYSTEM AND METHOD FOR NEUTRALIZING EXPLOSIVE DEVICES AND ELECTRONICS

(71) Applicant: Xtreme ADS Limited, Anderson, IN (US)

(72) Inventors: Peter V. Bitar, Anderson, IN (US); Rick Lee Busby, Pendleton, IN (US); Leroy Ernest Lakey, Anderson, IN (US); Varce Eron Howe, Zionsville, IN (US)

(73) Assignee: Xtreme ADS Limited, Anderson, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/679,308

(22) Filed: Aug. 17, 2017

(65) Prior Publication Data

US 2018/0066923 A1 Mar. 8, 2018

Related U.S. Application Data

(63) Continuation of application No. 15/006,479, filed on Jan. 26, 2016, now Pat. No. 9,739,573, which is a (Continued)

(51) Int. Cl.
*F41H 11/12* (2011.01)
*F41H 11/136* (2011.01)
(Continued)

(52) U.S. Cl.
CPC ..... *F41H 11/12* (2013.01); *F41H 11/136* (2013.01); *F41H 11/30* (2013.01); *F41H 11/32* (2013.01); *F41H 13/0018* (2013.01)

(58) Field of Classification Search
CPC ..... F41H 11/12; F41H 11/136; F41H 11/32; F41H 11/30; F41H 13/0018
(Continued)

(56) References Cited

U.S. PATENT DOCUMENTS 676,583 A 6/1901 Kinraide
2,378,440 A 6/1945 Scott
(Continued)

FOREIGN PATENT DOCUMENTS

GB 2122553 12/2006
JP 2001/135451 5/2001
(Continued)

OTHER PUBLICATIONS

Graham L. Hearn, Static Electricity. Guidance for Plant Engineers, Internet Article (2002) available at http://www.wolfsonelectrostatics.com/01_hazards/pdfs/guidanceforplantengineers-staticelectricity.pdf.

(Continued)

*Primary Examiner* — Bret Hayes
(74) *Attorney, Agent, or Firm* — Woodard, Emhardt, Henry, Reeves & Wagner, LLP

(57) ABSTRACT

Disclosed is an apparatus that includes an electric power source that powers a Marx generator that is electrically coupled to a cathode emitter that is configured to discharge electrical potential into the earth. The apparatus also includes a load resistor that is coupled between the output of the Marx generator and either a relative ground or the input to the Marx generator.

19 Claims, 60 Drawing Sheets

Related U.S. Application Data continuation of application No. 14/216,294, filed on Mar. 17, 2014, now Pat. No. 9,243,874, which is a continuation of application No. 13/803,838, filed on Mar. 14, 2013, now Pat. No. 8,683,907, which is a continuation of application No. PCT/US2012/054233, filed on Sep. 7, 2012.

(60) Provisional application No. 61/531,703, filed on Sep. 7, 2011, provisional application No. 61/693,035, filed on Aug. 24, 2012, provisional application No. 61/789,346, filed on Mar. 15, 2013.

(51) Int. Cl.
*F41H 11/32* (2011.01)
*F41H 11/30* (2011.01)
*F41H 13/00* (2006.01)

(58) Field of Classification Search
USPC ..... 89/1.13; 86/50; 102/402, 403; 166/248
See application file for complete search history.

(56) References Cited

U.S. PATENT DOCUMENTS

| | | | |
|---|---|---|---|
| 2,549,533 | A | 4/1951 | Sevold |
| 2,659,882 | A | 11/1953 | Barrett |
| 2,631,804 | A | 4/1958 | Collopy |
| 2,974,218 | A | 3/1961 | Inoue |
| 3,060,883 | A | 10/1962 | Herbst et al. |
| 3,601,054 | A | 8/1971 | Christianson |
| 3,663,787 | A | 5/1972 | Haswell |
| 3,905,272 | A | 9/1975 | Johnson |
| 3,946,696 | A | 3/1976 | Lubnow |
| 4,148,321 | A | 4/1979 | Wyss et al. |
| 4,223,279 | A | 9/1980 | Bradford, Jr. et al. |
| 4,380,958 | A | 4/1983 | Betts |
| 4,401,875 | A | 8/1983 | Schlienger et al. |
| 4,466,484 | A | 8/1984 | Kermabon |
| 4,495,990 | A | 1/1985 | Titus et al. |
| 4,793,325 | A | 12/1988 | Cadossi et al. |
| 4,911,686 | A | 3/1990 | Thaler |
| 4,961,181 | A | 10/1990 | Elliott |
| 4,967,048 | A | 10/1990 | Langston |
| 5,001,485 | A | 3/1991 | Jones |
| 5,007,346 | A | 4/1991 | Kirkland |
| 5,063,850 | A | 11/1991 | Olsson et al. |
| 5,079,482 | A | 1/1992 | Villecco et al. |
| 5,108,247 | A | 4/1992 | Vlaanderen |
| 5,323,726 | A | 6/1994 | Olsson |
| 5,433,829 | A | 7/1995 | Pool |
| 5,458,063 | A | 10/1995 | Laine et al. |
| 5,592,170 | A | 1/1997 | Price et al. |
| 5,598,152 | A | 1/1997 | Scarzello et al. |
| 5,668,342 | A | 9/1997 | Discher |
| 5,675,103 | A | 10/1997 | Herr |
| 5,856,629 | A | 1/1999 | Grosch et al. |
| 5,908,444 | A | 6/1999 | Azure |
| 5,936,460 | A | 8/1999 | Mori et al. |
| 5,982,180 | A | 11/1999 | Bushman |
| 6,163,242 | A | 12/2000 | Crewson et al. |
| 6,213,021 | B1 | 4/2001 | Pickett |
| 6,254,764 | B1 | 7/2001 | Babington et al. |
| 6,286,431 | B1 | 9/2001 | Cangelosi |
| 6,411,095 | B1 | 6/2002 | Chin et al. |
| 6,486,577 | B1 | 11/2002 | Ursel et al. |
| 6,606,932 | B2 | 8/2003 | Goldstein |
| 6,634,273 | B2 | 10/2003 | Cangelosi |
| 6,749,389 | B1 | 6/2004 | Vlaanderen |
| 6,799,499 | B2 | 10/2004 | Seregelyi et al. |
| 6,822,250 | B2 | 11/2004 | Korenev |
| 6,825,792 | B1 | 11/2004 | Letovsky |
| 6,913,183 | B2 | 7/2005 | Becker et al. |
| 7,034,539 | B2 | 4/2006 | Ueda et al. |
| 7,051,636 | B1 | 5/2006 | Snow et al. |
| 7,061,636 | B2 | 6/2006 | Ryan et al. |
| 7,109,718 | B2 | 9/2006 | Shimizu et al. |
| 7,130,624 | B1 | 10/2006 | Jackson et al. |
| 7,296,503 | B1 | 11/2007 | McGrath |
| 7,511,654 | B1 | 3/2009 | Goldman et al. |
| 7,775,146 | B1 | 8/2010 | Bitar et al. |
| 7,958,809 | B1 | 6/2011 | Bitar et al. |
| 7,987,760 | B1 | 8/2011 | Lundquist et al. |
| 8,499,675 | B2 | 8/2013 | McCahon et al. |
| 8,683,907 | B1 | 4/2014 | Howe et al. |
| 9,243,874 | B1 | 1/2016 | Bitar et al. |
| 9,739,573 | B2 * | 8/2017 | Bitar ..... F41H 11/12 |
| 2003/0159573 | A1 | 8/2003 | Cangelosi |
| 2004/0200341 | A1 | 10/2004 | Walters et al. |
| 2006/0278069 | A1 | 12/2006 | Ryan |
| 2008/0028921 | A1 | 2/2008 | Bitar et al. |
| 2008/0156219 | A1 | 7/2008 | Voss et al. |
| 2011/0120290 | A1 | 5/2011 | Bitar et al. |
| 2011/0259181 | A1 | 10/2011 | Lundquist et al. |
| 2012/0073426 | A1 | 3/2012 | Adler et al. |

FOREIGN PATENT DOCUMENTS

| | | |
|---|---|---|
| JP | 2002/156460 | 5/2002 |
| JP | 2003/020206 | 1/2003 |
| JP | 2003/203744 | 7/2003 |
| JP | 2007/003100 | 1/2007 |
| JP | 2007/108064 | 4/2007 |
| WO | WO 1998/36235 | 8/1998 |

OTHER PUBLICATIONS

Haase, Heinz; Electrostatic Hazards, Their Evaluation and control, Verlag Chemie-Weinheim-New York (1977), pp. Preface, Contents, Introduction and 7. Appendix pp. 108-111.

http://crohmiq.com/mie-fibc-minimum-ignition-energy-antistatic-big-bags.html.

http://www.teledynerisi.com/products/0products_8td_page02.asp.

International Search Report and Written Opinion issued in PCT/US2012/054233, dated Mar. 11, 2013.

Office Action dated Jan. 31, 2012 received in re-examination U.S. Appl. No. 95/001,828.

Office Action dated May 23, 2012 received in re-examination U.S. Appl. No. 95/001,828.

Office Action dated Aug. 28, 2012 received in re-examination U.S. Appl. No. 95/001,828.

Terry R. Gibbs, John F Beytos, LASL Explosive Property Data, University of California Press (1980) pp. 460-461 available at Google Books.

* cited by examiner

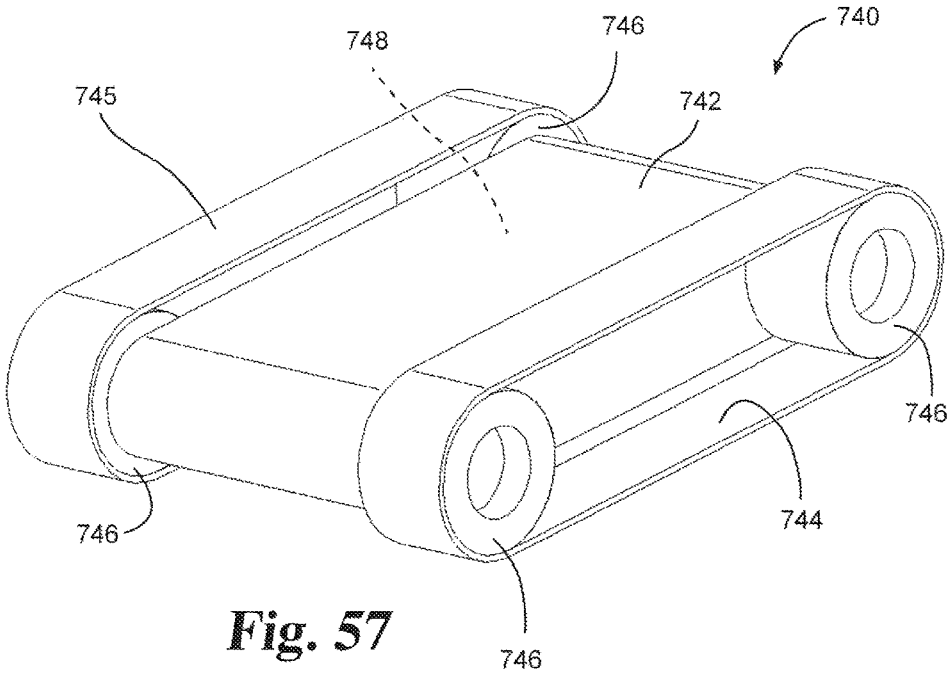
Fig. 57
Fig. 58
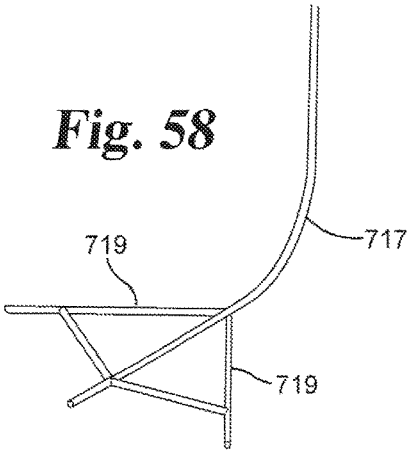
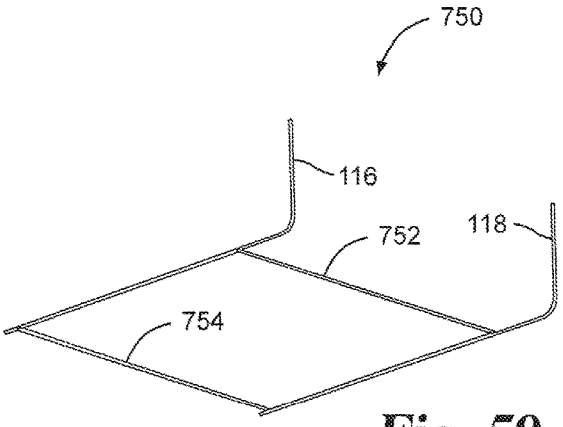
Fig. 59

ELECTRICAL DISCHARGE SYSTEM AND METHOD FOR NEUTRALIZING EXPLOSIVE DEVICES AND ELECTRONICS

CROSS-REFERENCE TO RELATED APPLICATIONS

This application is a continuation of U.S. patent application Ser. No. 15/006,479, filed Jan. 16, 2016, now U.S. Pat. No. 9,739,573, which is a continuation of U.S. application Ser. No. 14/216,294, filed Mar. 17, 2014, now U.S. Pat. No. 9,243,874, which is a continuation of U.S. application Ser. No. 13/803,838, filed Mar. 14, 2013, now U.S. Pat. No. 8,683,907, which is a continuation of International Application No. PCT/US2012/054233, filed Sep. 7, 2012, International Application No. PCT/US2012/054233 claims the benefit of U.S. Provisional Application No. 61/531,703 filed Sep. 7, 2011 and U.S. Provisional Application No. 61/693,035 filed Aug. 24, 2012, which are all incorporated by reference. This application claims the benefit of U.S. Provisional Application No. 61/789,346 filed Mar. 15, 2013, which is incorporated by reference.

BACKGROUND

Disclosed herein is a system and method for providing a mobile means to produce a high voltage electric discharge capable of disabling or destroying electric devices, detecting conductors and/or initiating detonation of an explosive device. For example, such an electric discharge can be used to detonate hidden explosive devices such as improvised explosive devices, electronically dispersed devices such as chemical, biological, radiological or nuclear (CBRNE) devices, or commercially produced land mines that may be hidden or otherwise obscured from an observer. High voltage can penetrate into the earth and/or travel along the surface of the earth to reach a conductor.

High explosives generally used in such explosive devices can be subdivided into classes by their relative sensitivity to heat and pressure as follows. The most sensitive type of explosives are commonly referred to as primary explosives. Primary explosives are extremely sensitive to mechanical shock, friction and heat to which they respond by rapid burning and/or detonation. The term "detonation" is used to describe an explosive phenomenon whereby chemical decomposition of an explosive is propagated by an explosive shock wave traversing the explosive material at great speeds typically thousands of meters per second. Secondary explosives, also referred to as base explosives, are comparatively insensitive to shock, pressure, friction and heat. Secondary explosives may burn when exposed to heat or flame in small unconfined quantities but when confined, detonation can occur. To ignite detonation, secondary explosives generally require substantially greater heat and/or pressure. In many applications, comparatively small amounts of primary explosives are used to initiate detonation of secondary explosives. Examples of secondary explosives include dynamite, plastic explosives, TNT, RDX, PENT, HMX and others. A third category of high explosives, referred to herein as tertiary explosives, are so insensitive to pressure and heat that they cannot be reliably detonated by practical quantities of primary explosives and instead require an intermediate explosive booster of a secondary explosive to cause detonation. Examples of tertiary explosives include ammonia nitrate fuel mixtures and slurry or wet bag explosives. Tertiary explosives are commercially used in large-scale mining and construction operations and are also used in improvised explosive devices (IED) due to their relative ease of manufacture from commercially available components (e.g., fertilizer and fuel oil).

Explosive devices, including IEDs, generally contain an explosive charge which could be comprised of either a secondary or tertiary explosive (in devices where a tertiary explosive is used, an additional booster charge of a secondary explosive is often found as well), a detonator (which generally includes a primary explosive and possibly a secondary explosive), and an initiation system to trigger the detonation of the detonator. Initiation systems commonly utilize an electric charge to generate heat through resistance to heat the primary explosive sufficiently to initiate detonation.

A common example of a detonator is a blasting cap. There are several different types of blasting caps. One basic form utilizes a fuse that is inserted in a metal cylinder that contains a pyrotechnic ignition mix of a primary explosive and an output explosive. The heat from a lit fuse ignites the pyrotechnic ignition mix which subsequently detonates the primary explosive which then detonates the output explosive that contains sufficient energy to trigger the detonation of a secondary explosive as described above.

Another type of blasting cap uses electrical energy delivered through a fuse wire to initiate detonation. Heat is generated by passing electrical current through the fuse wire to a bridge wire, foil, or electric match located in the blasting cap. The bridge wire, foil or electric match may be located either adjacent to a primary explosive or, in other examples, the bridge wire, foil or electric match may be coated in an ignition material with a pyrotechnic ignition mix located in close proximity to detonate a primary explosive, which, as described above, detonates an output explosive to trigger detonation of the explosive device. Electric current can be supplied with an apparatus as simple as connecting the fuse wire to a battery or an electric current can be triggered by an initiation system that includes a triggering control such as a remote signal or a timer.

Mines, CBRNE devices, and IEDs are extremely diverse in design and may contain many types of initiators, detonators, dispersing technologies, penetrators and explosive loads. Anti-personnel IEDs and mines typically contain shrapnel-generating objects such as nails or ball bearings. IEDs and mines are designed for use against armored targets such as personnel carriers or tanks that generally include armor penetrators such as a copper rod or cone that is propelled by a shaped explosive load. Mines and IEDs are triggered by various methods including but not limited to remote control, infrared or magnetic triggers, pressure sensitive bars or trip wires and command wires.

Military and law enforcement personnel from around the world have developed a number of procedures to deal with mines and IEDs. For example, a remote jamming system has been used to temporarily disable a remote detonation system. In some cases it is believed that the claimed effectiveness of such remote jamming systems, proven or otherwise, has caused IED technology to regress to direct command wire because physical connection between the detonator and explosive device cannot be jammed. However, in other situations it has been found that jamming equipment may only be partially effective because they may not be set to operate within the correct frequency range in order to stop a particular IED. Much of the radio frequency spectrum is unmanaged and in other cases jamming of some portions of the radio frequency spectrum can dangerously interfere with other necessary radio communications.

Other known methods of dealing with mines and IEDs include the use of mine rollers to detonate pressure sensitive devices. High-powered lasers have been used to detonate or burn the explosives in the mine or IED once the mine or IED is identified. Visual detection of the mine or IED and/or alterations to the terrain that were made in placing the mine or IED are some of the current methods used to combat such explosive devices. In any event, mines and IEDs continue to pose a threat and improved systems and methods for safely dealing with them are still needed.

BRIEF DESCRIPTION OF THE DRAWINGS

FIG. 57 is a perspective view of a fifth alternative embodiment of a robotically mounted electrical discharge system.

FIG. 58 is a perspective view of an alternative embodiment of an emitter incorporating a plurality of angled conductors.

FIG. 59 is a perspective view of an emitter sled.

DETAILED DESCRIPTION OF THE DRAWINGS

Figure 1:
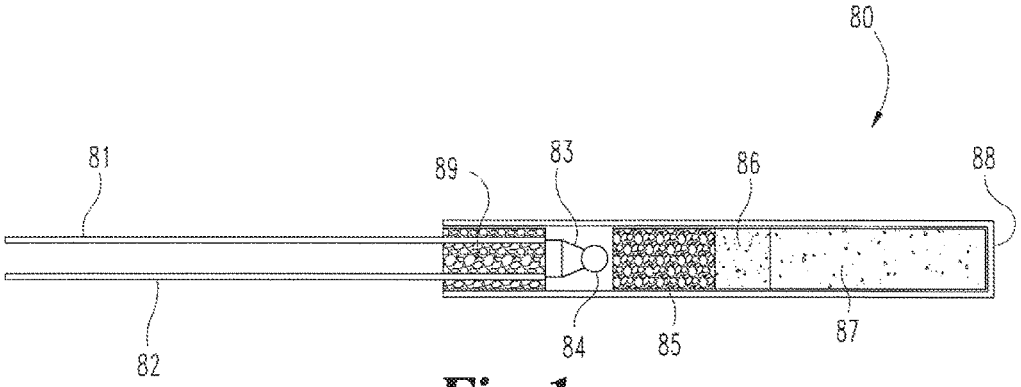
Fig. 1 (PRIOR ART)
FIG. 1 is an illustration of a prior art blasting cap.

For the purpose of promoting an understanding of the disclosure, reference will now be made to certain embodiments thereof and specific language will be used to describe the same. It will nevertheless be understood that no limitation of the scope of this disclosure is thereby intended, such alterations, further modifications and further applications of the principles described herein being contemplated as would normally occur to one skilled in the art to which the disclosure relates. In several FIGs., where there are the same or similar elements, those elements are designated with similar reference numerals.

Referring to FIG. 1, a prior art detonator typical of an electric type blasting cap 80 is illustrated. Blasting cap 80 includes lead wires 81 and 82, bridge wire 83, electric match 84, pyrotechnic ignition mix 85, primary explosive 86 and output explosive 87 all contained in casing 88 and header 89. Blasting cap 80 is used to initiate an explosive sequence by passing an electric current through lead wires 81 and 82 sufficient to heat and cause instantaneous combustion of electric match 84. The electric match ignites ignition mix 85 and subsequently primary explosive 86 resulting in the detonation of output explosive 87. Blasting cap 80 is generally constructed to have electric static discharge protection in order to protect against accidental detonation from an electric spark. One of the uses of the system(s) disclosed below is to generate an electric discharge sufficient to defeat the electrostatic discharge protection of standard blasting caps. An electric discharge with sufficient potential (voltage) and energy (Joules) has the ability to penetrate the insulation of the command wires or to find a path to conductive portions of the mine or IED. Once electric current flows through the bridge wires or generates a spark in proximity to electric match 84, detonation of blasting cap 80 may occur. Applicants have also observed situations where appropriate electric energy is passed through blasting cap 80 that bridge wire 83 is vaporized without igniting electric match 84, resulting in dudding blasting cap 80 so that it is inoperable to initiate detonation via intended triggering methods.

Figure 2:
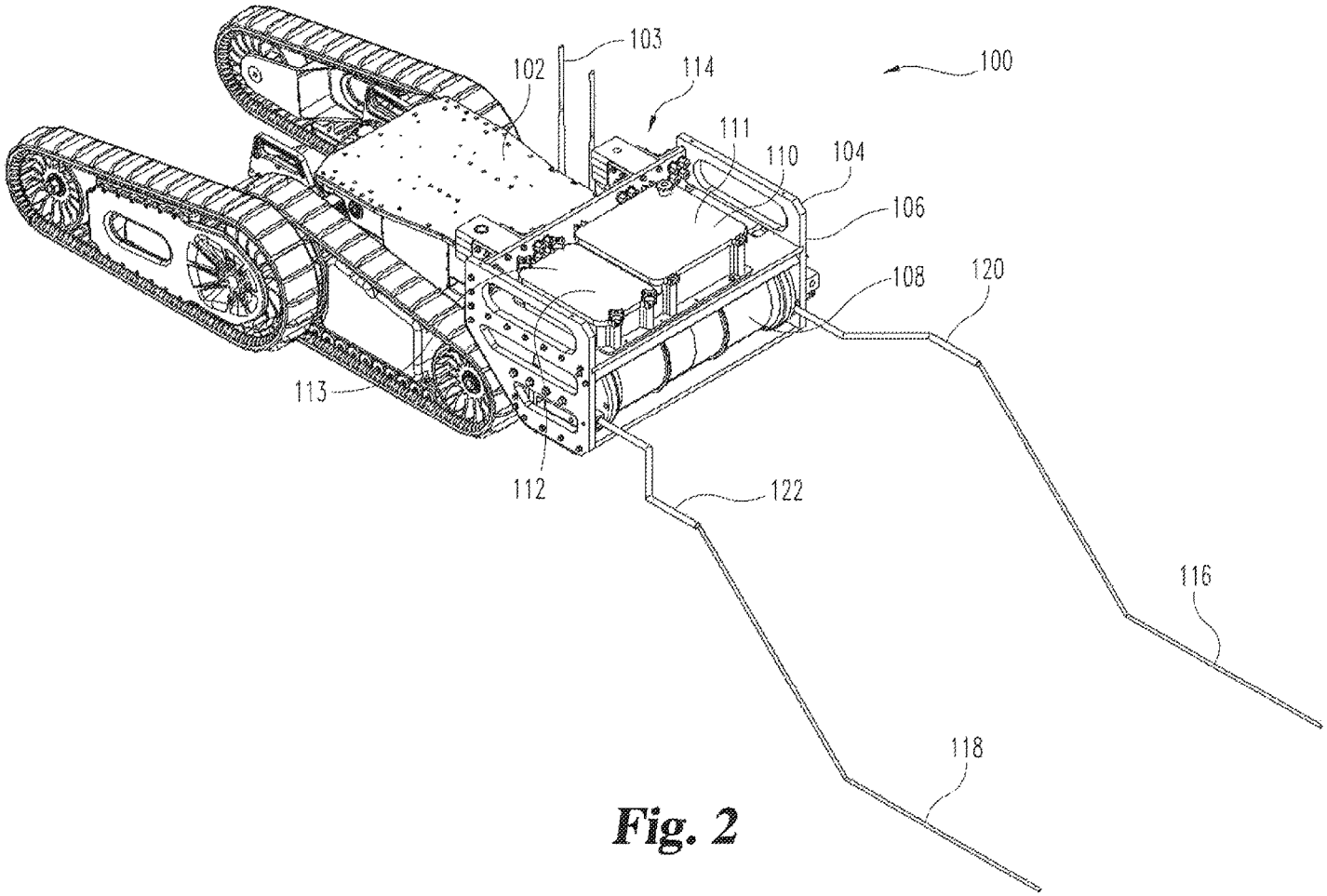
FIG. 2 is a perspective view of a robotically mounted electrical discharge system according to the present disclosure.

Referring to FIG. 2, system 100 is illustrated. System 100 includes vehicle 102 and module 104. The illustrated configuration vehicle 102 is a remotely controlled robotic vehicle as supplied by iRobot, 8 Crosby Drive Bedford, Mass. 01730. Phone (781) 430-3000 or at www.irobot.com. Vehicle 102 includes antennae 103 to receive remote control inputs. Vehicle 102 may be modified to send control signals to unit 104 via inputs received through antennae 103. While a specific robot is illustrated, it should be understood than any appropriate robotic vehicle could be used.

Unit 104 is generally defined by frame 106 that carries high voltage module 108, power converter 110 and power source 112. Power converter 110 and power source 112 define power supply 114. Power converter 110 includes cover 111 and power source 112 includes cover 113. Unit 104 also includes one or more emitters 116 and 118 extended away from frame 106 by supports 120 and 122. Emitters 116 and 118 in the illustrated configuration are flexible metal chains constructed and arranged to flex in one direction while maintaining relative rigidity in the other direction. This may permit emitters 116 and 118 to conform to the shape of the earth or whatever surface they are dragged across while maintaining a spaced apart relationship with each other. In other embodiments, emitters 116 and 118 may be rigid or semi-rigid structures that are supported above the ground or other surface being interrogated. Non-limiting examples of other emitter configurations includes cables, rods and straps. Emitters 116 and 118 are configured with emitter surfaces that are in close contact with the earth. In one embodiment, the emitter surfaces of emitter 116 and 118 are approximately 0.5 meters in length. In another embodiment, the emitter surface of emitter 116 and 118 are at least 0.3 meters in length. In yet another embodiment, the emitter surface of emitter 116 and 118 are at least 0.2 meters in length. In other embodiment, the emitter surfaces may be between approximately 0.5 to 1.5 meters in length. In yet other embodiments, the emitter surfaces may be between approximately 0.5 to 2.25 meters in length.

Supports 120 and 122 are comparatively rigid structures constructed of a non-conductive material that supports a conductor that electrically connects emitters 116 and 118 to high voltage module 108. Examples of non-conductive structural materials include EXTREN®, a pultruded fiberglass reinforced with polyester or vinyl ester resin manufactured by Strongwell and available at www.strongwell-.com. Another non-conductive structure material is G10 GAROLITE glass epoxy materials available structural material is Acetron® copolymer acetal available at www.quadrantplastics.com.

Figure 3:
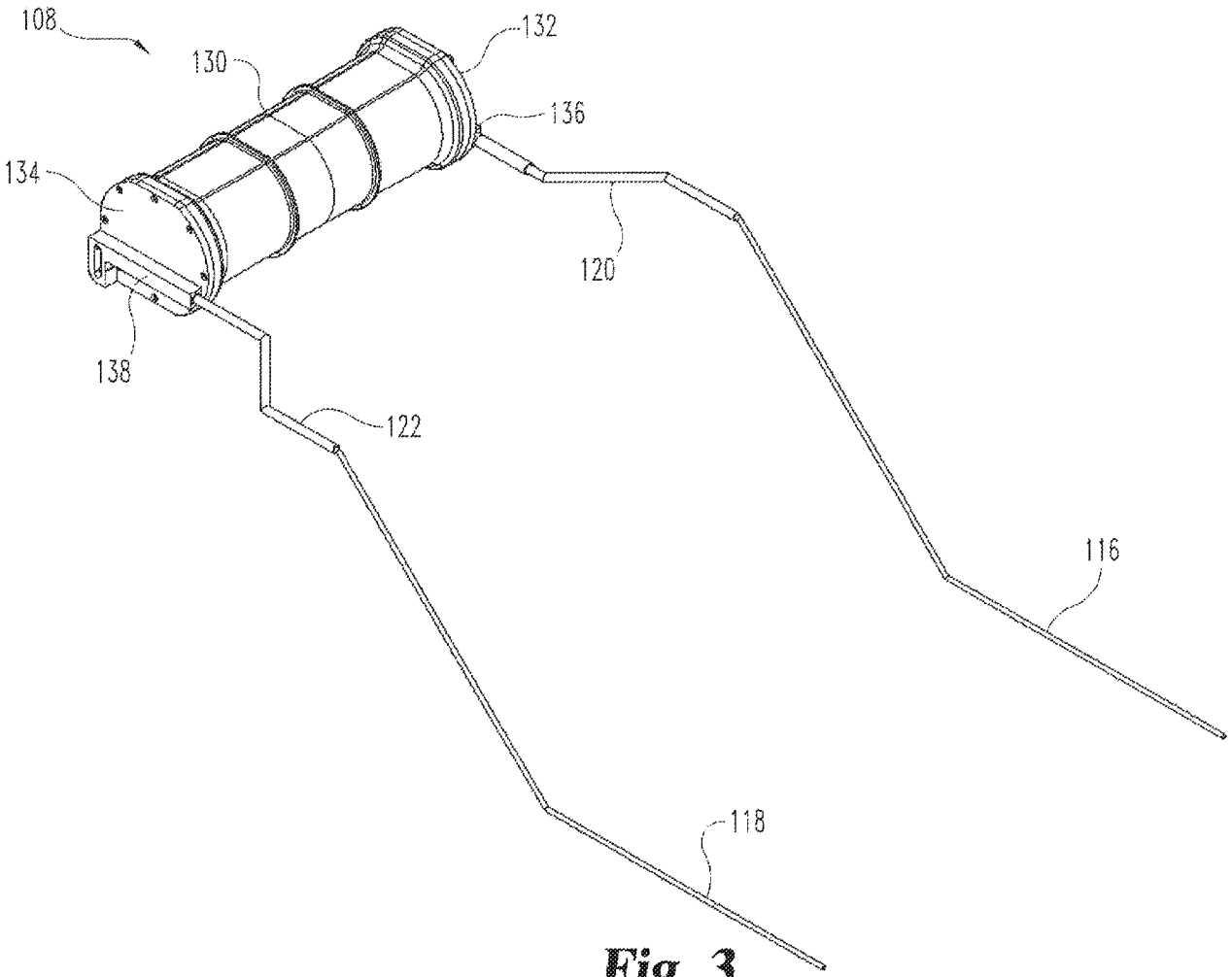
FIG. 3 is a perspective view of a high voltage module carried on the FIG. 2 electrical discharge system including drag emitters.

High voltage module 108 is shown in isolated detail in FIG. 3. High voltage module 108 includes casing 130 and end caps 132 and 134. End cap 132 includes support 136 holding support 120 while end cap 134 includes support 138 holding support 122.

Figure 4:
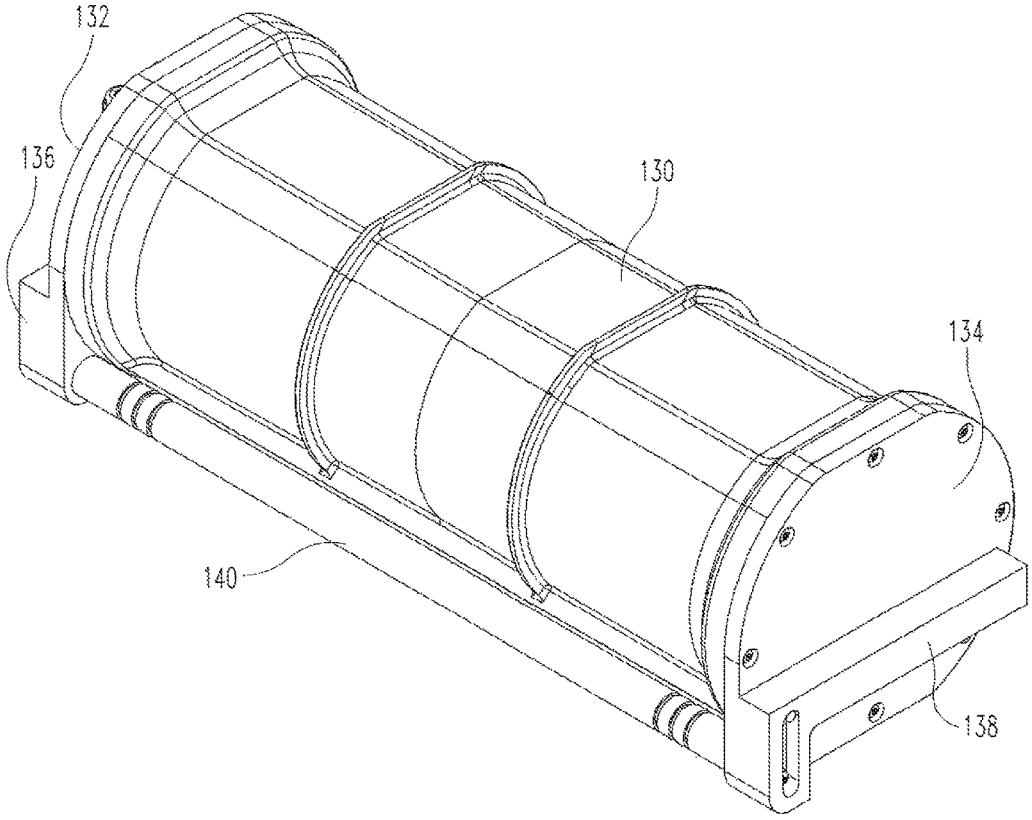
FIG. 4 is a perspective view of the casing of the high voltage module of FIG. 3.

Referring to FIG. 4, an alternative perspective view of casing 130 is illustrated showing housing 140 connected between supports 136 and 138. Housing 140 contains a load resistor coupled between emitters 116 and 118 as described below.

Figure 5:
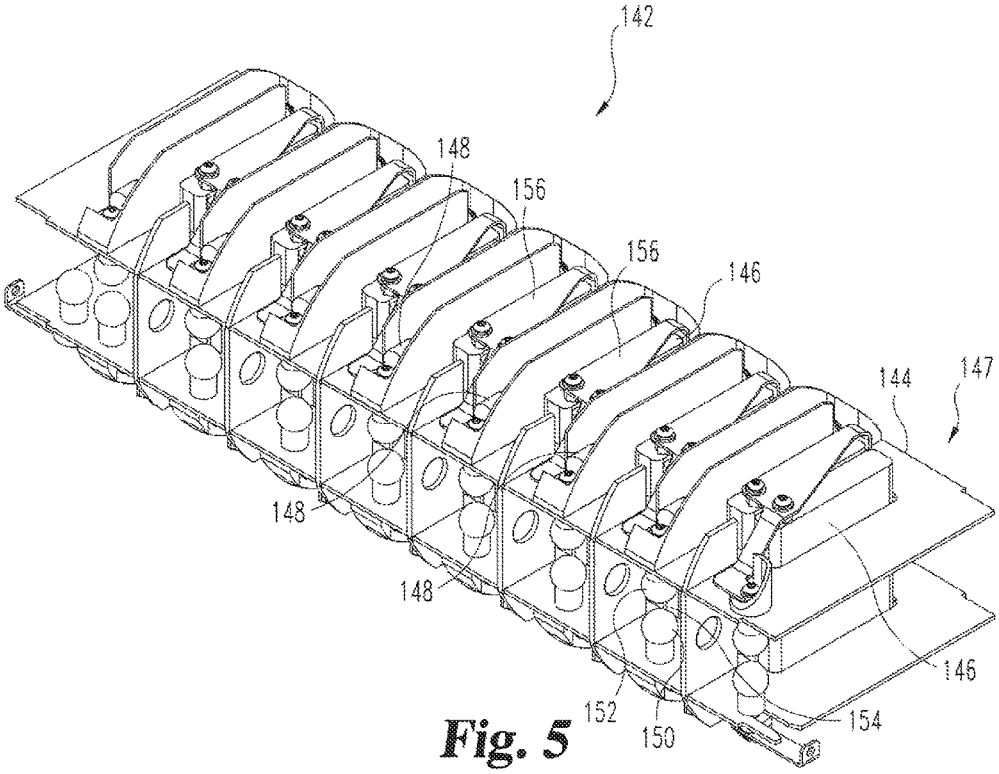
FIG. 5 is a front perspective view of a Marx generator assembly contained in the FIG. 4 casing.
Figure 6:
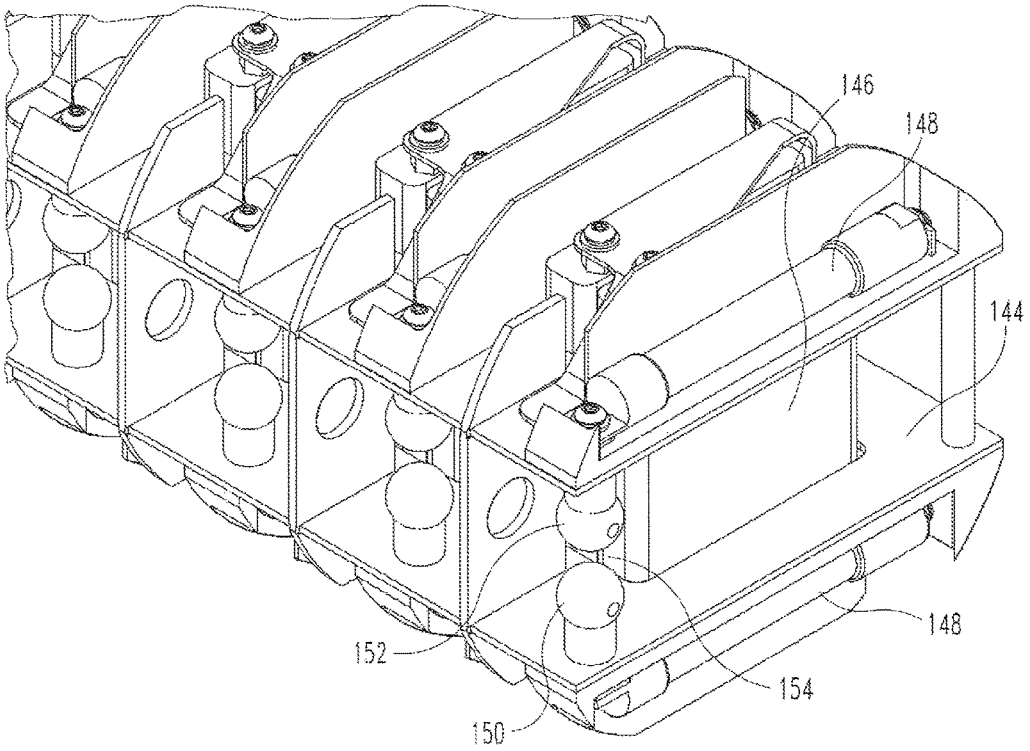
FIG. 6 is a partial perspective view of the FIG. 5 Marx generator assembly.
Figure 7:
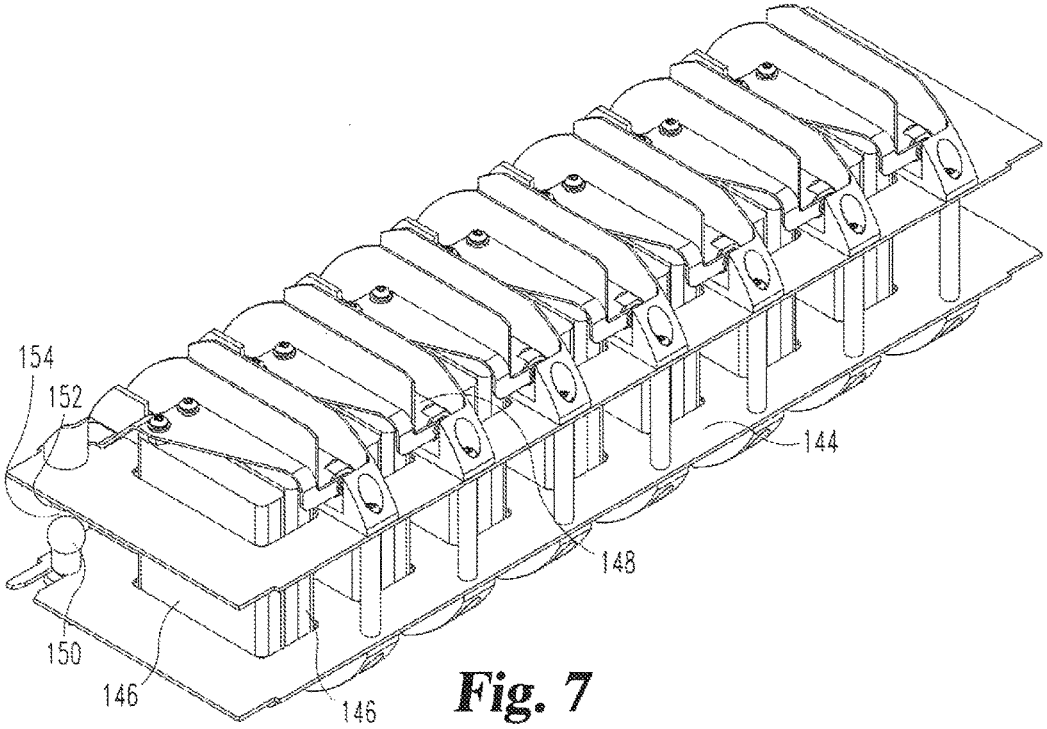
FIG. 7 is a back perspective view of the FIG. 5 Marx generator assembly.

Referring now to FIGS. 5-7, Marx generator 142 is illustrated. Marx generator 142 is housed within casing 130. Marx generator 142 includes frame 144, capacitors 146, resistors 148, electrodes 150 and 152 defining spark gaps 154 and plates 156 electrically coupling electrode 152, capacitors 146 and resistor 148 together. Frame 144 may be constructed of a comparatively non-conductive material. Note that the circuit defined by the illustrated assembly is described below in FIG. 10. Also note that Marx generator 142 may optionally included inductors as described below with regard to FIGS. 15-18 and Marx generator 242.

Figure 8:
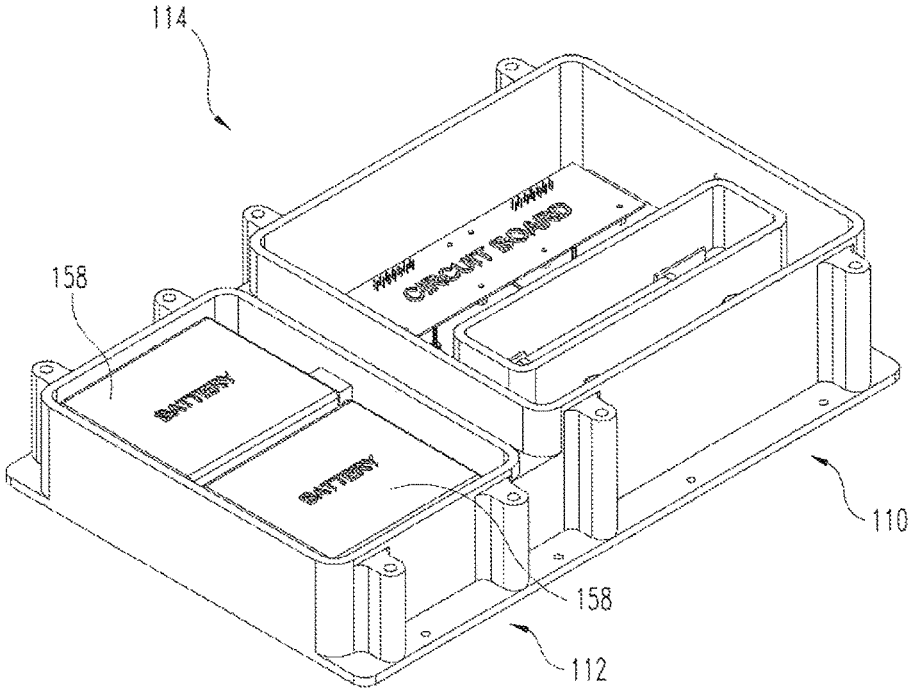
FIG. 8 is a perspective view of a power supply from the FIG. 2 system.
Figure 9:
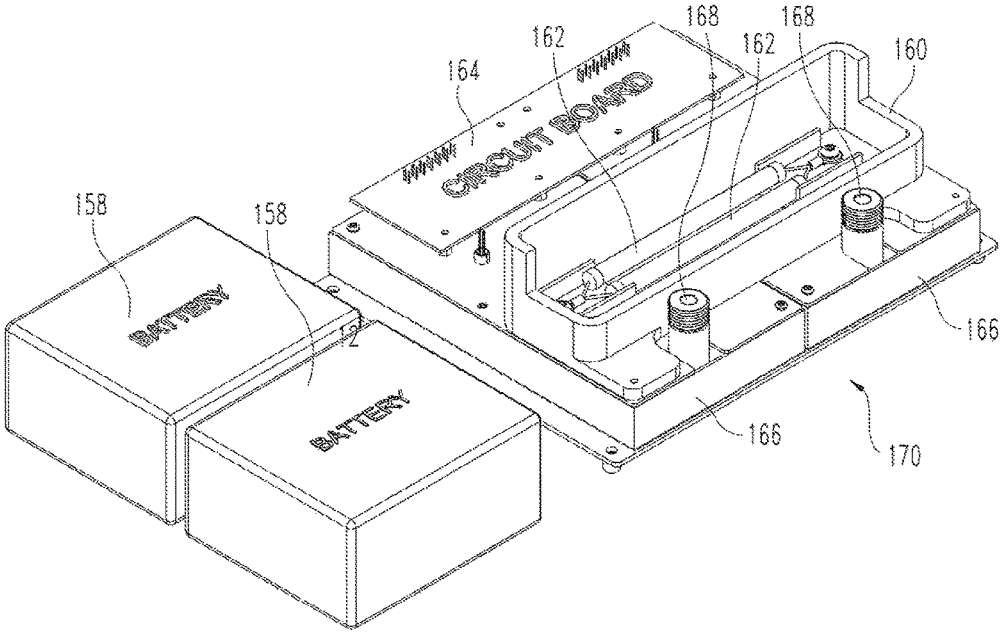
FIG. 9 is a perspective view including partial cross-sections of the FIG. 8 power supply including a battery power source and power converters.

Referring now to FIGS. 8-9, power supply 114 is illustrated with covers 111 and 113 removed. Power source 112 includes a pair of batteries 158. Power converter 110 includes insulator 160, resistors 162, control board 164 and power converters 166. Power converters 166 include power output terminals 168 and resistors 162 connected in parallel defining resistor 170. While not shown in FIGS. 8-9, batteries 158 are connected in parallel as well as power converters 162 being connected in parallel to increase the power output. Circuit board 164 controls the output of power converters 166. In the illustrated embodiment, power converters 166 correspond to model number 30C24-P125 or 30Z24N125 supplied by Ultravolt® at www.ultravolt.com at 1800 Ocean Avenue, Ronkonkoma, N.Y. 11779, telephone number (631) 471-4444.

Figure 10:
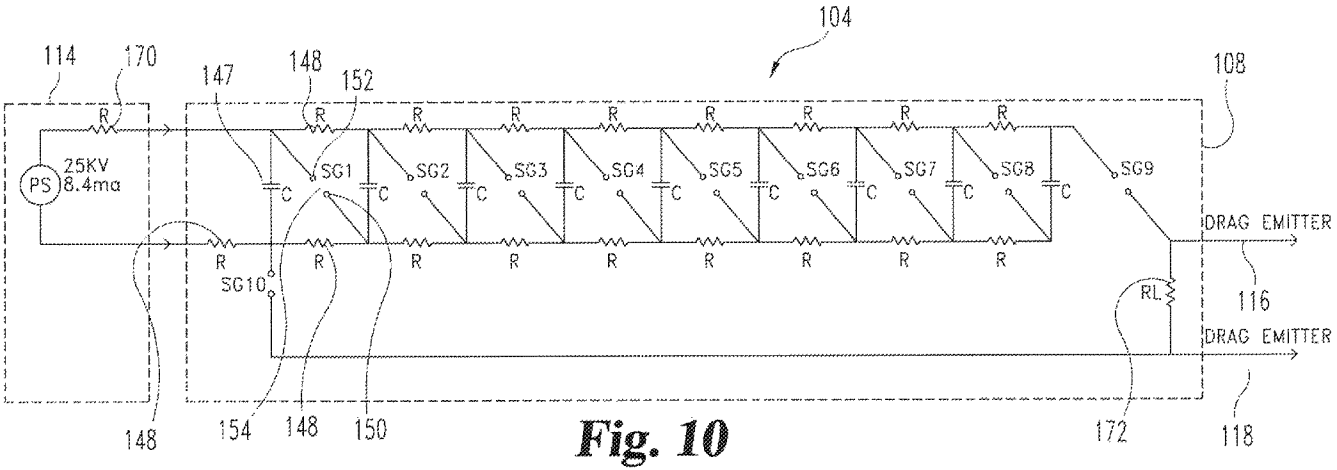
FIG. 10 is an electrical schematic of the FIG. 2 system.

Referring to FIG. 10, an electrical schematic of unit 104 is provided. As seen in FIG. 5, capacitors 146 are connected in parallel defining capacitor 147. Capacitors 147, resistors 148, electrodes 150 and 152 are arranged as a Marx generator with a plurality of stages. The illustrated embodiment includes eight stages. It should be understood that this is a non-limiting example and more or fewer stages may be used. The output of this Marx generator is electrically coupled to emitter 116 with emitter 118 electrically coupled to the input for the Marx generator with load resistor 172 coupled between emitters 116 and 118. Load resistor 172 is contained in housing 140.

In one specific embodiment unit 104 includes the following characteristics. Individual capacitors 146 are rated 0.005 μF with four capacitors 146 combined in parallel to make capacitor 147 rated 0.020 μF. Resistors 148 are ceramic resistors rated at 10 kΩ. Load resistor 172 is rated at 25 kΩ. The breakdown voltage of spark gaps 154 are approximately 25 kV. The illustrated system is configured with power supply 114 providing 25 kV of output power which is used to charge each of the eight capacitors in high voltage module 108 to generate an approximate 200 kV output from high voltage module 108 with approximately 50 J of energy in each discharge. It should be understood that the breakdown voltage of spark gaps 154 can be adjusted upward or downwards within the voltage capacity of the power supply. Similarly, the voltage and energy outputted can be adjusted upward or downward by varying the breakdown voltage and/or the number or capacity of the capacitors.

High voltage module 108 operates automatically as power is continuously supplied from power supply 114 to continuously charge capacitors 147. When sufficient electric potential is contained within each of the capacitors 147, the breakdown voltage of spark gaps 154 is reached and the electric potential generates a plasma field and spark between electrodes 150 and 152. The spark effectively closes the circuit across each of the spark gaps. Once a first spark gap sparks over, the increase voltage generated results in the remaining spark gaps 154 almost simultaneously also sparking over, effectively linking all capacitors 147 in series, resulting in a multiplication of the input voltage by the number of capacitors in the Marx generator. In one embodiment, this generates a 200 kV output applied to emitter 116.

Spark gaps 154 may all be constructed and arranged to have substantially similar break down voltages. Alternatively, one spark gap 154 may be constructed and arranged with a slightly lower break down voltage than the rest of the spark gaps. The spark gap with the lowest breakdown voltage will become the triggering spark gap with the resulting increased voltage being sufficient to immediately break down all other spark gaps 154 connected to the triggering spark gap.

Another alternative is to include a mechanical trigger associated with a triggering spark gap that initiates the break down and spark over of the trigger spark gap on a controlled command. For example, a conductor can be introduced into the trigger spark gap to lower the effective break down voltage or an energy source such as a laser could be used to heat the air or gas in the triggering spark gap to also lower the effective break down voltage of the triggering spark gap.

Figure 11:
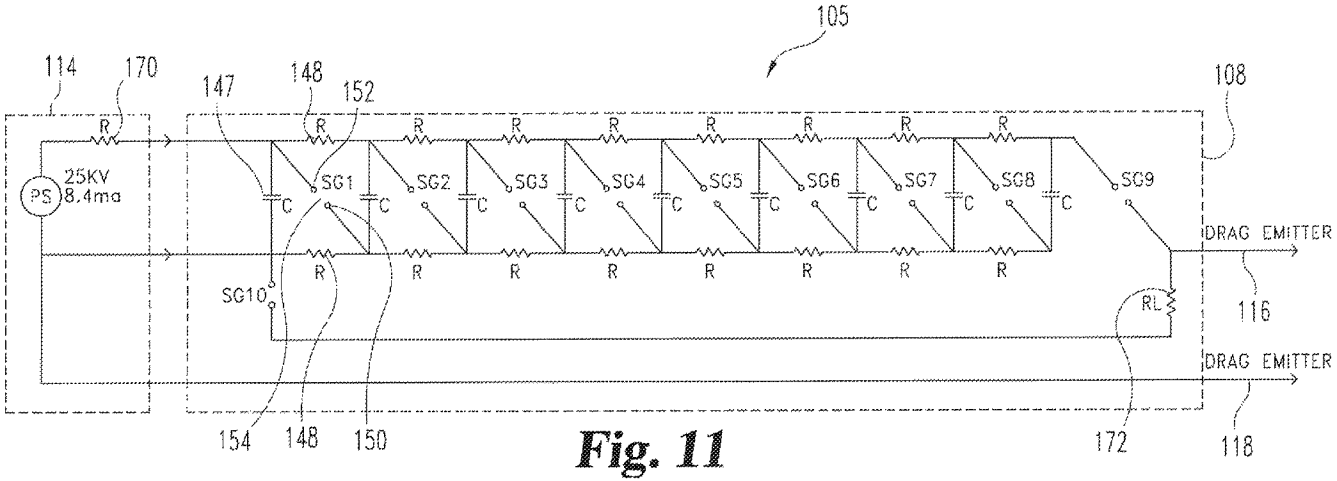
FIG. 11 is an electrical schematic of an alternate embodiment of the FIG. 2 system.

Referring to FIG. 11, an electric schematic of module 105 is provided. Module 105 is an alternate embodiment of module 104. Capacitors 147, resistors 148 and electrodes 150 and 152 are arranged again as an nine-stage Marx generator. (Note that any number of stages can be used as desired. Applicants are currently using an seven-stage Marx generator instead of the illustrated nine-stage unit.) Once again, the output of the Marx generator is electrically coupled to emitter 116 with emitter 118 electrically coupled to the low voltage side of power supply 114. In module 105 load resistor 172 is electrically coupled between emitter 116 and to the input to the Marx generator. Module 105 also differs from unit 104 in that resistor 148 positioned between the low side of power supply 114 and the input to the Marx generator is omitted. In module 105, emitter 118 may be directly coupled to a relative ground such as a vehicular ground.

In system 100, high voltage module 108, power converter 110 and power source 112 operate together, as described above, to define a source of pulsed electrical potential.

Figure 12:
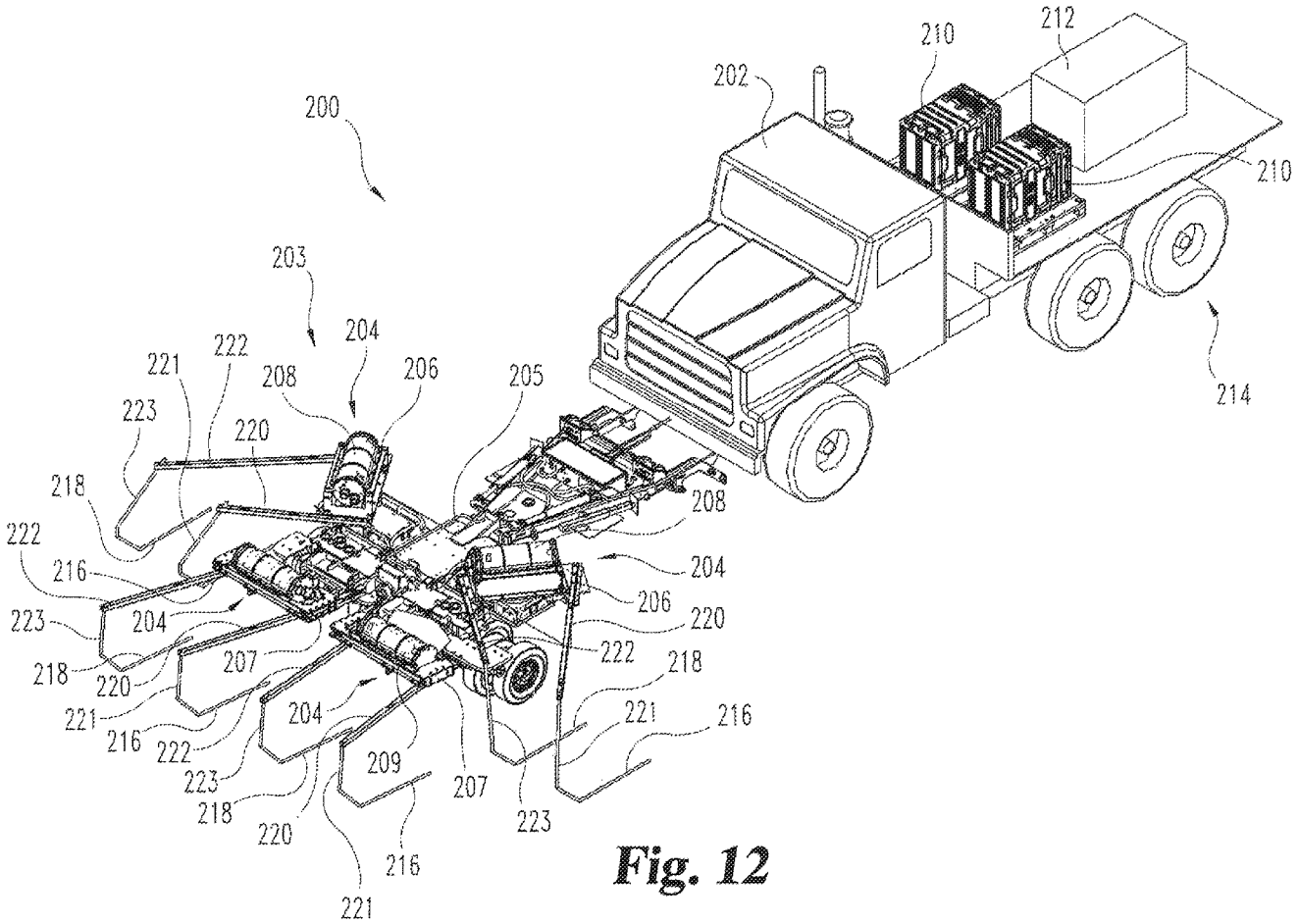
FIG. 12 is a perspective view of a mine roller mounted electrical discharge system according to a second embodiment of the present disclosure

Referring to FIG. 12, system 200 is illustrated. System 200 includes vehicle 202 and assembly 203. In the illustrated configuration vehicle 202 is a U.S. military flatbed truck and assembly 203 is mounted on a modified U.S. military mine roller assembly.

Assembly 203 is generally defined by mine roller 205 which is a standard US military mine roller. It should be understood that other vehicular platforms may be used in conjunction with the disclosed electrical discharge systems. Mine roller 205 carries a plurality of units 204 that include high voltage modules 208 and 209. Vehicle 202 carries one or more power converters 210 and power source 212. Power converters 210 and power source 212 define power supply 214. Power converters 210 and power source 212 are carried in the bed of vehicle 202. Note that power converters 210 and power source 212 may be located in any desired position on the vehicle, including on mine roller 205 or elsewhere on vehicle 202. In the illustrated embodiment, power source 212 is a NATO standard 10 kW palletized generator/engine assembly. However, any other power source can be used including solar cells, batteries, an onboard vehicle alternator or generator, etc.

High voltage modules 208 and 209 also include emitters 216 and 218 extended away from mine roller 205 by rigid supports 220 and 222 and flexible supports 221 and 223. Emitters 216 and 218 as illustrated are flexible metal chains constructed and arranged to flex in one direction while maintaining relative rigidity in the other directions. As discussed above, emitters 216 and 218 may be constructed from alternative materials, as desired. Supports 220 and 222 are comparatively rigid structures constructed of a comparatively non-conductive material that carries emitters 216 and 218 and flexible supports 221 and 223. Flexible supports 221 and 223 are located between emitters 216 and 218 and rigid supports 220 and 222. Flexible supports 221 and 223 include some degree of flexibility and bias.

Emitters 216 and 218 are configured with emitter surfaces that are in close contact with the earth. In one embodiment, the emitter surfaces of emitter 216 and 218 are approximately 0.5 meters in length. In another embodiment, the emitter surfaces of emitter 216 and 218 are at least 0.3 meters in length. In yet another embodiment, the emitter surfaces of emitter 216 and 218 are at least 0.2 meters in length. In another embodiment, the emitter surfaces may be between approximately 0.5 to 1.5 meters in length. In one embodiment, emitters 216 and 218 may be spaced apart between approximately 0.5 meters to approximately 2.25 meters. In another embodiment, emitters 216 and 218 may be spaced apart between approximately 0.6 meters to approximately 1.2 meters. In any event, it should be noted that emitters 216 and 218 may be any desired length.

Figure 13:
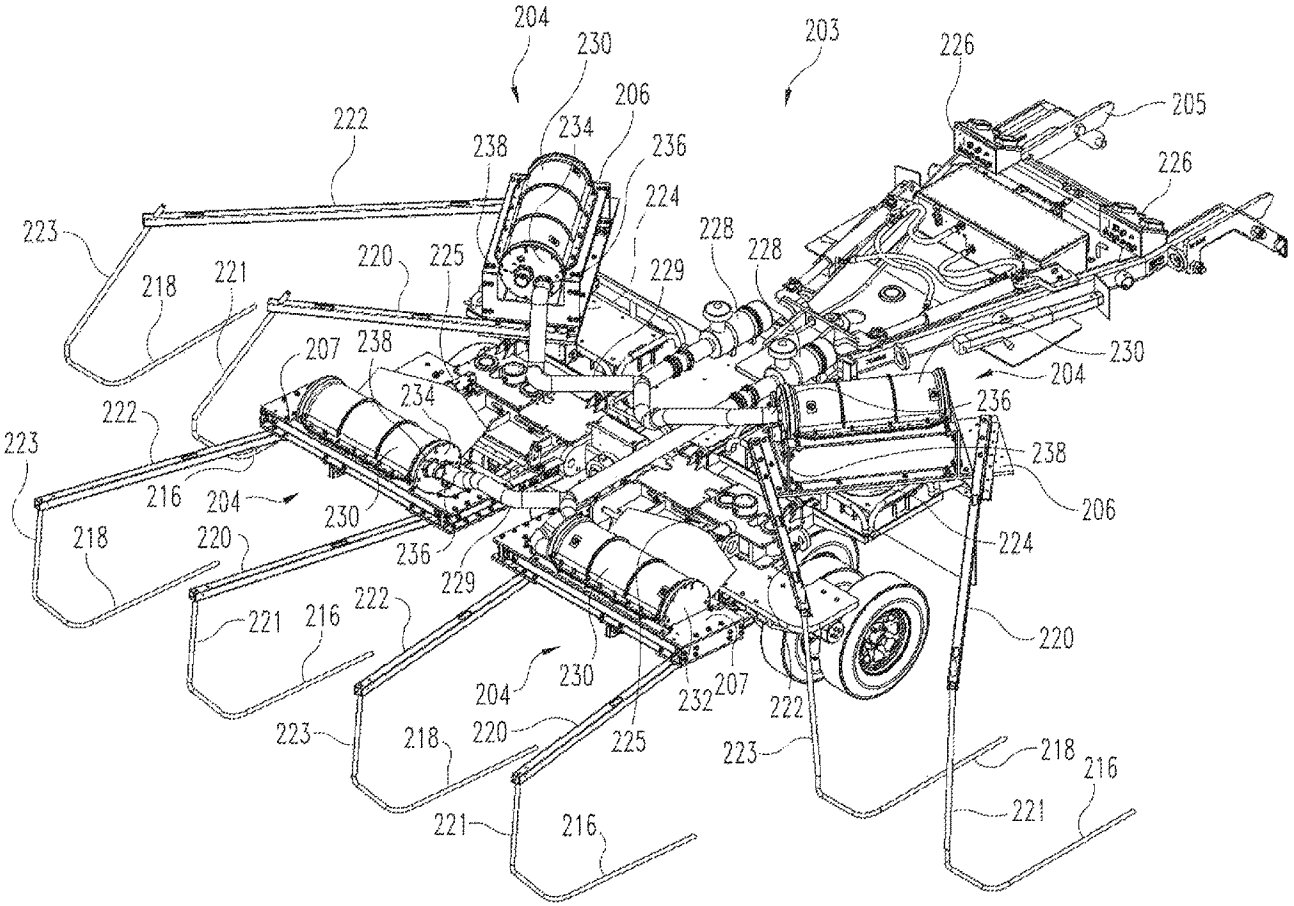
FIG. 13 is a perspective view of the FIG. 12 mine roller.

Assembly 203 is shown in isolated detail in FIG. 13. High voltage module 208 is mounted on frame 206 and high voltage module 209 is mounted on frame 207. Frame 206 is coupled to mine roller 205 via swivel connection 224. Frame 207 is coupled to mine roller 205 via tilt connection 225. Swivel connection 224 and tilt connection 225 are configured and arranged to permit emitters 216 and 218 to be stowed for transport.

Frames 206 and 207 and swivel connection 224 and tilt connection 225 are all constructed of comparatively non-conductive material to isolate high voltage modules 208 and 209 from mine roller 205. In general, a minimum of a 15 cm clearance between high voltage modules 208 and 209 and mine roller 205 was sought. Dielectric materials may be optionally located between high voltage components and mine roller 205.

Also mounted on mine roller 205 are junction boxes 226. Junction boxes include wire terminations between power converters 210 and high voltage modules 208 and 209 (wires not illustrated). Junction boxes 226 also include emergency disconnects to disconnect power converters 210 from high voltage modules 208 and 209. Junction boxes 226 may optionally be omitted in other embodiments.

Blowers 228 are optionally mounted on mine roller 205 and are coupled to high voltage modules 208 and 209 by flexible air lines 229 to assist with heat removal from high voltage modules 208 and 209. High voltage modules 208 and 209 include casings 230 with caps 232 and 234. Cap 234 includes air inlet 236 and air outlet 238. Flexible air lines 229 are coupled between blowers 228 and air inlets 236 on each high voltage modules 208 and 209.

Figure 14:
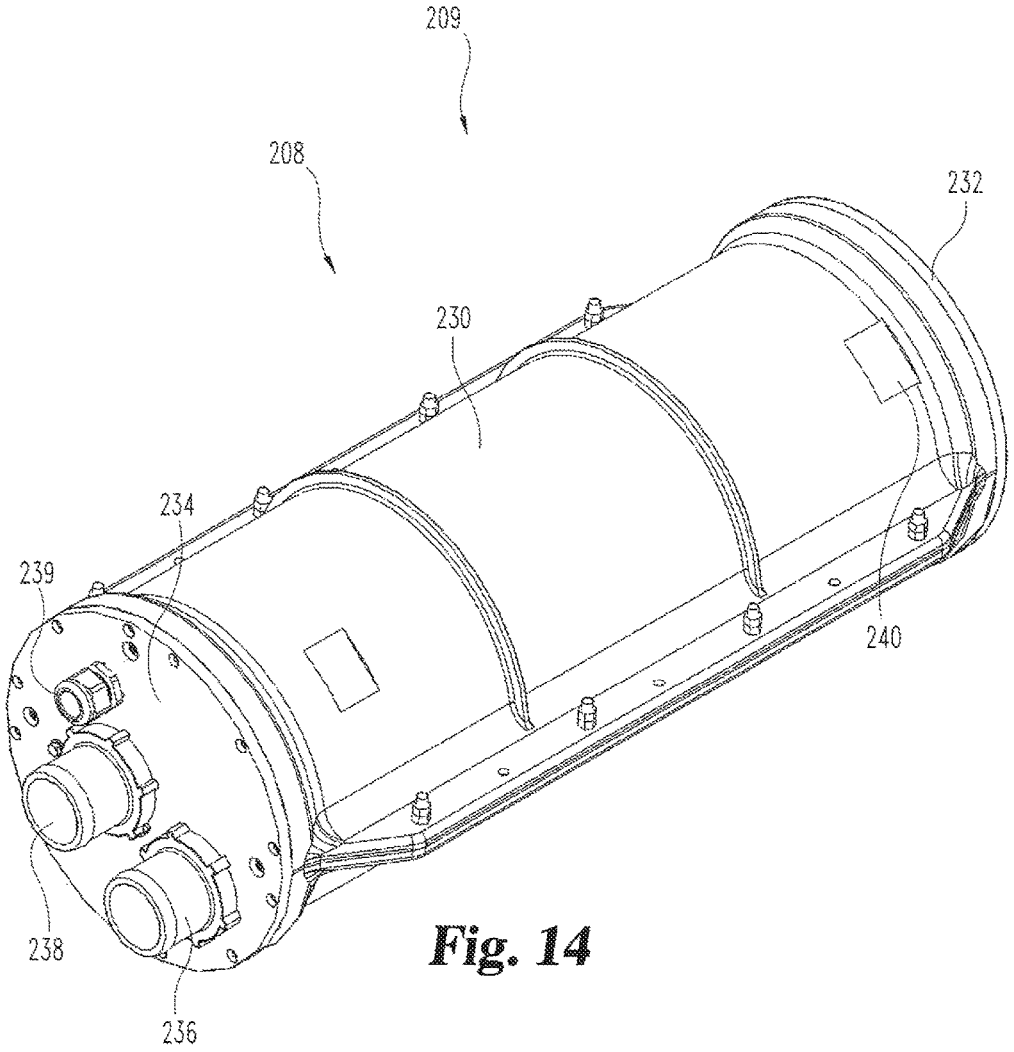
FIG. 14 is a perspective view of a high voltage module mounted on the FIG. 12 mine roller.

Referring now to FIG. 14, high voltage modules 208 and 209 are illustrated in isolated detail. High voltage modules 208 and 209 also include wire fitting 239 on cap 234 and output terminal 240 in casing 230. Wire fitting 239 is a strain relief fitting through which a high voltage cable passes to connect to unit 204. Output terminal 240 is coupled to unit 204 contained within casing 230.

Referring now to FIGS. 15-18, Marx generator 242 is illustrated. Marx generator 242 is housed within casing 230 in each of high voltage modules 208 and 209. Marx generator 242 includes frame components 244, capacitors 246, resistors 248, inductors 250, electrodes 251 and 252 defining spark gaps 254. Capacitors 246 are connected in parallel defining capacitor groups 247 and resistors 248 are also connected in parallel in groups defining resistor groups 249. Note that the circuit defined by the illustrated assembly is described below in FIGS. 23-24.

Figure 17:
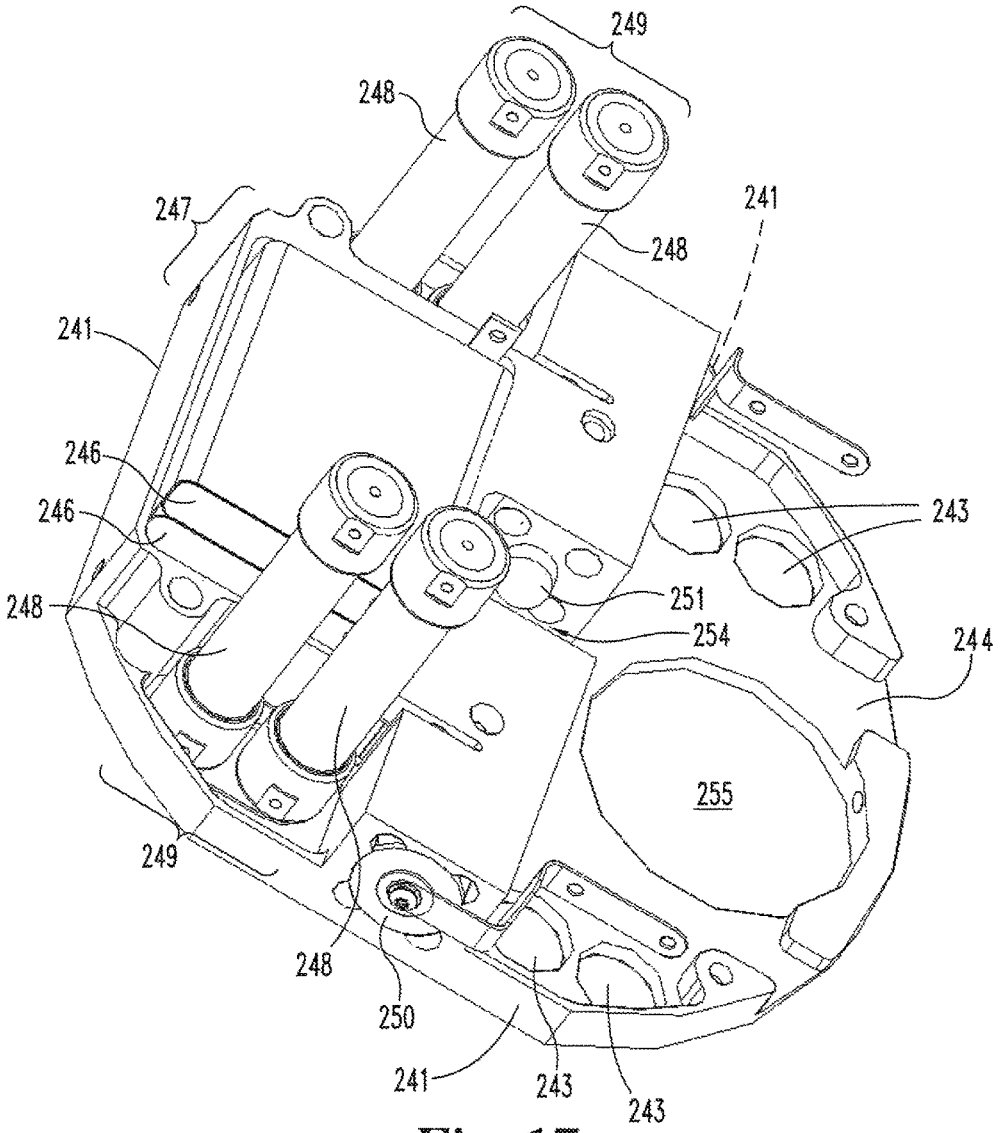
FIG. 17 is a perspective view of one assembly component of the FIG. 15 Marx generator.
Figure 18:
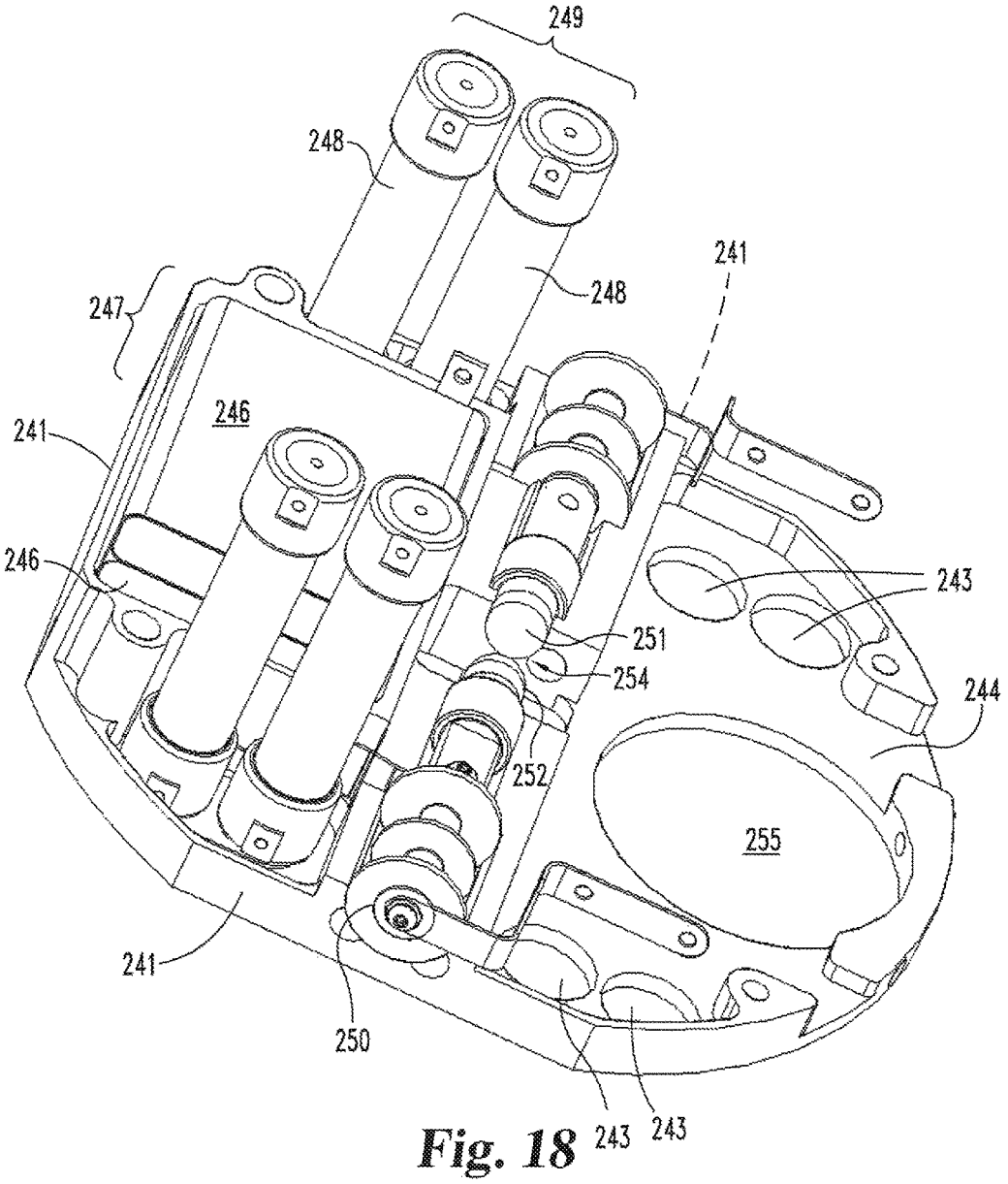
FIG. 18 is a perspective view of the FIG. 17 assembly with partial cross-sectional views.

As best seen in FIGS. 17-18, Marx generator 242 is assembled from stacked frame components 244 each including individual stages of the Marx generator. Larger or smaller Marx generators may be assembled by including additional or fewer frame components 244 assemblies. Also as best seen in FIGS. 17-18, frame components 244 include recess 255 that goes through the length of Marx generator 242. Recess 255 defines a continuous air path for cooling air as well as the space where a load resistor is located (as shown in FIG. 19 and described in FIGS. 23-24).

Figure 15:
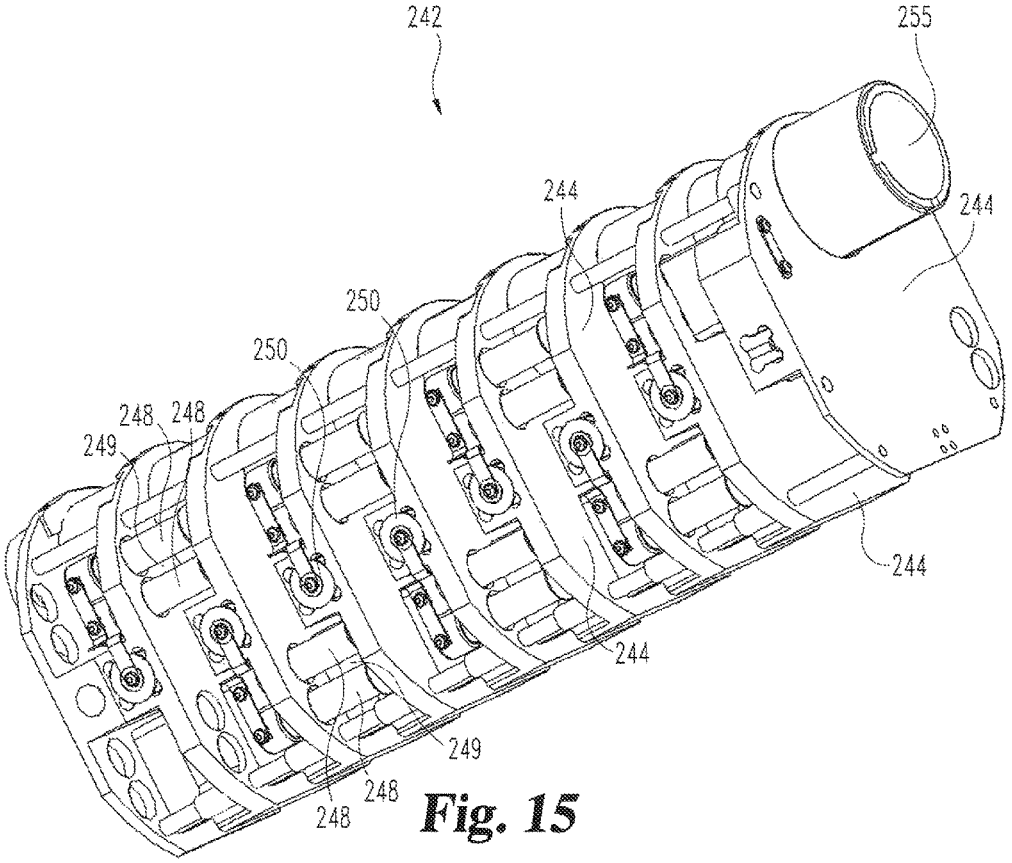
FIG. 15 is a front perspective view of a Marx generator enclosed within the FIG. 14 high voltage module.
Figure 16:
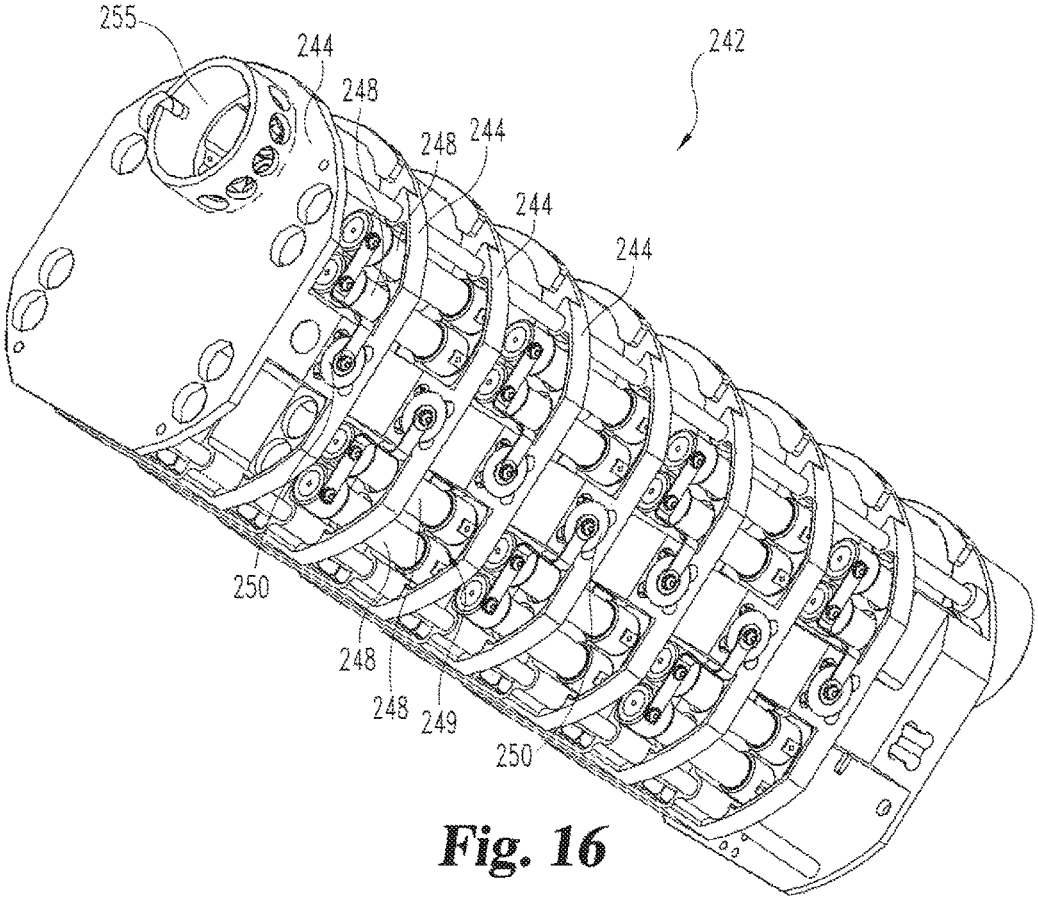
FIG. 16 is a back perspective view of the FIG. 15 Marx generator.
Figure 68:
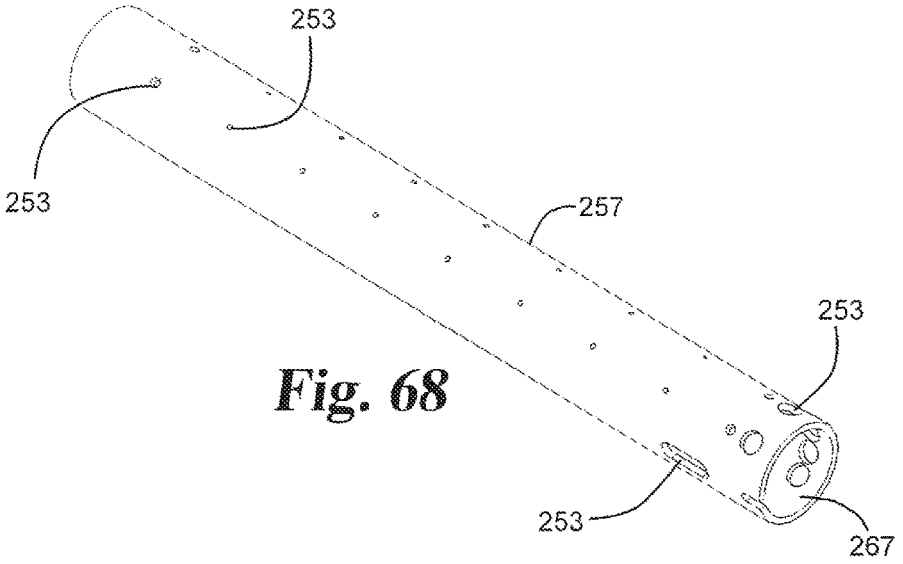
FIG. 68 is a perspective view of an alternative embodiment of a load resistor tube.
Figure 69:
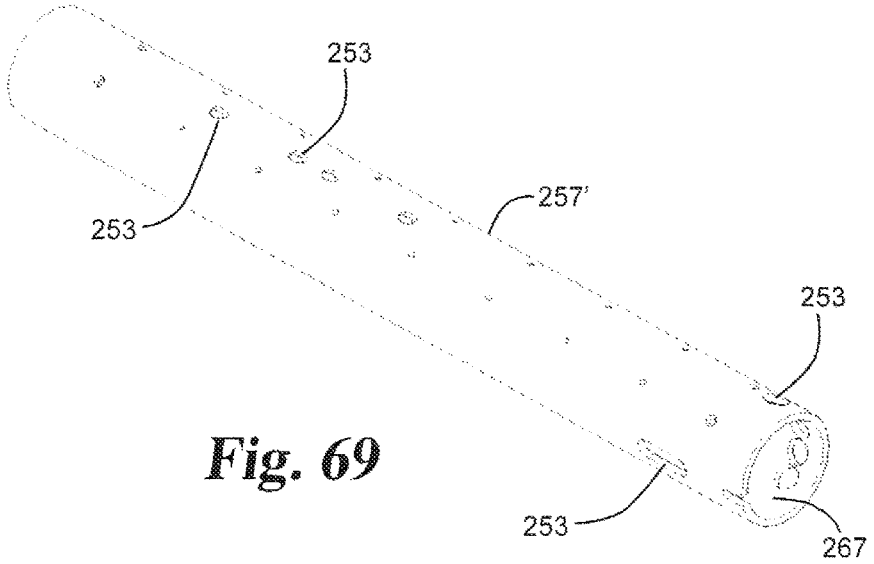
FIG. 69 is a perspective view of an alternative embodiment of a load resistor tube.

Recess 255 may optionally contain load resistor tube 257 (described below) containing load resistor 256. FIGS. 68 and 69 illustrate two embodiments of load resistor tube 257 with orifices of various sizes in various positions to divert airflow from the load resistor tube to other parts of Marx generator 242. In addition to recess 255, each Marx generator 242 as shown in FIGS. 15 and 16 includes three sides flat faces 241 that may provide a pathway for air to move past stacked frame components 244 when the Marx generator 242 is installed in casing 230. The air flow may assist in cooling components of Marx generator 242. Additionally, as seen in FIG. 18, matching pass through holes 243 in each frame component 244 allow stage resistors 249 to extend through adjacent stage frames 244. Pass through holes 243 may optionally be circular or oval or other shapes promote air to circulate past the resistors to assist in cooling resistors 249 during operation.

While not specifically illustrated, Marx generator 242 may optionally include a luminance meter configured to monitor the relative luminance of one or more spark gaps 254. For example, in one embodiment, an exposed end of a fiber optic cable is directed at a spark gap 254 to transmit emitted light to a separately located luminance meter. The relative luminance of sparks emitted from the spark gap change based on the relative resistivity experienced during a particular discharge. Discharges into relatively high impedance environments result in lower relative luminance while discharges into relatively low impedance environments result in a significantly higher relative luminance. The measured luminance for a particular discharge can be compared against a baseline standard for a particular environment. If the standard is exceeded that may indicate the presence of a conductive material that warrants further investigation. If the luminance for a particular discharge exceeds the standard, then the operator of system 200 (or 100) can be notified of such by illuminating an indicator light or activating a marking system to mark the location on the ground or record GPS coordinates where the discharge took place. The detected conductive material can then be re-scanned by systems 100 and/or 200, can be investigated immediately, or recorded coordinates can be transmitted via communications systems for further investigation.

Figure 19:
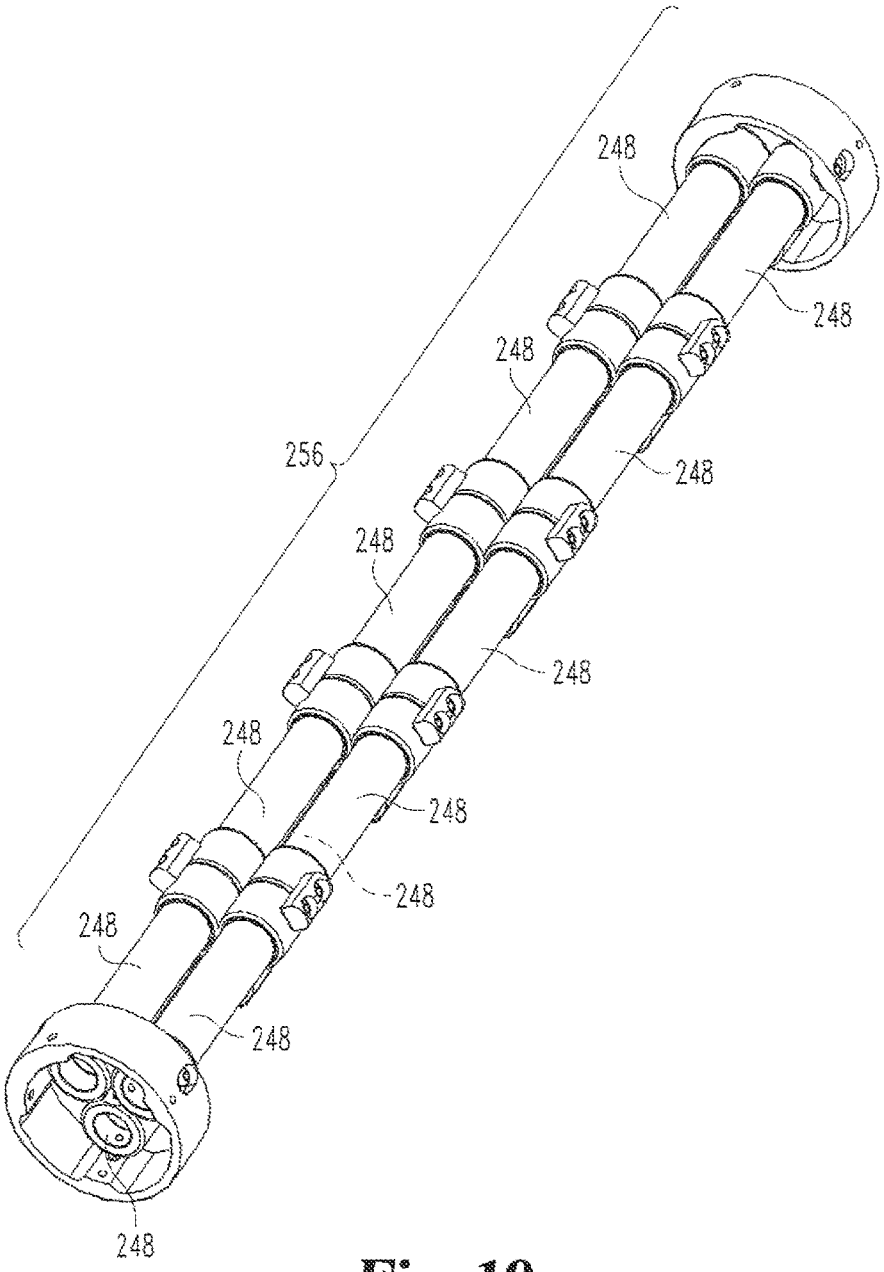
FIG. 19 is a perspective view of a load resistor assembly also enclosed within the FIG. 14 high voltage module.

Referring now to FIG. 19, load resistor 256 is illustrated. Load resistor 256 is assembled from five groups of three resistors 248 connected in parallel. Load resistor 256 is configured and arranged to fit within recess 255 defined in Marx generator 242. Load resistor 256 can be constructed from any desired combination of resistors in series and/or parallel to achieve desired characteristics such as resistance, heat dissipation, etc. Ambient air can be drawn through filters to remove particulate matter and then blown into the HV module. The majority of the volume of air can first be blown through a load resistor tube across all of the resistors in the load resistor assembly. The load resistor tube may optionally have holes drilled in it to allow air to escape the tube and blow past other parts of the module. When the air reaches the other end of the HV module, the air may exits the load resistor tube and travel back through the module around the other HV module components including resistors, spark gaps, etc. cooling other parts of the HV module. In some instances, air may be selectively diverted from the load resistor tube and directed toward specific areas of the module that may be found to generate and/or build up more heat than other components in the HV module.

Referring now to FIG. 68, load resistor tube 257 is illustrated. Load resistor tube is constructed and arranged to extend through recess 255 through the length of Marx generator 242. Load resistor tube is a cylindrically shaped tube that defines recess 267 that extends the length of load resistor tube 257. Load resistor tube defines a plurality of orifices 253. As described above, orifices 253 may be constructed and arranged to selectively divert forced air to exit from recess 267 and direct the diverted airflow toward specific areas or components of Marx generator 242. Orifices 253 may be any size or shape desired. In general, larger orifices will divert more air than smaller orifices will. In this regards, FIG. 69 illustrates load resistor tube 257' that includes a larger number of orifices 253 and generally larger orifices 253.

Figure 20:
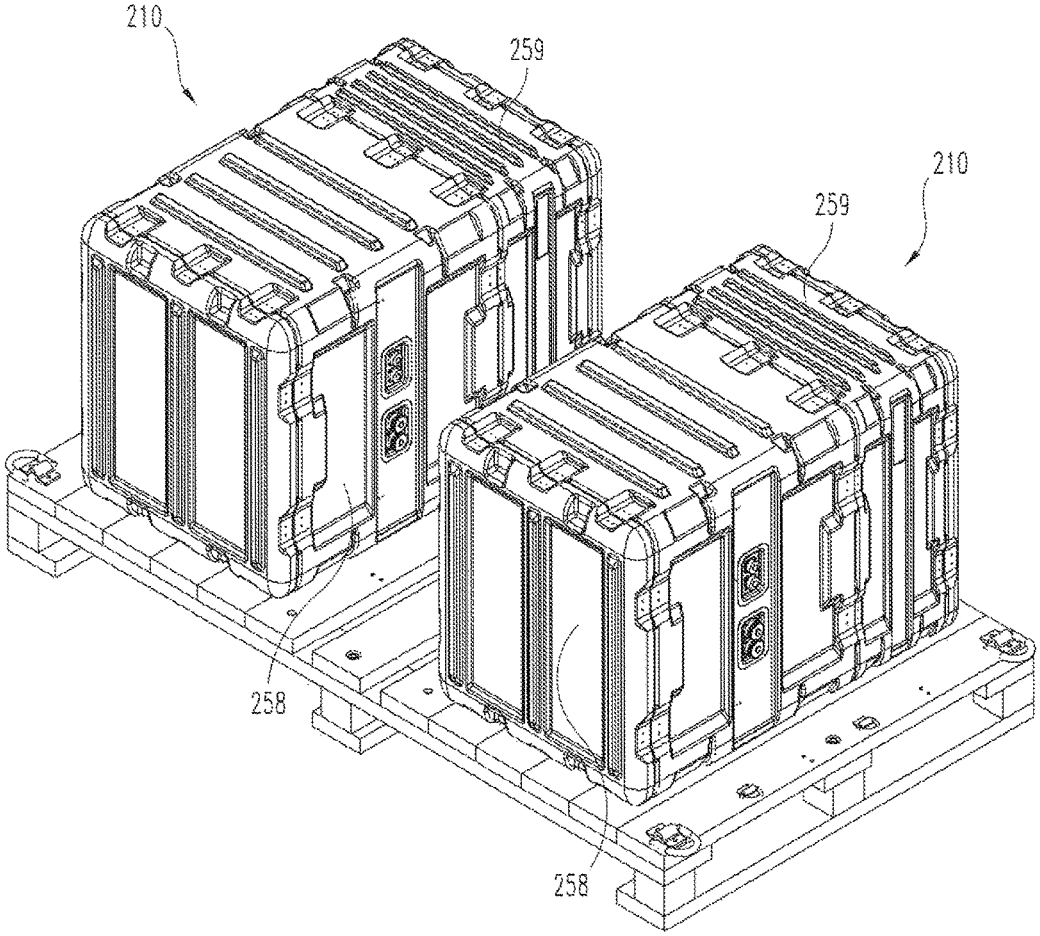
FIG. 20 is a front perspective view of power converters from the FIG. 12 system.
Figure 21:
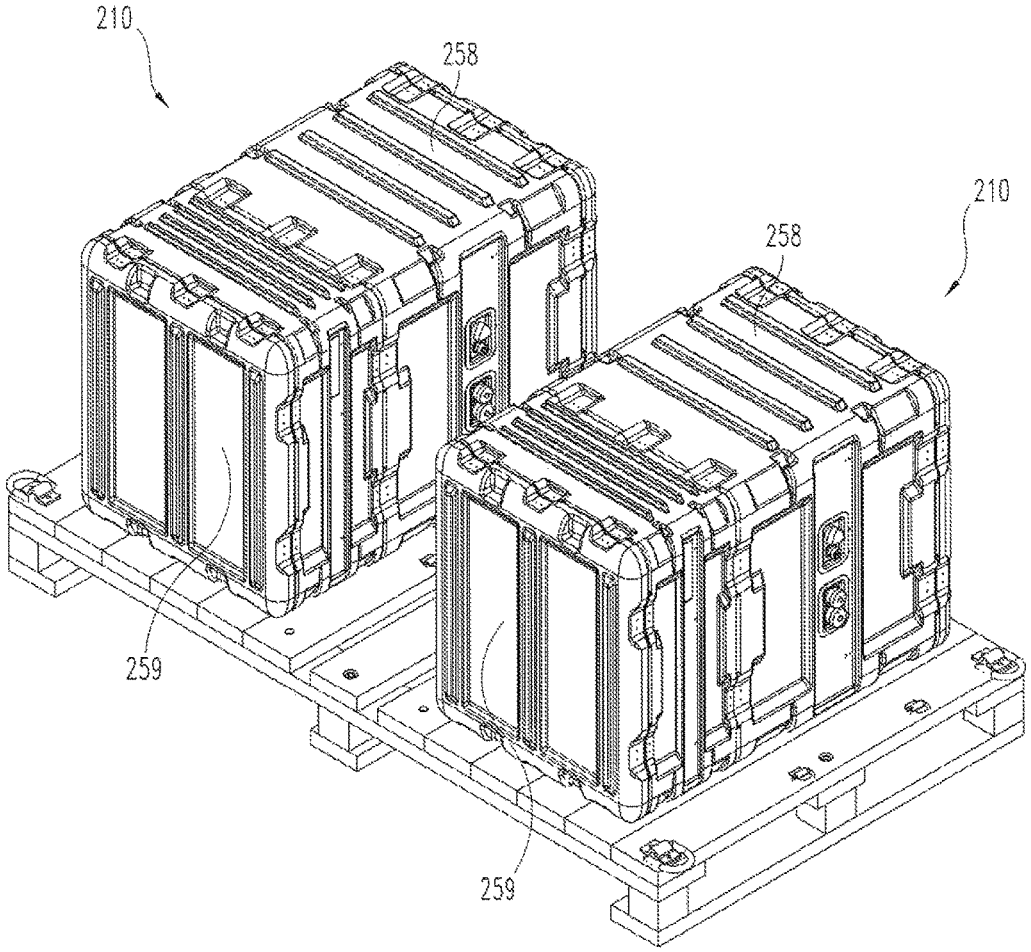
FIG. 21 is a back perspective view of the FIG. 20 power converters.

Referring now to FIGS. 20-21, power converters 210 are illustrated. Power converters 210 include casing 258 which includes air conditioning/heating unit 259 attached to one side of casing 258. While not specifically referenced, casing 258 includes connectors for high voltage cables and control cables. Each casing 258 may also optionally include one or more emergency stop button(s) to disconnect the output of power converters 210 from the rest of system 200.

Figure 22:
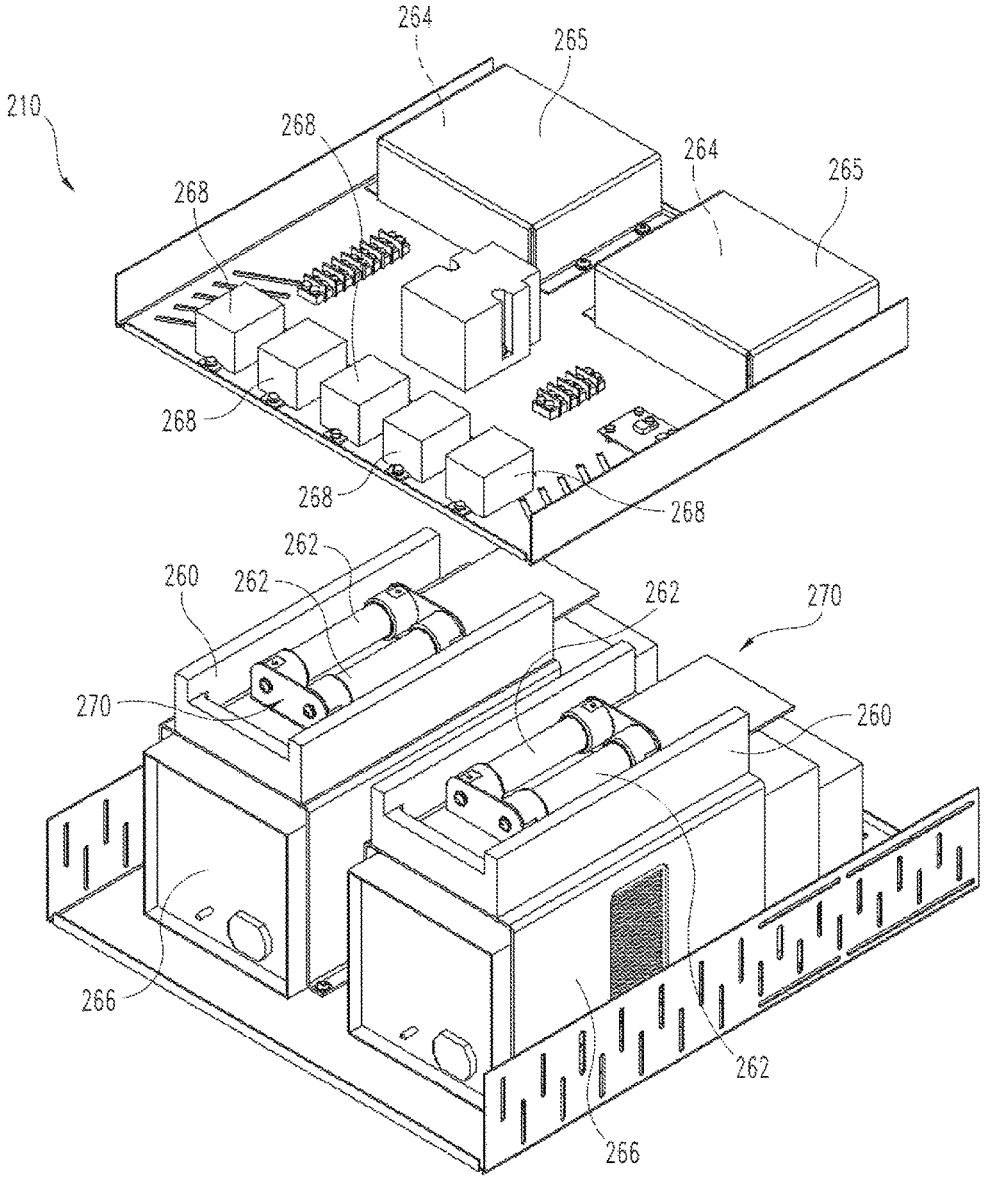
FIG. 22 is a perspective view of components included within the outer casing of the FIG. 20 power converters.

Referring now to FIG. 22, an interior layout of components contained within casing 258 is provided. Power converter 210 includes insulator 260 holding a pair of resistors 262, control boards 264 covered by shields 265 and two power converters 266 and relays 268. Resistors 262 are connected in parallel defining resistors 270. Control boards 264 control the output of power converters 266 and engagement of relays 268 to control both the output of power converter 266 and the availability of output power from power converters 266. Power converters 266 are known in the industry as capacitor charging power supplies. Power converters 266 correspond to model number 202A-40KV-POS-PFC or 202A-40KV-NEG-PFC supplied by TDK-Lambda at 3055 Del Sol Boulevard, San Diego, Calif. 92154, telephone number (619) 575-4400, www.tdk-lambda.com. However, any other type of capacitor charging power supply known in the art that meets the requirements of a particular system my be used.

Figure 23:
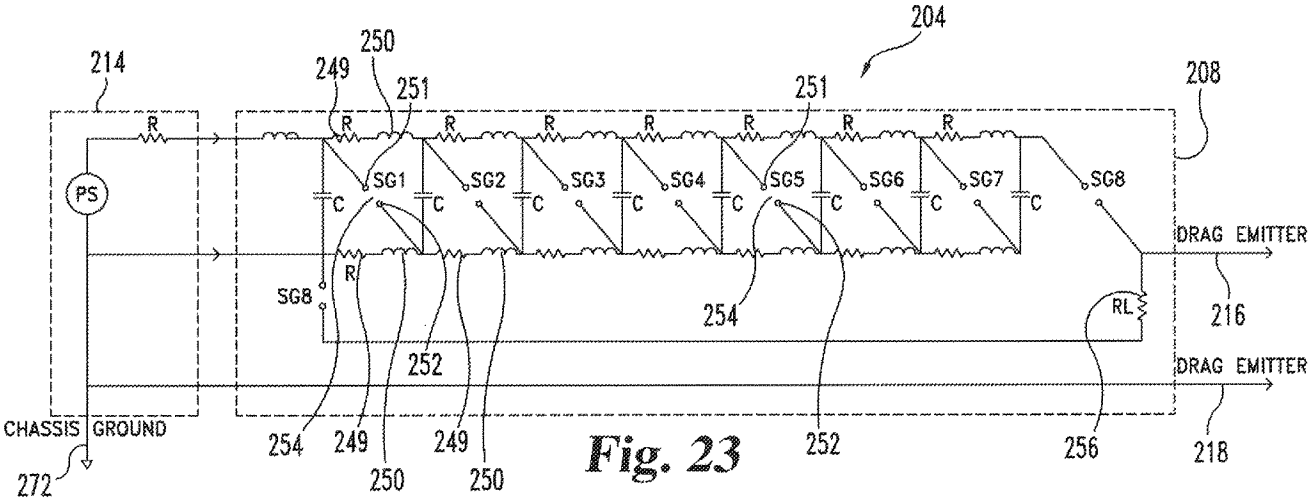
FIG. 23 is an electrical schematic of the FIG. 12 system.
Figure 24:
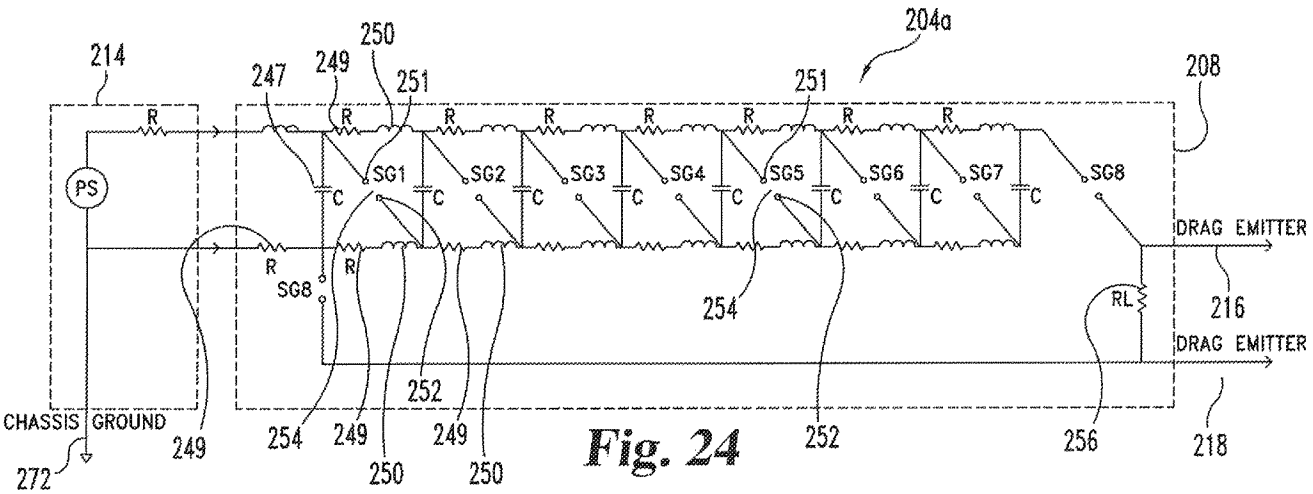
FIG. 24 is an electrical schematic showing an alternative embodiment of the FIG. 12 system.

Referring to FIG. 23, an electric schematic of module 204 is provided as seen in FIGS. 17-18, capacitors 246 are connected in parallel defining capacitor groups 247 and resistors 248 are connected in parallel defining resistor group 249. Capacitor groups 247, resistor groups 249, inductors 250 and electrodes 251 and 252 are arranged as a multi-stage Marx generator (as shown in FIGS. 15-16). The output of this Marx generator is electrically coupled directly to emitter 216 with emitter 218 electrically coupled to chassis ground 272. Load resistor 256 is electrically coupled between emitter 216 and the low power side of Marx generator 242. The illustrated system can be configured with power supply 214 providing a nominal 54 to 81 J of output power used to charge seven capacitors in high voltage module 208 or 209 to generate approximately 224 kV output applied to emitter 216.

In one specific embodiment high voltage module 208 includes the following characteristics. Individual capacitors 246 are rated 0.0075 μF with three capacitors 246 combined in parallel to make capacitor group 247 rated 0.0225 μF. Resistors 248 are ceramic resistors rated at 10 kΩ with two resistors 249 connected in parallel to make resistor group 249 rated 5 kΩ. Inductors 250 are rated 3 mH. Load resistor 256 is assembled from five groups of three resistors 248 connected in series, with the groups of three resistors 248 connected in parallel for an overall rating of 16.7 kΩ for load resistor 256. The breakdown voltage of spark gaps 254 are approximately 32 kV, although the breakdown voltage could optionally be set between 25 kV and 38 kV. The illustrated system is configured with power supply 214 providing up to 40 kV of output power which is used to charge seven capacitor groups in high voltage module 208 to generate a nominal 224 kV output from high voltage module 108 with approximately 81 J of energy in each discharge. This described embodiment of high voltage module 208 is constructed and arranged to continuously discharge approximately 10 times each second, although the pulse frequency can be adjusted via the control software.

In one specific embodiment high voltage module 209 includes the following characteristics. Individual capacitors 246 are rated 0.0075 μF with two capacitors 246 combined in parallel to make capacitor group 247 rated 0.0015 μF. Resistors 248 are ceramic resistors rated at 10 kΩ with two resistors 249 connected in parallel to make resistor group 248 rated 5 kΩ. Inductors 250 are rated 3 mH. Load resistor 256 is assembled from five groups of three resistors 248 connected in series, with the groups of three resistors 248 connected in parallel for an overall rating of 16.7 kΩ for load resistor 256. The breakdown voltage of spark gaps 254 are approximately 32 kV, although, once again, the breakdown voltage could be varied between 25 kV and 38 kV, as desired. The illustrated system is configured with power supply 214 providing up to 40 kV of output power which is used to charge seven capacitors in high voltage module 209 to generate a 224 kV output from high voltage module 108 with approximately 54 J of energy in each discharge. This described embodiment of high voltage module 209 is constructed and arranged to continuously discharge approximately 15 times each second. Note that alternative configurations of high voltage module 209 may utilize components, including capacitors 246, resistors 248, inductors 250, load resistor 256 and spark gaps 254 with different ratings, as desired. High voltage module 209 may also be constructed and arranged to discharge at different frequencies by modifying hardware and/or control system inputs.

Figure 25:
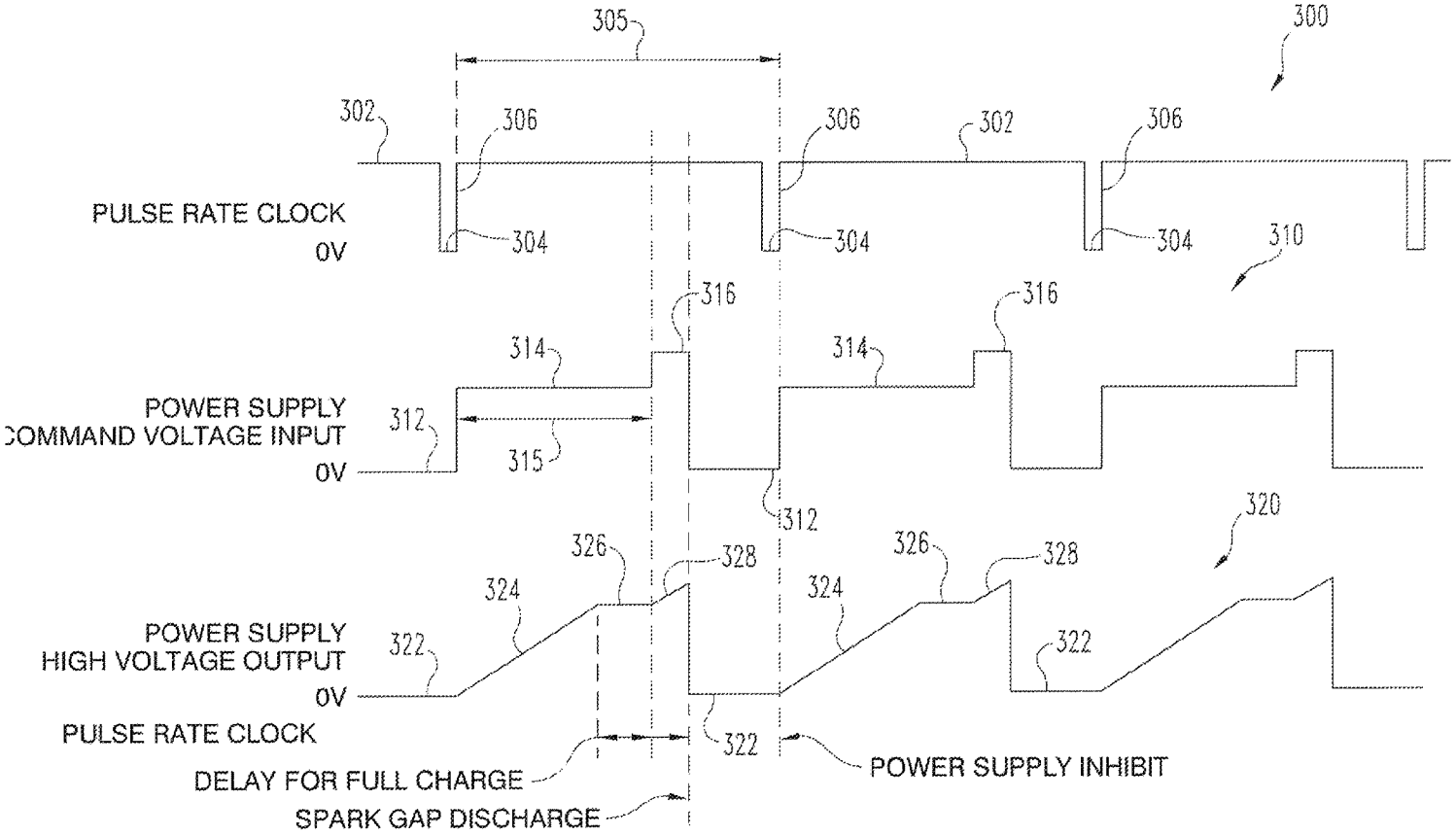
FIG. 25 is a timing diagram illustrating a pulse rate clock, power supply command voltage input and a power supply high voltage output along a common timeline during operation of one embodiment of the FIG. 12 system.

Referring now to FIG. 25, pulse rate clock waveform 300, power supply command voltage input waveform 310 and power supply output voltage waveform 320 are shown. Pulse rate clock waveform 300 represents a control timing signal provided by or to control board 264 in power converter 210. Pulse rate clock waveform 300 includes control voltage signal 302, zero volt signal 304 and delay 305 between successive signals 306. Signal 306 is the transition from zero volt signal 304 to the control voltage signal 302. Signal 306 indicates to control board 264 to command power converter 266 to begin providing the programmed output voltage. In one embodiment, delay 305 between successive signals 306 is equal to approximately 100 ms. In another embodiment, delay 305 between successive signals 306 is equal to approximately 66 ms. In yet another embodiment, delay 305 may be automatically determined by a processor at least in part based on the indicated velocity of vehicle 202. For example, an emitter 216 could be used to discharge across a continuous length of ground. If vehicle 202 is traveling at 50 km per hour (13.9 m/s) and if emitter 216 is 1 m long, then 13.9 discharges per second would cover a continuous length of ground with pulsed discharges. 13.9 discharges per second equates to a delay of 72 ms, which could be automatically provided by a processor as an adjustable delay 305 in signal 306.

Power supply command voltage input waveform 310 represents the electrical control signal provided by control board 264 to power converter 210. Power supply command voltage input waveform 310 includes inhibit output 312, charging output 314, delay 315 and break over output 316. Charging output 314 and break over output 316 are a scaled voltage signal provided to power converter 210 indicating the relative voltage that power converter 210 is commanded to produce. Delay 315 is a programmed delay between the initiation of charging output 314 and break over output 316. Delay 315 may be generated internally by control board 264 via a timing mechanism similar to pulse rate clock waveform 300. Charging output 314 may be set below the break over voltage of all spark gaps 254 in Marx generator 242 while break over output 316 may be configured to be above the break over voltage of all spark gaps 254. In one embodiment, power converter 210 outputs between 0 V and 40 kV with charging output 314 being approximately 30 kV, break over output 316 being approximately 40 kV with spark gaps 254 having a break over voltage of approximately 32 kV.

Power supply output voltage waveform 320 shows the voltage output of power converter 210 when controlled by power supply command voltage input waveform 310. Power supply output voltage waveform 320 includes inhibited output 322, charging output 324, charged output 326 and overcharge output 328. Power converter 210 is a current limited voltage controlled power converter, so when power converter 210 receives the signal to provide charging output 314, the ability of power converter 210 to actually provide the requested voltage is limited by the power output of power converter 210 compared to the applied load. In system 200, the load is capacitor groups 247, inductors 250 and resistor groups 249. Thus, charging output 324 represents the voltage output of power converter 210 while capacitor groups 247 are being charged up to charging output 314. Charged output 326 represents a period when capacitor groups 247 are fully charged to charging output 314. Overcharge output 328 represents the voltage output of power converter 210 while capacitor groups 247 are charging to break over output 316. At some point between charging output 314 and break over output 316, the voltage across capacitor groups 247 will exceed the break over voltage of spark gaps 254, initiating a comparatively rapid discharge of capacitor groups 247 as described above. (In this regard, capacitor groups 247 do not discharge instantaneously. However, the time it takes for capacitor groups 247 to discharge can be measured in microseconds, which is much quicker than the illustrated waveforms with millisecond timing can distinguish.)

Power converter 210 includes a feedback signal to control board 264 that indicates when the voltage output of power converter 210 drops. Upon discharge, control board 264 signals inhibit output 312 until detecting the next signal 306. The time when power converter 210 is inhibited allows Marx generator 242 to substantially completely discharge through emitter 216. The inhibit time may also be used to increase the amount of time available to resistor groups 249 and load resistor 256 to cool down between discharges.

In system 200, high voltage modules 208 or 209, power converter 210 and power source 212 operate together, as described above, to define a source of pulsed electrical potential. Power converter 210 and high voltage modules 208 and 209 operate together, as described above, to define a pulsed voltage converter.

Emitters 116 and 216 may be configured as cathode emitters directly coupled to the output of Marx generators 142 or 242. Emitters 118 and 218 may be configured as anode emitters coupled to either the input of Marx generators 142 or 242 or to a relative vehicular ground such as the chassis of vehicle 102 or 202. Emitters 116, 118, 216 and 218 may include an emitter surface on the surface facing the earth. In the illustrated embodiments, emitters 116, 118, 216 and 218 are dragged along the earth in direct contact with the earth. However, in other embodiments, emitters 116, 118, 216 and/or 218 can be suspended above the earth in close proximity to the earth. For example, emitters 116, 118, 216 and/or 218 could be constructed of a rigid material and small wheels or other device could be located on emitters 116, 118, 216 and/or 218 to define a gap between the earth and emitters 116, 118, 216 and/or 218. In another embodiment, a rigid or flexible material could be placed between emitters 116, 118, 216 and/or 218 and the earth. For example, emitters 116, 118, 216 and/or 218 could be woven in a flexible material. In another example, a thin sled could be placed between emitters 116, 118, 216 and/or 218 and the earth. The thin sled could optionally include spaces or voids to create air passages through the sled between the earth and emitters 116, 118, 216 and/or 218. Such a sled could optionally be constructed of a dielectric material. Additionally, while emitters 116, 118, 216 and/or 218 are shown oriented parallel to the direction of travel of systems 100 and 200, the emitters can alternatively be oriented in other directions including perpendicular to the direction of travel or a combination of different directions, including both parallel and perpendicular can be utilized.

Power converters 110 and 210 may be switched-mode power supplies or non-switched power supplies.

Systems 100 and 200 are constructed and arranged to move emitters 116, 118, 216 and 218 across the ground. One possible use of this apparatus is to scan an area for explosive devices, for example, Improvised Explosive Devices (IEDs), CBRNE devices or land mines. In particular, devices such as those currently being encountered in Afghanistan and Iraq. Systems 100 and 200 produce an electrical potential sufficiently high to transfer that electrical potential through substances normally considered non-conductive such as air, soil and coatings on wires. High voltage electrical potentials will seek a path to a lower potential ground, or at least a lower potential ground relative to the electrical potential.

The high voltage electric field presented on emitters 116 and 216 can cause air molecules to ionize, which results in much more conductive air due to the mobility of free electrons and therefore the promotion of electric current away from or toward emitters 116 and 216 (depending on the polarity of the applied voltage). Conductive objects located in or near the electric field and/or the created plasma can act as a conduit to a lower potential (a relative ground) for the electrical potential to dissipate through.

The dynamics involved with an electric potential dissipating into the ground are complex and subject to a large number of variables. The results can be analogous to lightning propagation through the atmosphere where the path of the lightning is rather chaotic and unpredictable paths are taken in what is presumably the course of least resistance (or most conductance) to ground.

In general, homogenous metal objects common to many explosive devices are more conductive than water and minerals with metallic content. Examples of such materials include wire, blasting cap casings and munitions casings. Such materials may represent a much more attractive charge collectors for a discharged potential than surrounding materials in the ground. Table 1 shows the resistivity and permittivity of several reference materials and terrain types.

TABLE 1

Material and Terrain Resistance

| Material/Terrain | Resistivity (Ohm-meters) | Permittivity |
|---|---|---|
| Annealed copper | 1.72 × 10^−8 | |
| Aluminum | 2.82 × 10^−8 | |
| Structural Steel | 3.00 × 10^−8 | |
| Sea water | 0.22 | 81 |
| Unpolluted freshwater | 1000 | 80 |
| Richest loam soil | 30 | 20 |
| Fertile soil | 80 | 15 |
| Marshy, densely wooded | 130 | 13 |
| Heavy clay soils | 250 | 12 |
| Rocky, sandy, some rainfall | 500 | 8 |
| Low-rise city suburbs | 1000 | 6 |
| High-rise city centers/industrial areas | 3000 | 4 |
| Arid sand deserts | >20,000 | 3 |

Another significant variable effecting arc penetration of the ground is moisture content. Table 2 shows the resistivity of silica based sand and clay mixed with sand with varying moisture content.

TABLE 2

Moisture and Silica Resistance

| Moisture % by weight | Resistivity-Silica based sand (Ohm-meters) | Resistivity-Clay mixed with sand (Ohm-meters) |
|---|---|---|
| 0 | 10,000,000 | — |
| 2.5 | 1,500 | 3,000,000 |
| 5 | 430 | 50,000 |
| 10 | 185 | 2,100 |
| 15 | 105 | 630 |
| 20 | 63 | 290 |
| 30 | 42 | — |

Another significant variable is soil density. Soil density in combination with moisture saturation determines possible arc channels through and around aggregate. Higher density results in fewer channels of air or water which generally results in higher arc impedance.

The relative resistance of the anticipated operating environment for systems 100 and 200 can affect the resistance of load resistors 172 and 256. Load resistors 172 and 256 may be optionally included to reduce the dissipation load on Marx generators 142 and 242 when emitters 116 or 216 have a relatively high impedance to the earth. As discussed above, conductors in the earth may create a comparatively low impedance discharge path. In addition, conductors in the earth may create a partial bridge between emitters 116 and 118 or emitters 216 and 218. However, if no relatively low impedance paths are available, discharge pulses may end up feeding back into Marx generators 142 and 242 and dissipating through resistors 148 and 248. In such an event, load resistors 172 and 256 may define an alternative or additional source for discharged pulses to dissipate through. In one embodiment, the relative resistance of load resistors 172 and 256 are balanced with the relative resistance provided by Marx generators 142 or 242. Load resistors 172 and 256 may optionally be configured to have a load resistance greater than an earth resistance between emitters 116 or 216 and the earth when there is a conductive material in the earth located proximate to emitters 116 or 216 and within about 8 cm of the surface of the earth.

Applicants have determined that discharging at least 30 kV of electrical potential into the ground with at least 30 Joules of energy provides the desired scanning capacity. Lower potential and energy levels are certainly capable of disabling electronics and/or pre-detonating or dudding explosives, with successful detonation with energy as low as 3 Joules or voltage as low as 15 kV. Applicants have simply determined that at least 30 kV of potential and at least 30 Joules of energy provide more reliable results in various situations. However, improved results may be obtained with higher potential and/or energy levels. For example, 100 kV provides more reliable results than 30 kV and 200 kV provides more reliable results than 100 kV. In some situations up to 400 kV or more may be desirable. Similarly, more power in each discharge may provide more reliable results. 50 Joules per discharge may provide more reliable results than 30 Joules. 75 Joules per discharge may provide more reliable results than 50 Joules. The required potential and energy levels may be highly dependent upon the characteristics of the terrain being scanned and the characteristics of the electronic and/or explosive target. For example, a system configured for the deserts of Iraq may have significantly different requirements than a system configured for jungles in the Philippines.

In addition to direct conduction, the high voltage electrical field generated around emitters 116 and 216 may induce current to flow in conductors located in that electrical field. The high voltage electrical field generated around emitters 116 and 216 varies with time, from a high potential when voltage is generated in high voltage modules 108 and 208 and released to emitters 116 or 216 as a pulse to a low potential after an individual pulsed discharge has dissipated. This generates a changing transverse magnetic flux around emitters 116 and 216 that can induce current to flow through a conductor located within range of the magnetic flux. (Transverse meaning that the direction of the magnetic field is perpendicular to the emitter). The current induced by the changing magnetic flux is proportional to the degree of perpendicularity of the conductor compared to the magnetic field with the highest induced current being generated in conductors perpendicular to the magnetic field and almost no current being generated in conductors parallel to the magnetic field. Because the magnetic field is perpendicular to the emitter, then a conductor parallel to the emitter will experience the highest magnetic flux induced current while a conductor perpendicular to the emitter will experience almost no magnetic flux induced current.

Emitters 116 and 216 can also be viewed as transmitting antenna with potential target conductor, such as command wires, pressure plates, and remote control devices acting as relay antenna that both receive and transmit the radiating energy.

Thus there are at least two different mechanisms through which systems 100 and 200 can pre-detonate or otherwise neutralize an explosive device. First, a high voltage can be emitted near enough to the explosive device or to a conductive path to the explosive device to overcome the impedance between the high voltage and the initiation circuit of the explosive device to transfer sufficient energy to the explosive device to either detonate the explosive device or to render it inoperative (for example by dudding a blasting cap or disabling the initiation circuitry). Second, electromagnetic coupling can occur between emitters 116 or 216 and conductors connected to or part of the explosive device to generate an induced current sufficient to either detonate the explosive device or to render it inoperative.

Enhanced scanning may be achieved by having emitters positioned relatively perpendicular to each other. For example, a first emitter can be positioned parallel to the direction of travel while a second emitter can be positioned perpendicular to both the direction of travel and the first emitter. This provides at minimum a 45 degree angle between an emitter and a conductor, potentially enhancing the potential to electromagnetically induce a current in the conductor.

Emitters 116, 118, 216 and 218 are dragged along the earth in close proximity to the earth. In general, closer proximity to the earth results in greater energy being available to pass into the earth, as less energy is expended ionizing the air between the emitters and the earth. Thus, direct contact with the earth usually utilizes the greatest percentage of available energy for interrogating the earth and any items in the earth in proximity to the emitters. However, direct contact with the earth can result in wear on emitter surfaces, so, in some cases, emitter surfaces can be located spaced apart from the earth. In one embodiment, within 3 cm. In another embodiment, within 8 cm.

In a multi-emitter system, such as system 200, it is also possible to configure high voltage modules 208 and 209 so that the high voltage modules each discharge independently and out of phase with each other (i.e., only one high voltage module discharges at a particular time), or high voltage modules 208 and 209 may be configured to all discharge simultaneously.

Vehicles 102 and 202 are both configured with a direction of straight travel. The illustrated emitters 116, 118, 216 and 218 are all oriented parallel to the direction of straight travel for the respective vehicles. However, both vehicles 102 and 202 are configured to be turn-able for steering.

Systems 100 and 200 described above have pulsed power generators producing pulsed electrical discharges. For purposes of this application, pulsed refers to discharging accumulated energy very quickly. For example, but not limited to, within 100 microseconds. Systems 100 and 200 include components that accumulate relatively low power and potential energy over a relatively long period of time and then release comparatively high power and potential energy in a comparatively very quick time increasing the instantaneous power discharged. Using pulsed power generation, systems 100 and 200 are able to be relatively small and lightweight compared to the amount of power emitted, i.e., a non-pulsed power generation system would have to be much larger and heavier to output comparable levels of power continuously. In addition, pulsed discharges may have advantages over continuous discharges. As discussed above, pulsed discharges produce changing electromagnetic fields that can induce current in nearby conductors. In addition, pulsed discharges can be more efficient at creating plasma in air.

Systems 100 and 200 described above include specific characteristics for various components and performance levels. It should be understood that these are merely examples and are not restrictive in scope. Different system performance can be obtained by varying components. Larger or smaller power sources 112 and 212 may be utilized. Larger or smaller power converters 210 and 212 may be utilized to achieve different voltage output and power throughput. Larger or smaller Marx generators 142 and 242 may be utilized. Various components disclosed in Marx generators 142 and 242 may be varied as desired, including the number of stages, the type and number of components, etc. Actual system parameters are determined based on criteria such as soil type and conditions, target device type or configuration, environmental conditions, desired movement speed and other factors.

Similarly, system 200 includes disclosure of operation at 10 Hz and 15 Hz. Other embodiments can operate at different frequencies as desired. Pulse rates can be varied to deliver higher or lower pulse frequency to compensate for factors such as speed of travel and emitter length. If desired, pulse frequency can be controlled manually or automatically at least in part based on vehicle speed or with other criteria such as soil moisture content.

Figure 26:
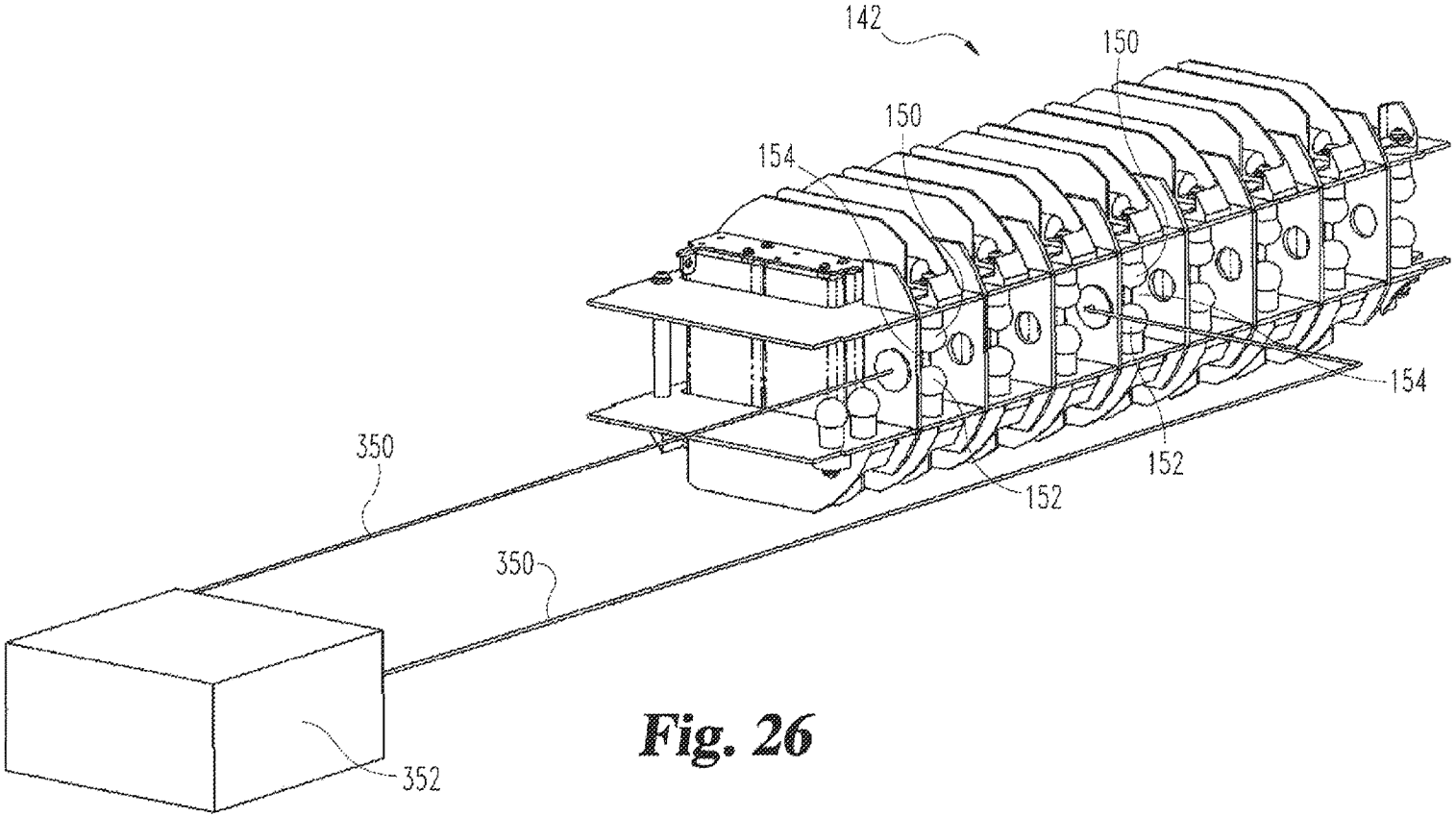
FIG. 26 is a front perspective view of a Marx generator incorporating a spark gap light sensor.

Referring now to FIG. 26, Marx generator 142 is illustrated incorporating a luminescence detection system. Specifically, FIG. 26 illustrates fiber optic cables 350 directed between electrodes 150 and 152 toward spark gaps 154. The other ends of fiber optic cables 350 enter signal processing units 352, that contain light detection and processing equipment, for example, a luminescence meter with signal processing hardware to determine the luminescence of each individual spark in multiple spark gaps 154.

Figure 27:
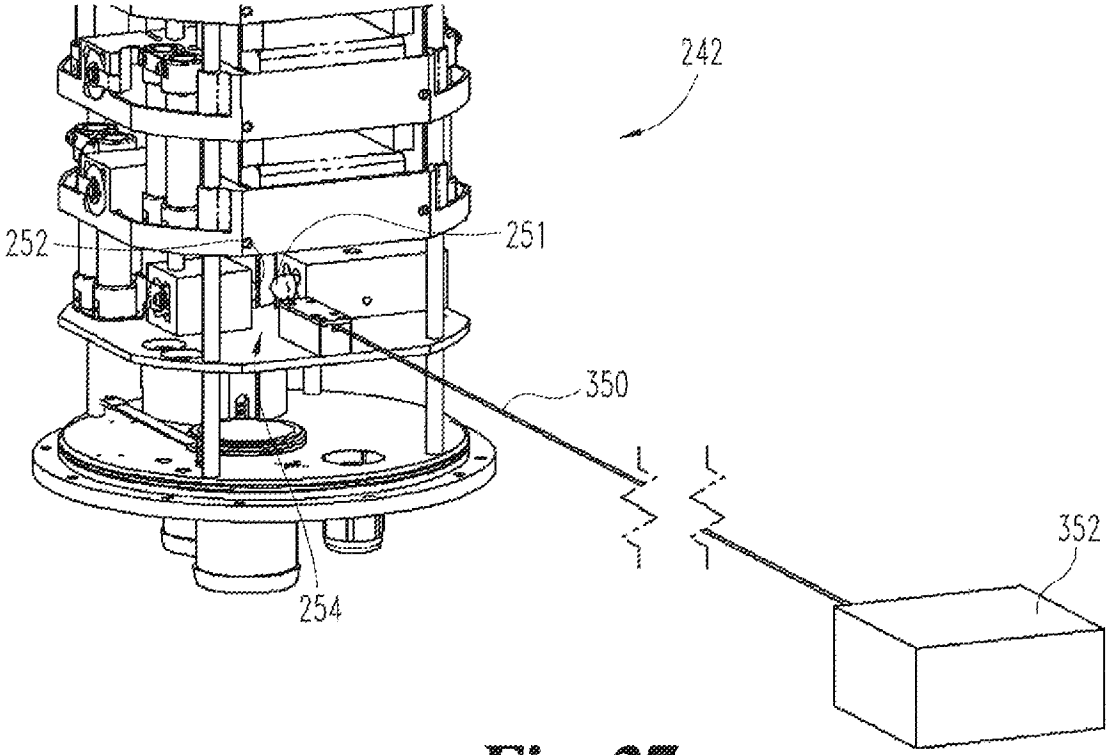
FIG. 27 is a rear perspective view of a Marx generator incorporating a spark gap light sensor.

Referring to FIG. 27, a similar system is illustrated and incorporated with Marx generator 242. Specifically, FIG. 27 illustrates fiber optic cable 350 is directed between electrodes 251 and 252 at spark gap 254. Light generated by sparks in spark gap 254 are transferred by fiber optic cable 350 to signal processing unit 352, that contains light detection and processing equipment, for example, a luminescence meter with signal processing hardware to determine the luminescence of an individual spark in spark gap 254.

Figure 28:
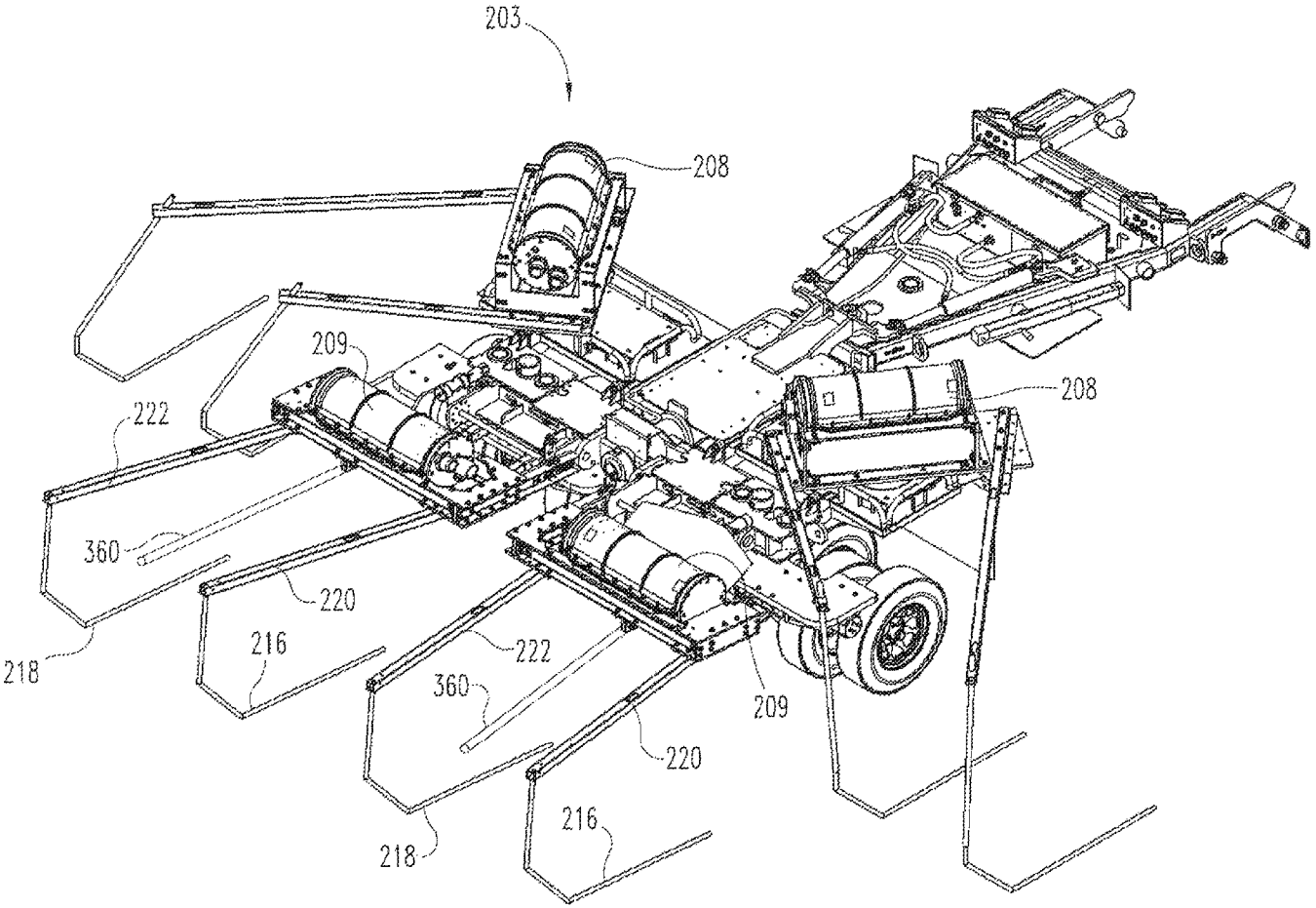
FIG. 28 is a perspective view of a mine roller mounted electrical discharge system incorporating antennas.

Referring now to FIG. 28, an embodiment of assembly 203 is illustrated with a pair of high voltage modules 208 and a pair of high voltage modules 209 coupled to emitters 216 and 218 through supports 220 and 222 as discussed above. The embodiment illustrated in FIG. 28 also includes antennas 360 extending between supports 220 and 222 and high voltage modules 209. In the illustrated embodiment, antennas 360 are omnidirectional whip antennas.

Antennas 360 may optionally be located on or near the ground on either side of emitters 216 and 218 or between emitters 216 and 218. Antennas 360 may optionally be coated with a high impedance material or may optionally be constructed of a high impedance material.

Referring to FIGS. 29-34, several embodiments of system 400 are illustrated. System 400 generally includes vehicle 402 and assembly 403. In the illustrated embodiment, vehicle 402 is a armored U.S. military flatbed truck and assembly 403 includes a modified U.S. military mine roller assembly 405. Mine roller 405 carries a plurality of modules 404 that each include a high voltage module configured as sources for pulsed electrical potential.

Vehicle 402 carries power supply 414 with is electrically coupled to modules 404. Modules 404 are each electrically coupled to emitters 416 and 418. Emitters 416 and 418 are extended away from mine roller 405 by rigid supports and flexible supports. Emitters 416 and 418 may be constructed of flexible materials. Emitter 416 and 418 may be configured to be dragged along the earth or they may be configured to be held in close proximity to the earth similar to emitters 216 and 218 as discussed above.

FIGS. 29-34 disclose various embodiments of system 400 incorporating unidirectional and omnidirectional antenna in various locations on system 400. It should be understood that the types and locations of antenna disclosed herein are only examples of potential types of antenna and locations to position different antenna. Antenna types and locations may be optimized based on performance characteristics of individual systems and the type and accuracy of radio frequency information desired.

Figure 29:
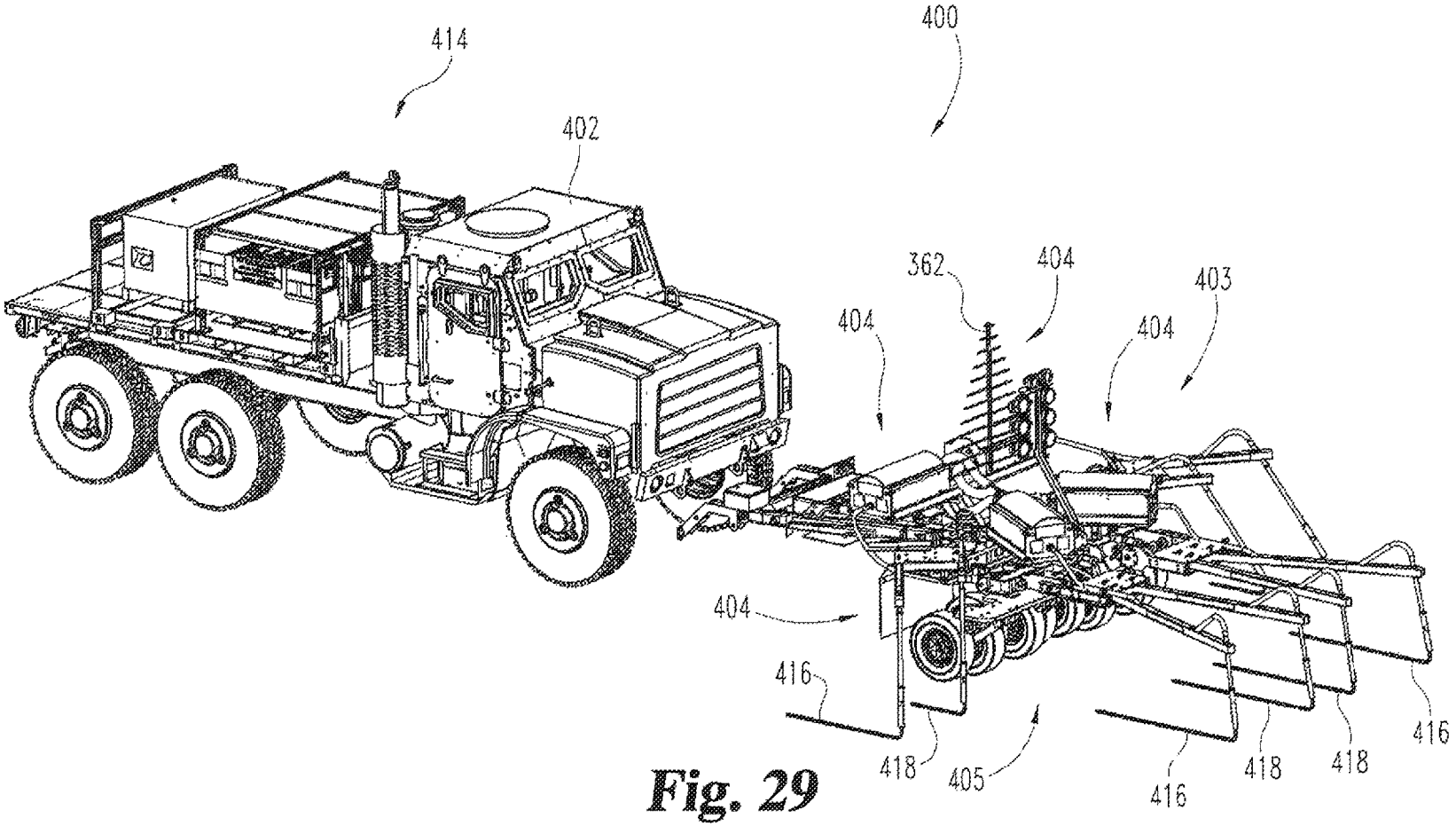
FIG. 29 is a perspective view of a mine roller mounted electrical discharge system incorporating a unidirectional antenna on the mine roller.
Figure 30:
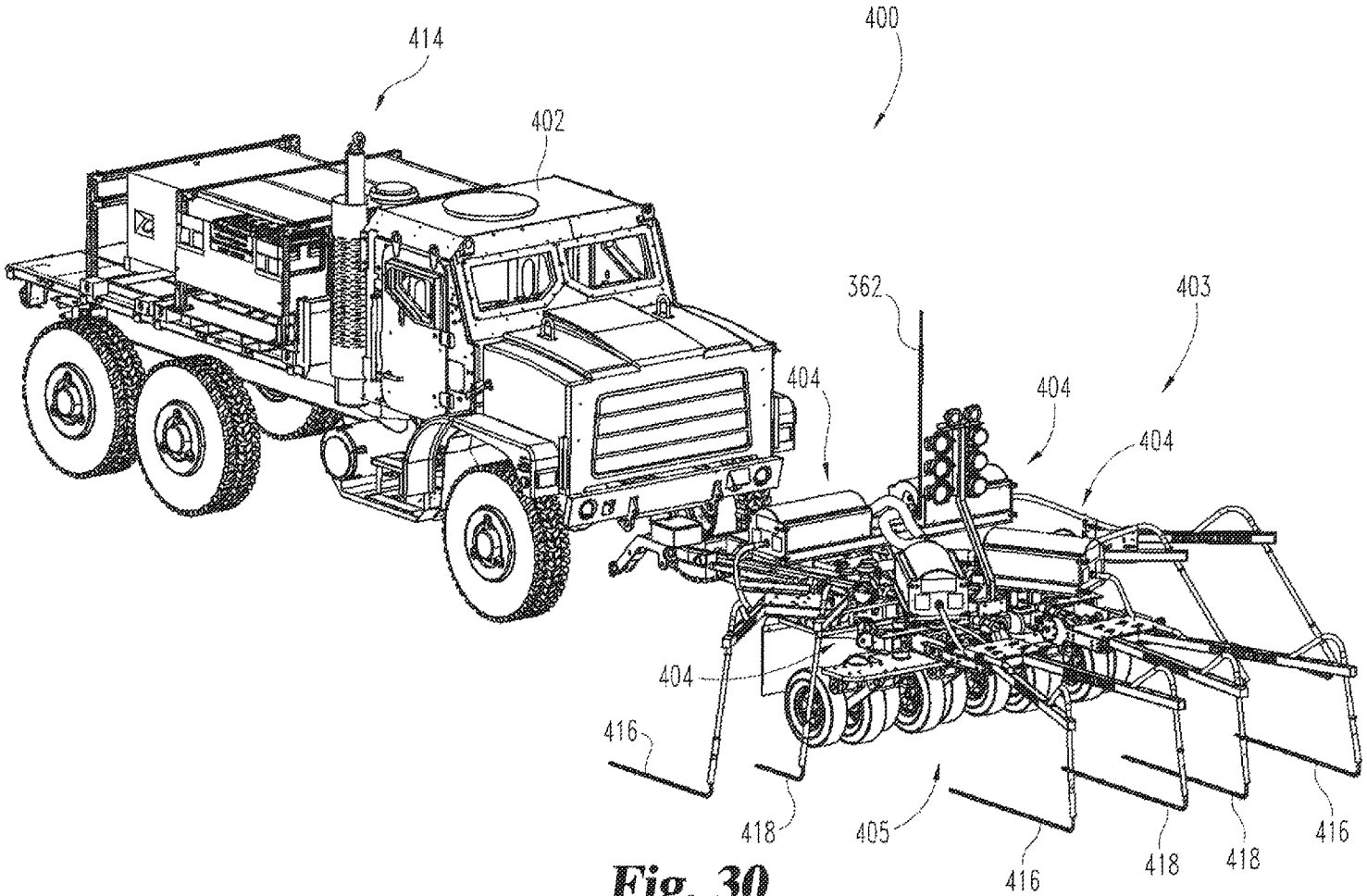
FIG. 30 is a perspective view of a mine roller mounted electrical discharge system incorporating an omnidirectional antenna on the mine roller.
Figure 31:
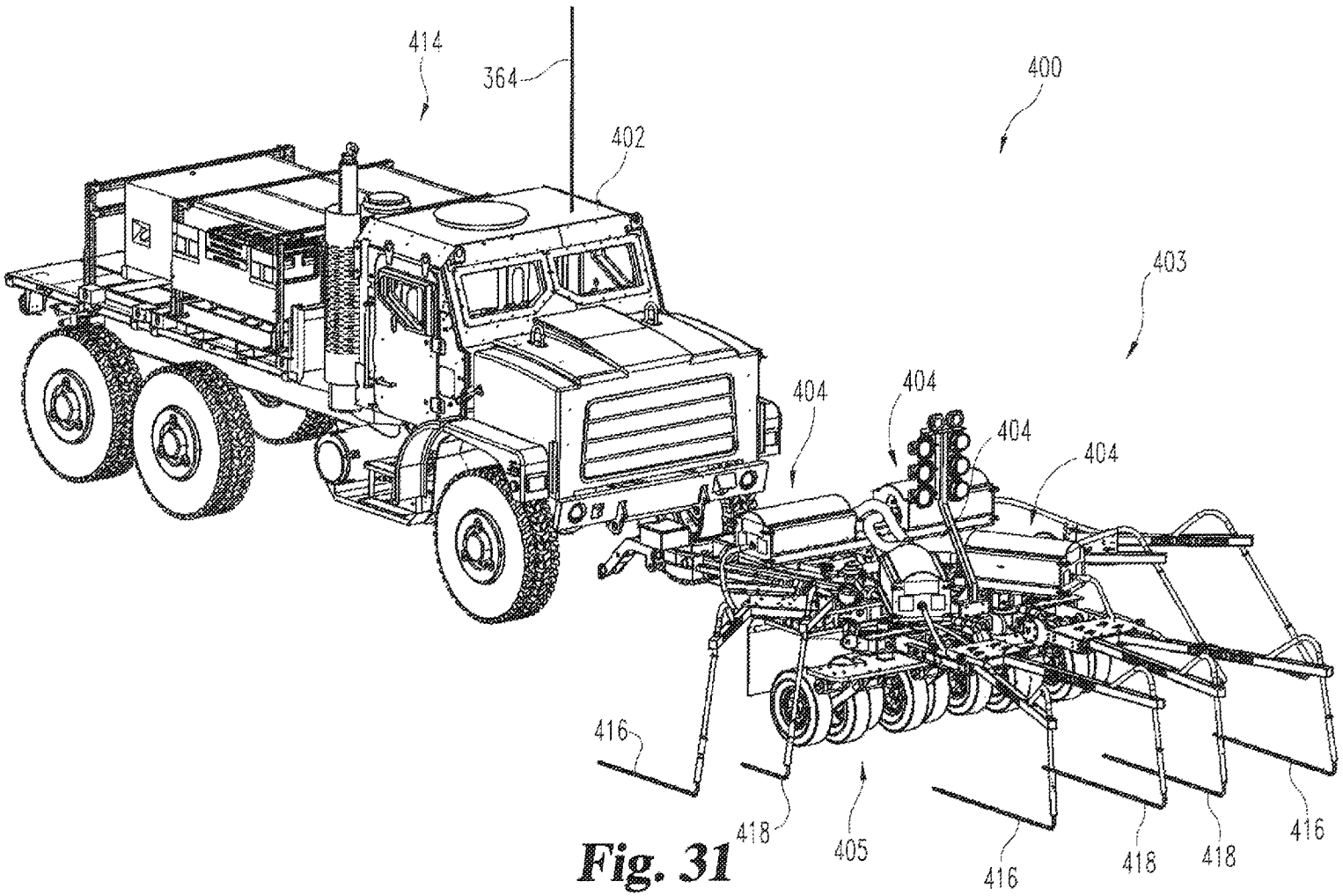
FIG. 31 is a perspective view of a mine roller mounted electrical discharge system incorporating an omnidirectional antenna on the truck.
Figure 32:
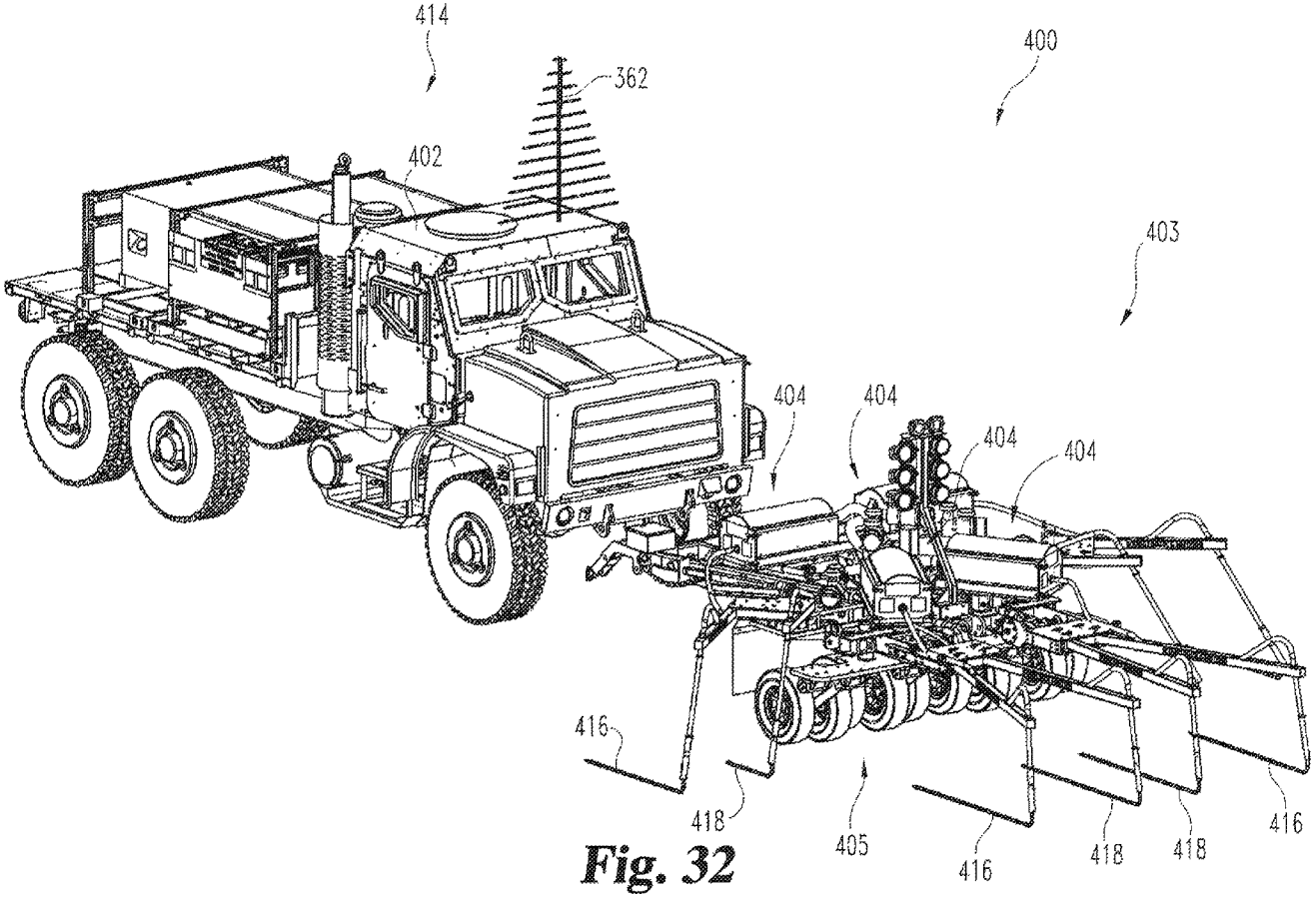
FIG. 32 is a perspective view of a mine roller mounted electrical discharge system incorporating a unidirectional antenna on the truck.
Figure 33:
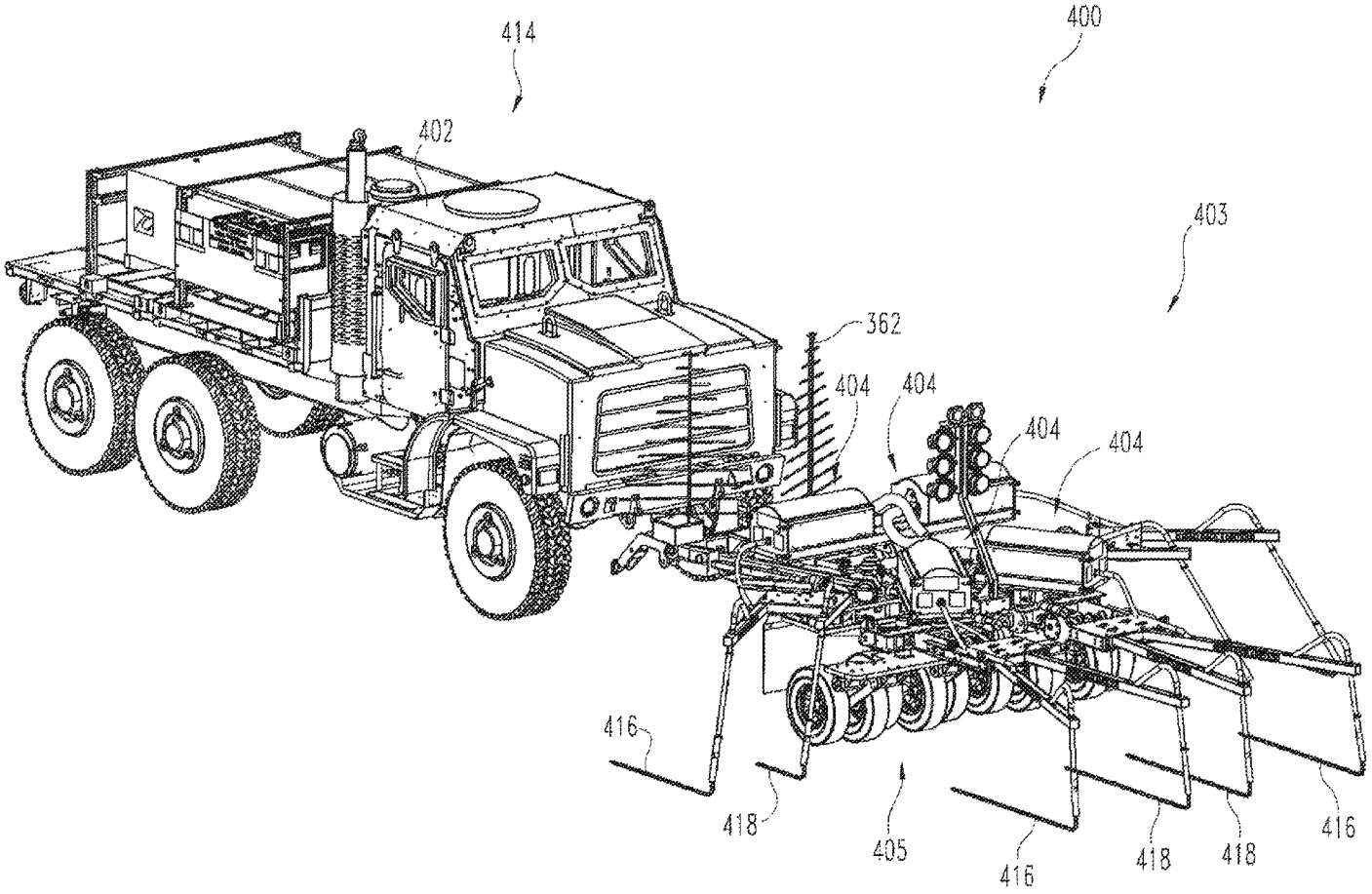
FIG. 33 is a perspective view of a mine roller mounting multiple unidirectional antennas on the mine roller.
Figure 34:
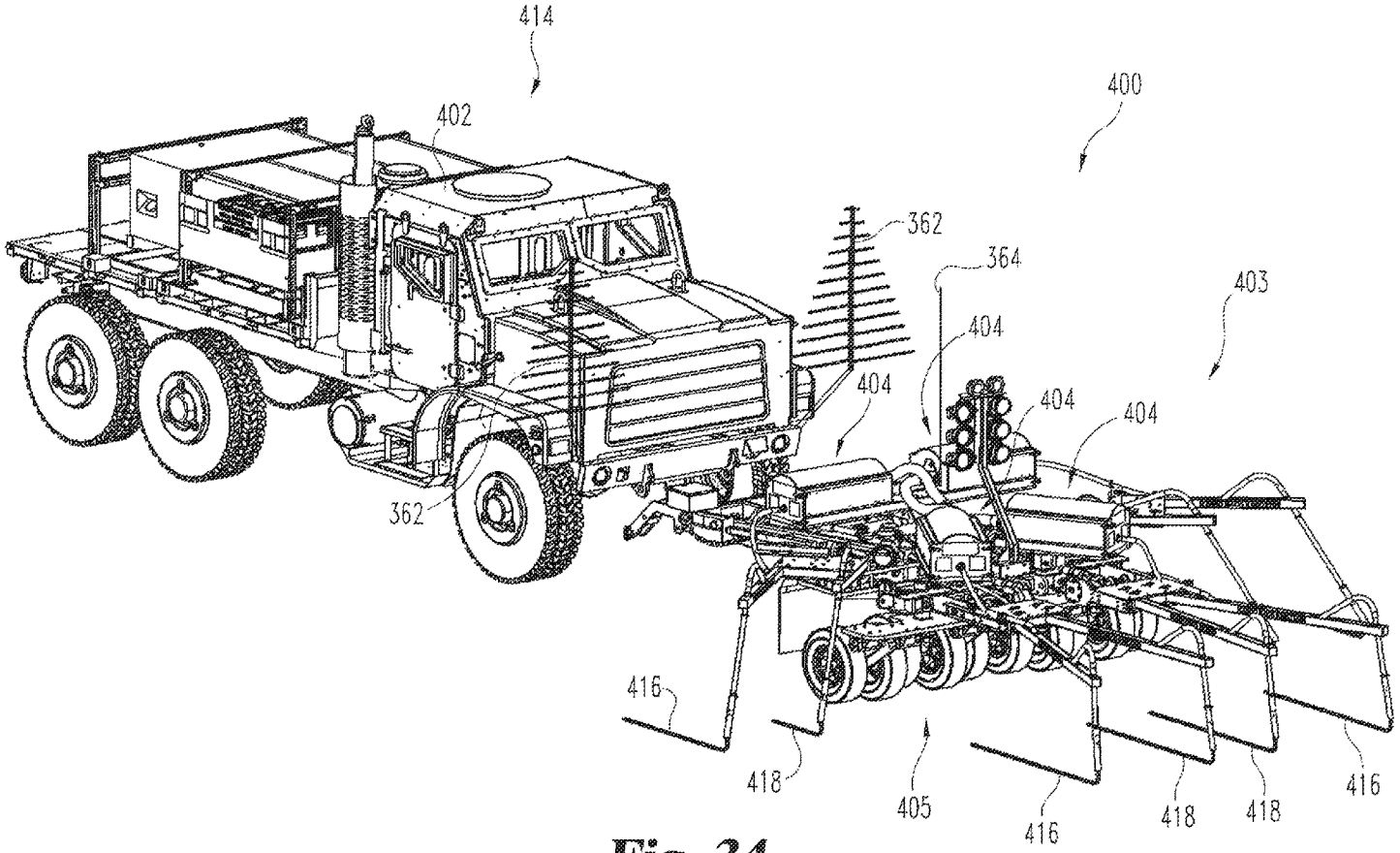
FIG. 34 is a perspective view of a system mounting multiple unidirectional antennas on the truck and an omnidirectional antenna on the mine roller.

Referring specifically to FIG. 29, FIG. 29 illustrates uni-directional antenna 362 mounted on mine roller 405. Referring to FIG. 30, the illustrated embodiment of system 400 includes omnidirectional antenna 364 mounted on mine roller 405. Referring to FIG. 31, the illustrated embodiment of system 400 includes omnidirectional antenna 364 mounted on vehicle 402. Referring to FIG. 32, the illustrated embodiment of system 400 includes uni-directional antenna 362 mounted on vehicle 402. Referring to FIG. 33, the illustrated embodiment of system 400 includes a pair of uni-directional antennas 362 mounted on the rear end of mine roller 405. Referring to FIG. 34, the illustrated embodiment of system 400 includes a omnidirectional antenna 364 mounted on mine roller 405 and a pair of uni-directional antennas 362 mounted on front end of vehicle 402.

Antenna arrangement illustrated in FIGS. 28-34 are examples of antenna arrangements that may be used to detect emissions from emitters 416 as well as electric magnetic fields generated by current flows in conductors induced by electrical discharges from emitters 416. As discussed above, the high voltage electrical field generated around emitters 416 varies with time from a high potential when voltage is initially discharged from modules 404 to a low potential after an individual false discharge is dissipated. This generates a changing transverse magnetic flux around emitter 416 that can induce the current to flow through a conductor located within range of the magnetic flux. Antenna 360, 362 and 364 may be used to detect that induced current as a method of locating conductors within range of system 400.

Figure 35:
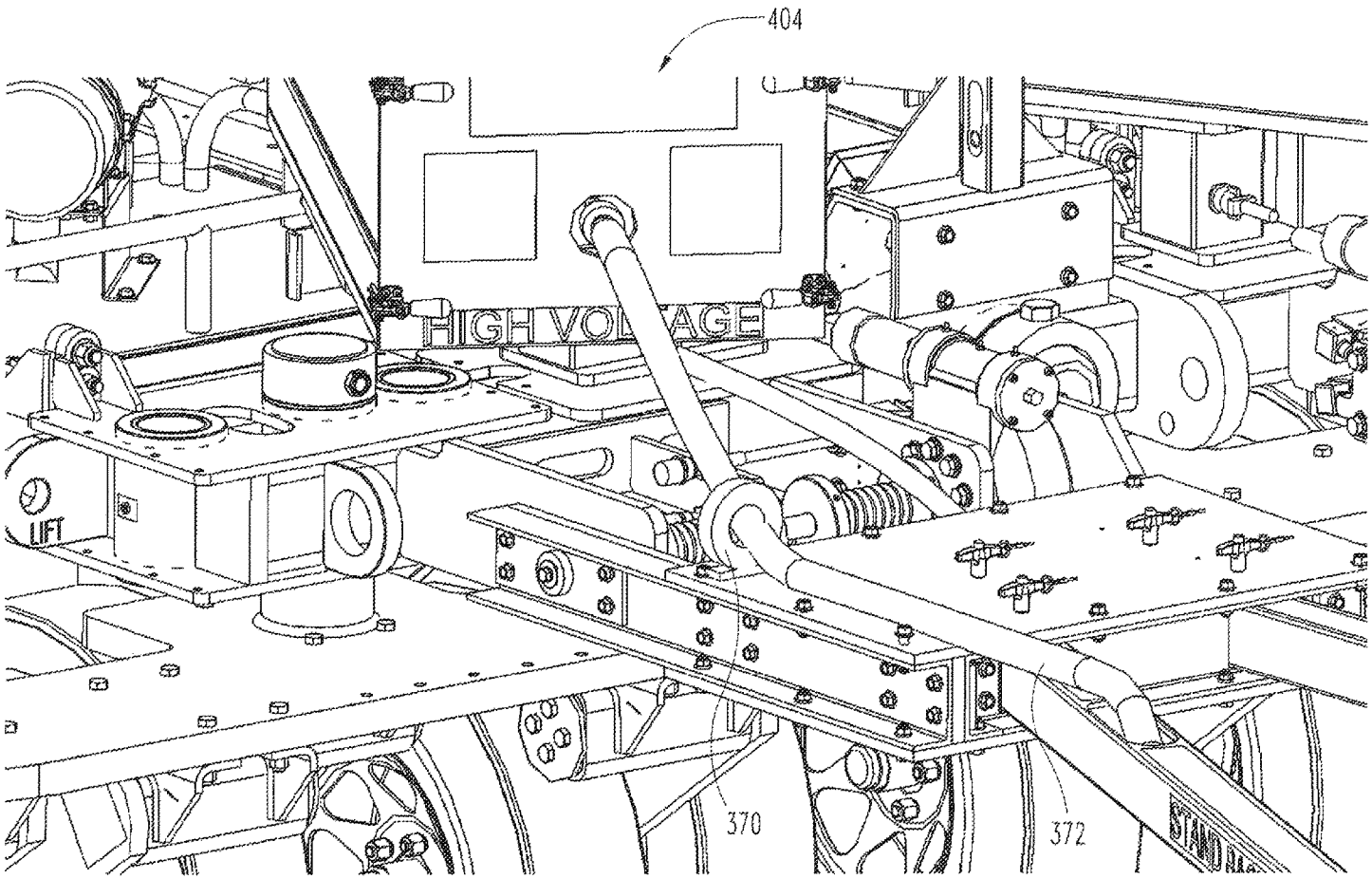
FIG. 35 is a close up view of a mine roller incorporating a current sensor on the cable coupling the emitter to high voltage module.

Referring to FIG. 35, sensor 370 is illustrated. Sensor 370 is a current transformer or current sensor. Sensor 370 is positioned with cable 372 passing through sensor 370. Cable 372 is an electrical cable coupling between module 404 and emitter 416. The illustrated embodiment of sensor 370 is a current transformer such as that produced by Pearson Electronics (www.pearsonelectronics.com); however, any other form of current sensor known in the art may be used including, but not limited to, a Rogowski coil.

Figure 36:
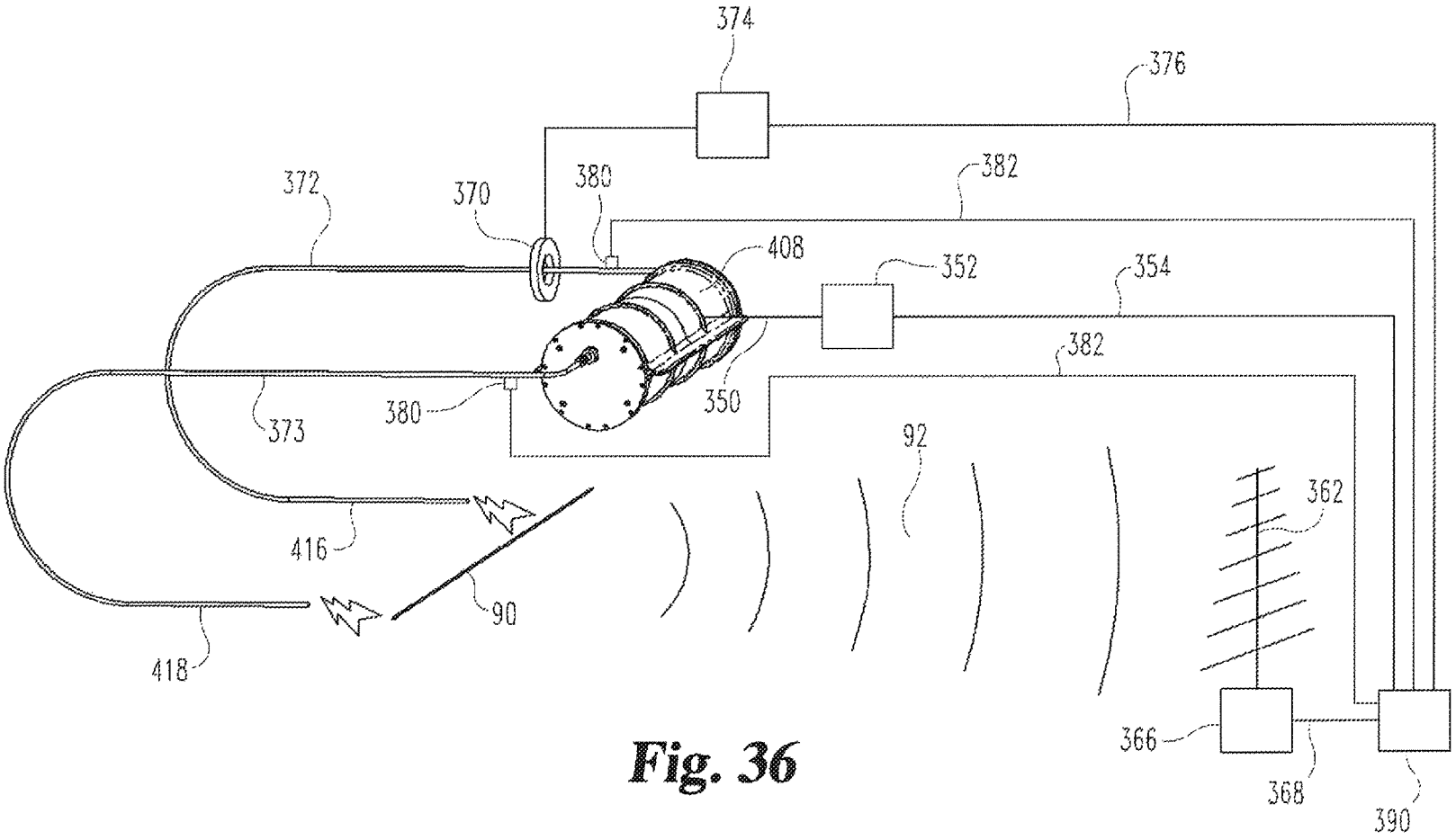
FIG. 36 is a schematic diagram including various detection systems incorporated on or near a high voltage module and its emitters.

Referring to FIG. 36, schematic of various detection methods is illustrated. The FIG. 36 schematic includes a representative high voltage module 408 coupled to emitters 416 and 418. Also shown in FIG. 36 is a representative target conductor 90 capable of receiving an electrical discharge from emitter 416. Target conductor 90 may receive the electrical discharge from emitter 416 directly, indirectly through direction conduction through an intermediary such as air or the earth, or indirectly through current flow induced by the magnetic field generated by emitter 416. The current received by target conductor 90 generates electromagnetic energy 92 which is received by antenna 362 and is processed by radio frequency receiver 366 producing a signal sent to signal processor 390.

In addition to the representative high voltage module 408 with emitters 416 and 418. FIG. 36 also illustrates several sensors and signal processing components including signal processing unit 352, antenna 362, RF receiver 366, current sensor 370, signal processing unit 374, and voltage meters 380. It should be understood that every sensor illustrated is not necessary for detection operation. Various components and/or sub combinations of the illustrated sensors may be used to obtain any desired level of detection capacity. For example, multiple sensors may be integrated together or single sensors may be used alone.

As discussed above, signal processing unit 352 is coupled to fiber optic cable 350 which is directed toward a spark gap in high voltage module 408. Signal processing unit 352 generated luminescence signal 354 sent to signal processor 390. Antenna 362 receives electromagnetic energy 92 emitted from target conductor 90. RF receiver 366 generates RF signal 368 sent to signal processor 390. Sensor 370 is coupled to signal processing unit 374 which generates current signal 376 sent to signal processor 390. Voltage meters 380 are positioned on cables 372 and 373 between high voltage module 408 and emitters 416 and 418. Voltage meters 380 generate voltage signals 382 that are sent to signal processor 390. In alternative embodiments, voltage meters 380 may be positioned on the surface of the case of high voltage module 408.

Signal processor 390 may be configured to process one or more the aforementioned signals including relative luminescence, voltage, current, and detected radio frequency emissions to determine the location and nature of conductors in proximity with emitters 416 and 418. Voltage signals 382 from various emitters may be separately monitored in signal processor 390. For example, an emission from a particular emitter 416 may result in a corresponding voltage change across multiple emitters 418. Signal processor 390 may be configured to monitor multiple emitters 418 in conjunction with an emission through an emitter 416 to determine relative directions of current flow.

In this regard, in a system utilizing multiple emitters 416 and 418 coupled to multiple high voltage modules 408, various high voltage modules 408 may optionally be controlled to operate discretely to facilitate analysis of various signals generated by a single discharge event. Including multiple high voltage modules 408 on system 400 and operating them discretely, providing additional information related to the relative location of a high voltage at a point in time, may facilitate more precise signal processing to help determine the location, size, depth and conductivity of target conductor 90. In addition, the return signals of particular conductors, such as particular landmines or a command wire, may be tabulated or otherwise categorized to add in future identification of similar structures.

Signals such as luminescence signal 354, voltage signal 382 and/or current signal 376 may be utilized as time signals in signal processor 390 to establish when a particular emission occurs. This may be used in conjunction with the signals received from radio frequency receiver 366 to facilitate calculating distance and position of target conductor 90.

Figure 37:
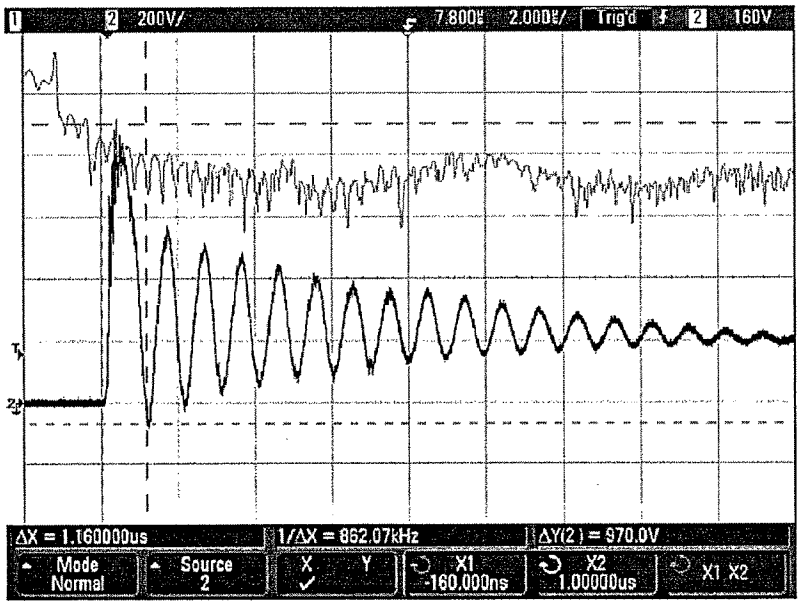
FIG. 37 is an oscilloscope waveform illustrating a low impedance discharge.

Referring to FIG. 37, an example of an oscilloscope waveform recorded with a radio frequency antenna focused directly towards the output of emitter 416. The waveform shown in FIG. 37 represents the waveform with very low impedance due to emitters 416 and 418 being located close together. This waveform may be representative of the condition when a conductor is positioned at least partly between emitters 416 and 418.

Figure 38:
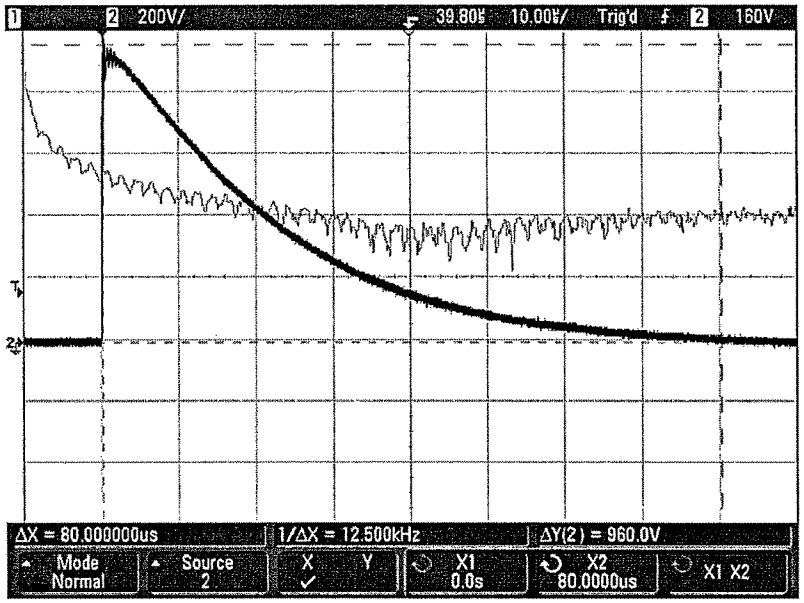
FIG. 38 is an oscilloscope waveform illustrating a comparatively high impedance discharge.

Referring to FIG. 38, illustrated is an oscilloscope waveform recorded with a radio frequency antenna focused directly towards the spark output where emitters 416 and 418 are spaced far apart without any conductor in-between. This waveform may be representative of a high impedance discharge condition.

There are several detection schemes that may provide useful information. One or more unidirectional antenna(s) aimed off-axis away from emitters 416 and 418 to detect electromagnetic energy 92 from target conductor 90. Unidirectional antenna(s) aimed directly at emitters 416 and 418 to detect the electrical signature of individual discharges. These systems can be combined together and/or with other signals such as voltage, current and luminescence to determine the magnitude and phase relationship between the source discharge and the returned energy from target conductor 90.

Figure 39:
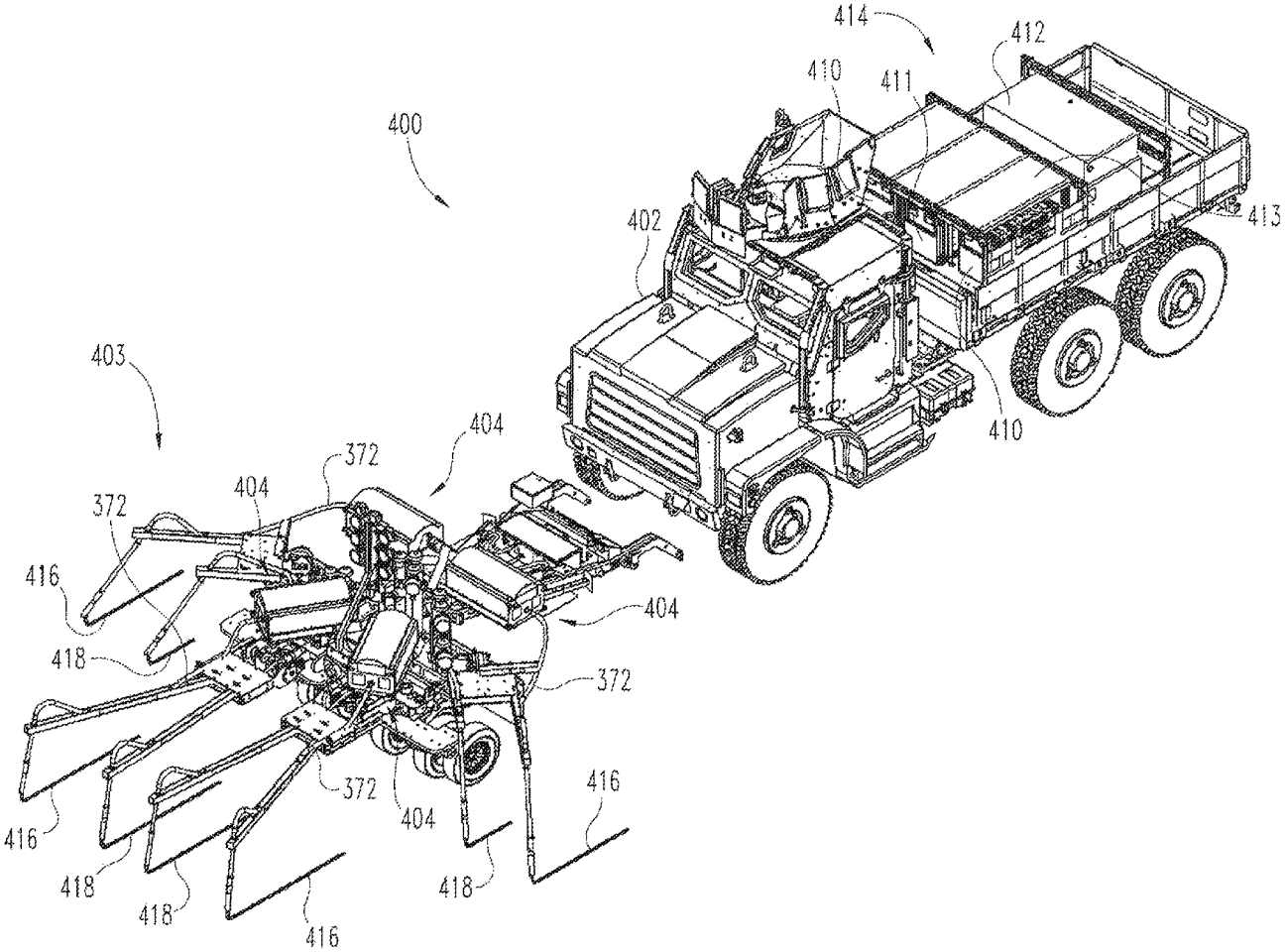
FIG. 39 is a perspective view of a mine roller mounted electrical discharge system according to an alternative embodiment of the FIG. 12 system.

Referring to FIG. 39, system 400 is illustrated. System 400 is similar to system 200 described above and in FIG. 12. System 400 includes vehicle 402 and assembly 403. In the illustrated configuration vehicle 402 is an armored U.S. military flatbed truck and assembly 403 is mounted on a modified U.S. military mine roller assembly.

Assembly 403 is generally defined by mine roller 405 which is a standard US military mine roller. It should be understood that other vehicular platforms may be used in conjunction with the disclosed electrical discharge systems. Mine roller 405 carries a plurality of modules 404 that each include a high voltage module 408. Vehicle 402 carries one or more power converters 410, system control unit 411 and power source 412 posited under sun shield 413. Power converters 410, system control unit 411 and power source 412 define power supply 414. Power converters 410, system control unit 411 and power source 412 are carried in the bed of vehicle 402. Note that power converters 410, system control unit 411 and power source 412 may be located in any desired position on the vehicle, including on mine roller 405 or elsewhere on vehicle 402. In the illustrated embodiment, power source 412 is a NATO standard 10 kW palletized generator/engine assembly. However, any other power source can be used including solar cells, batteries, an onboard vehicle alternator or generator, etc.

Modules 404 include emitters 416 and 418 extended away from mine roller 405 by rigid supports 420 and 422 and flexible supports 421 and 423. High voltage modules 408 are electrically connected to emitters 416 by cables 372. Emitters 416 and 418 as illustrated are relatively rigid steel cables. However, emitters 416 and 418 may be constructed from any desired material. Supports 420 and 422 are comparatively rigid structures constructed of a comparatively non-conductive material that carries emitters 416 and 418 and flexible supports 421 and 423. Flexible supports 421 and 423 are located between emitters 416 and 418 and rigid supports 420 and 422. Flexible supports 421 and 423 include some degree of flexibility and bias.

Emitters 416 and 418 are configured with emitter surfaces that are in close contact with the earth. In one embodiment, the emitter surfaces of emitter 416 and 418 are approximately 0.5 meters in length. In other embodiments, the emitter surfaces of emitter 416 and 418 are at least 0.3 meters in length. In yet other embodiments, the emitter surfaces of emitter 416 and 418 are at least 0.2 meters in length. In another embodiment, the emitter surfaces may be between approximately 0.5 to 1.5 meters in length. In one embodiment, emitters 416 and 418 may be spaced apart between approximately 0.5 meters to approximately 2.25 meters. In another embodiment, emitters 416 and 418 may be spaced apart between approximately 0.6 meters to approximately 1.2 meters.

Figure 40:
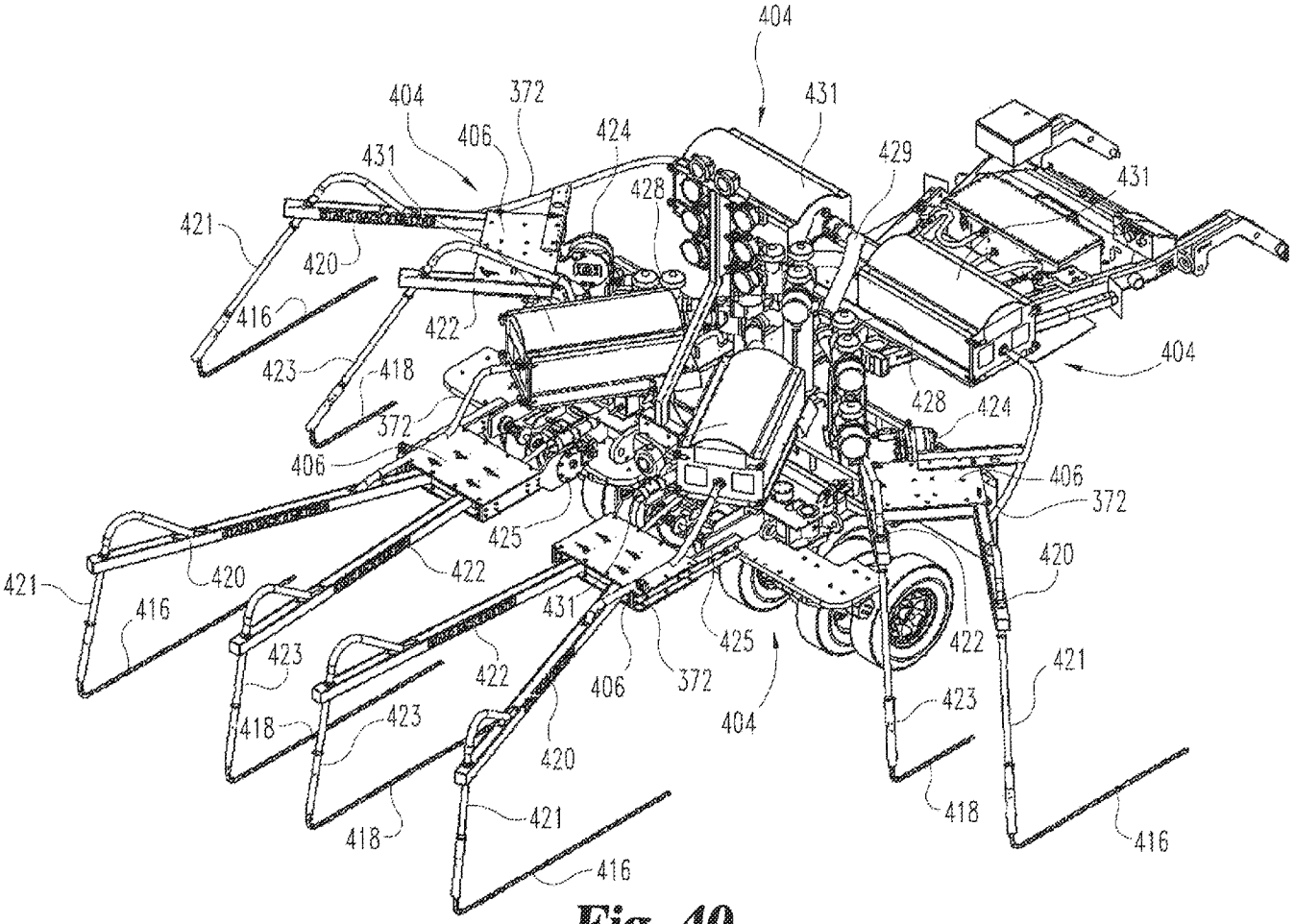
FIG. 40 is a perspective view of the FIG. 39 mine roller.

Assembly 403 is shown in isolated detail in FIG. 40. High voltage modules 408 are mounted mine roller 405. Rigid supports 420 and 422 are mounted on frames 406. Frames 406 is coupled to mine roller 405 via swivel connections 424 and 425. Swivel connections 424 and 425 are configured and arranged to permit pairs of emitters 416 and 418 to be individual stowed for transport.

Frames 406 and 407 and swivel connection 424 and 425 are each constructed of comparatively non-conductive material to isolate high voltage modules 408 from mine roller 205. In general, high voltage components such as high voltage modules 408 and cables 372 are spaced apart from mine roller 405. Dielectric materials may be optionally located between high voltage components and mine roller 405.

Blowers 228 are optionally mounted on mine roller 405 and are coupled to high voltage modules 408 by flexible air lines 429 to assist with removing heat and ionized air from high voltage modules 408. High voltage modules 408 are located within casings 431 as described below.

Figure 41:
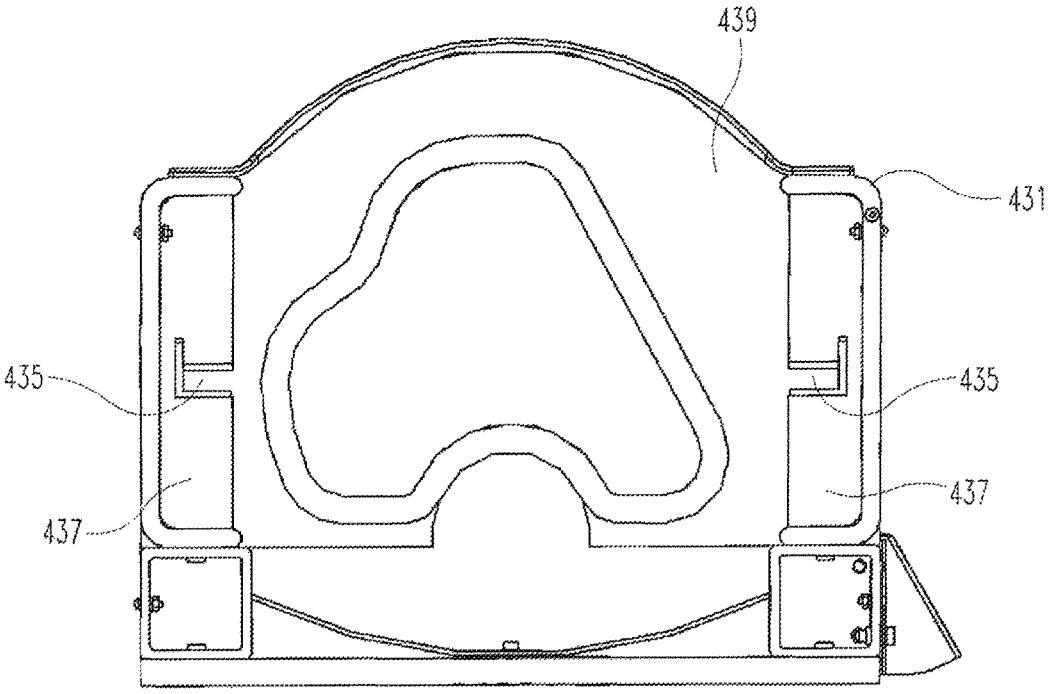
FIG. 41 is an end view of a high voltage module casing used on the FIG. 12 mine roller.

Referring to FIG. 41, casing 431 is illustrated. Casing 431 includes slots 435 extending along both sides of casing 431, with slots 435 located in resilient material 437. Casing 431 defines recess 429.

Figure 42:
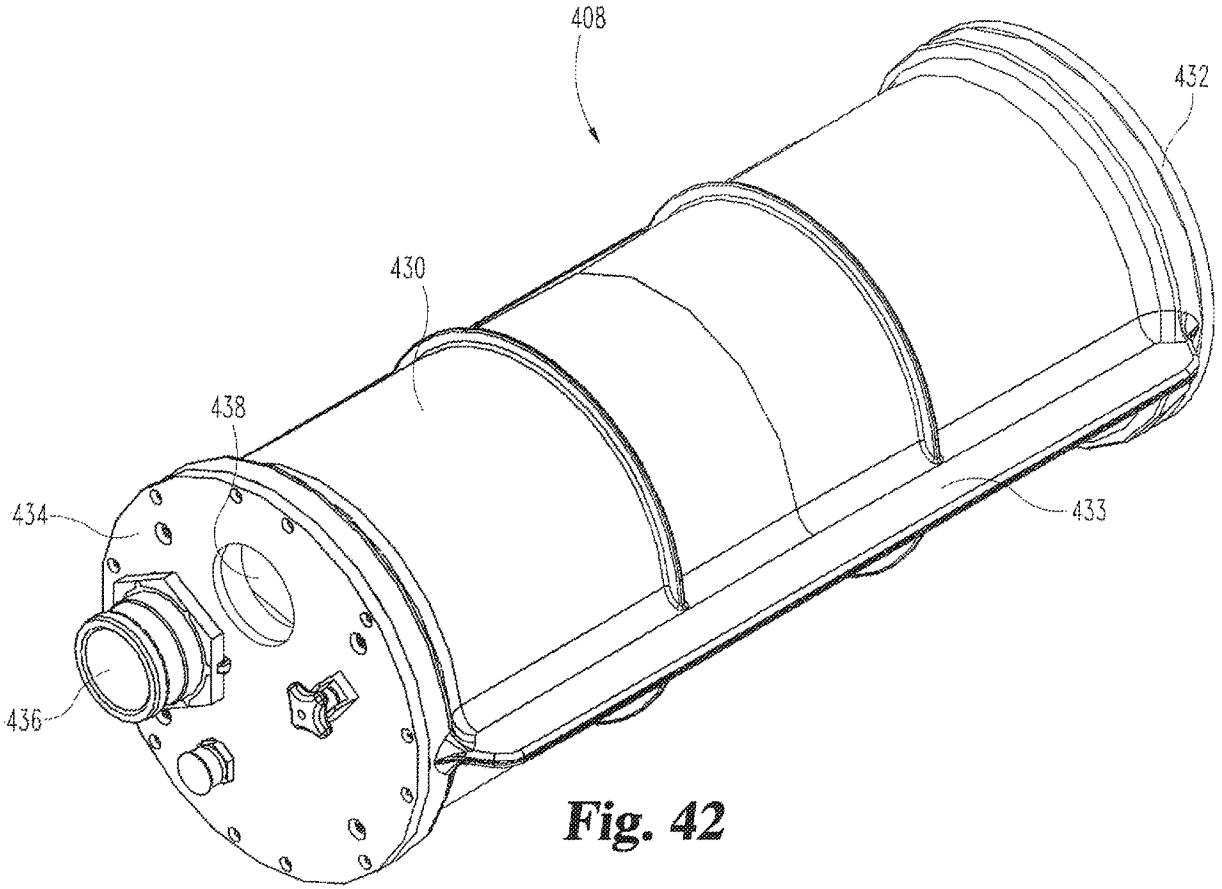
FIG. 42 is a perspective view of a high voltage module mounted in the FIG. 41 casing.

Referring to FIG. 42, casing 430 is illustrated. Similar to casing 230 described above, casing 430 is configured and arranged to hold a Marx generator assembly (not illustrated). Marx generator 242 discussed above could be used as part of High Voltage module 408. Casing 430 includes flanges 433 on either side with caps 232 and 234 covering the ends of casing 430 and permitting access to the Marx generator contained within. Cap 434 includes air inlet 436 and air outlet 438. Flexible air lines 429 may be coupled between blowers 428 and air inlets 436 on each high voltage modules 408.

Casing 430 is positioned within casing 431 by inserting flanges 433 into slots 435 with casing 430 located in recess 439 (not illustrated). Casing 431 is configured and arranged such that, when assembled with casing 430, casing 430 only contacts casing 431 at flanges 433. Casing 430 is effectively suspended in recess 429 by flanges 433. Resilient material 437 provides a damping effect, isolating casing 430 from vibrations and impulse forces experience by casing 431.

Figure 43:
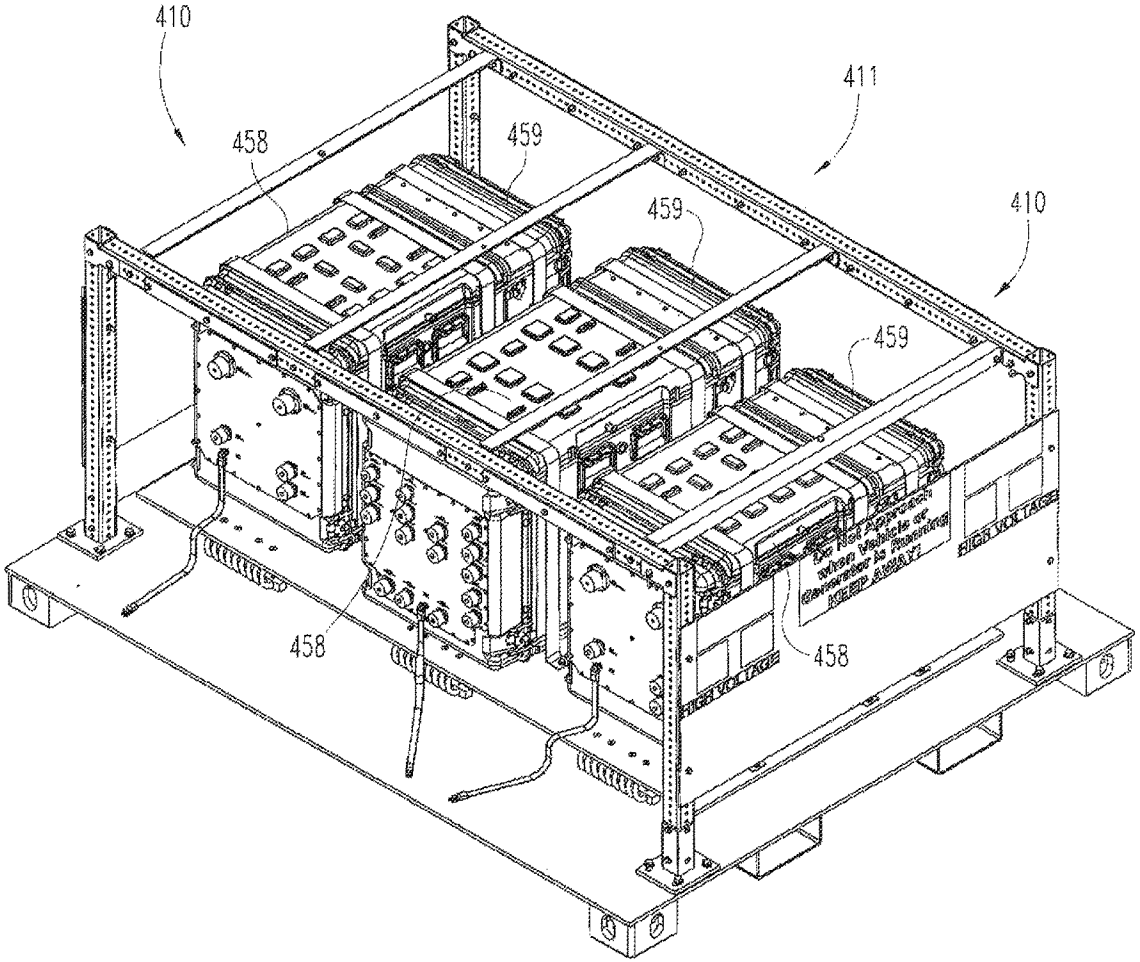
FIG. 43 is a front perspective view of power converters from the FIG. 39 system.
Figure 44:
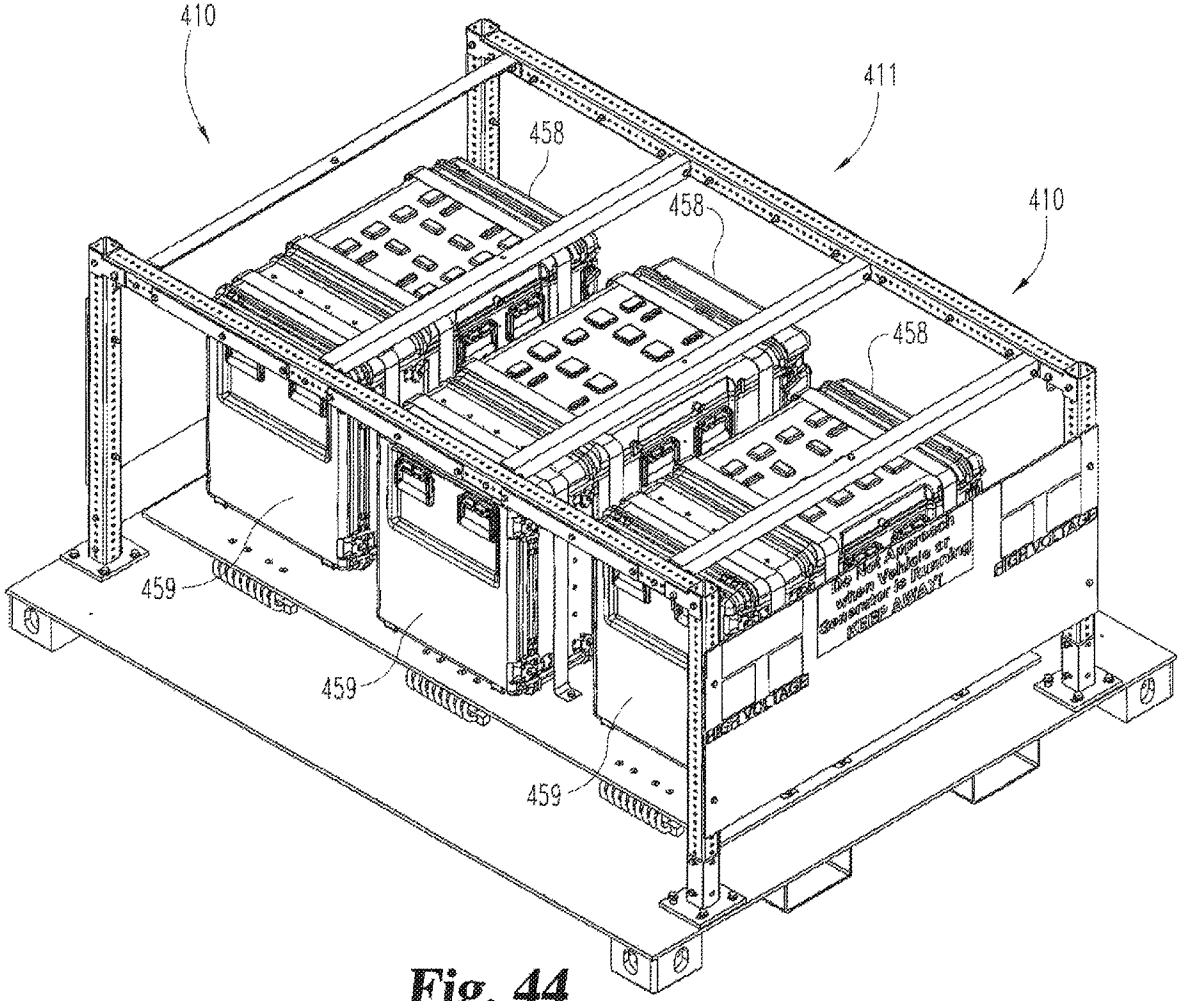
FIG. 44 is a back perspective view of the FIG. 43 power converters.

Referring now to FIGS. 43-44, power converters 410 and system control unit 411 are illustrated with sun shield 413 removed (for clarity). Power converters 410 and system control unit 411 are each located inside casings 458 which includes air conditioning/heating unit 459 attached to one side of casing 458. While not specifically referenced, each casing 458 includes connectors for high voltage cables and control cables. Each casing 458 may also optionally include one or more emergency stop button(s) to disconnect the output of power converters 410 from the rest of system 400.

Figure 45:
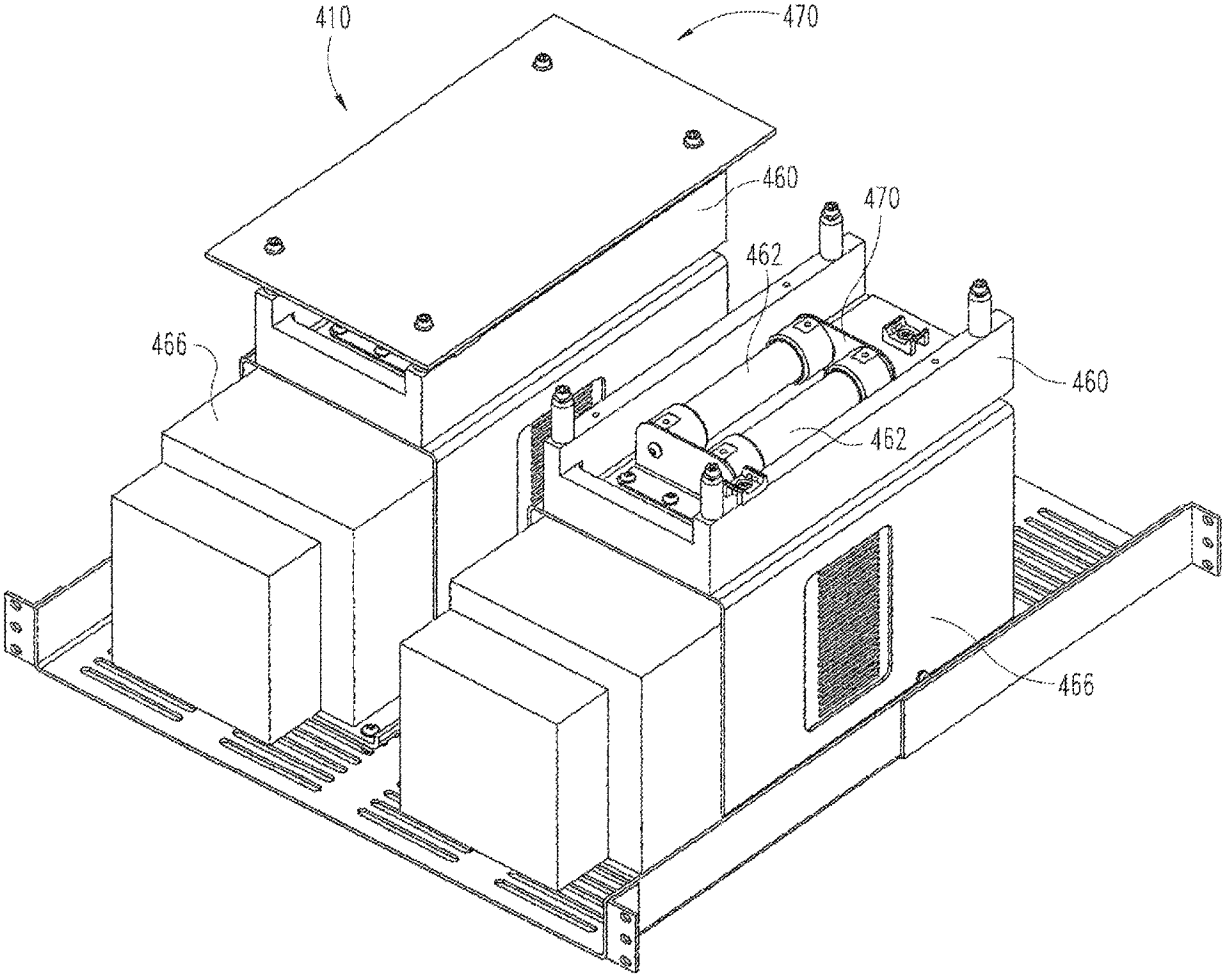
FIG. 45 is a perspective view of components included within the outer casing of the FIG. 43 power converters.

Referring now to FIG. 45, an interior layout of components contained within casing 258 in one power converter 410 is provided. Power converter 410 includes insulator 460 holding a pair of resistors 462, two power converters 466. Resistors 462 are connected in parallel defining resistors 470. Power converters 466 are known in the industry as capacitor charging power supplies. Power converters 466 correspond to model number 202A-40KV-POS-PFC or 202A-40KV-NEG-PFC supplied by TDK-Lambda at 3055 Del Sol Boulevard, San Diego, Calif. 92154, telephone number (619) 575-4400, www.tdk-lambda.com. The output of each power converter 466 is coupled to an individual high voltage module 408. However, multiple power converters 466 could be coupled to a single high voltage module 408, or a single power converter 466 could be coupled to multiple high voltage modules 408.

While not illustrated, system control unit 411 includes control circuitry, including a PLC, operable to control each individual power converters 466 and power source 112. System control unit 411 may optionally be controlled from within the cab of vehicle 102.

Figure 46:
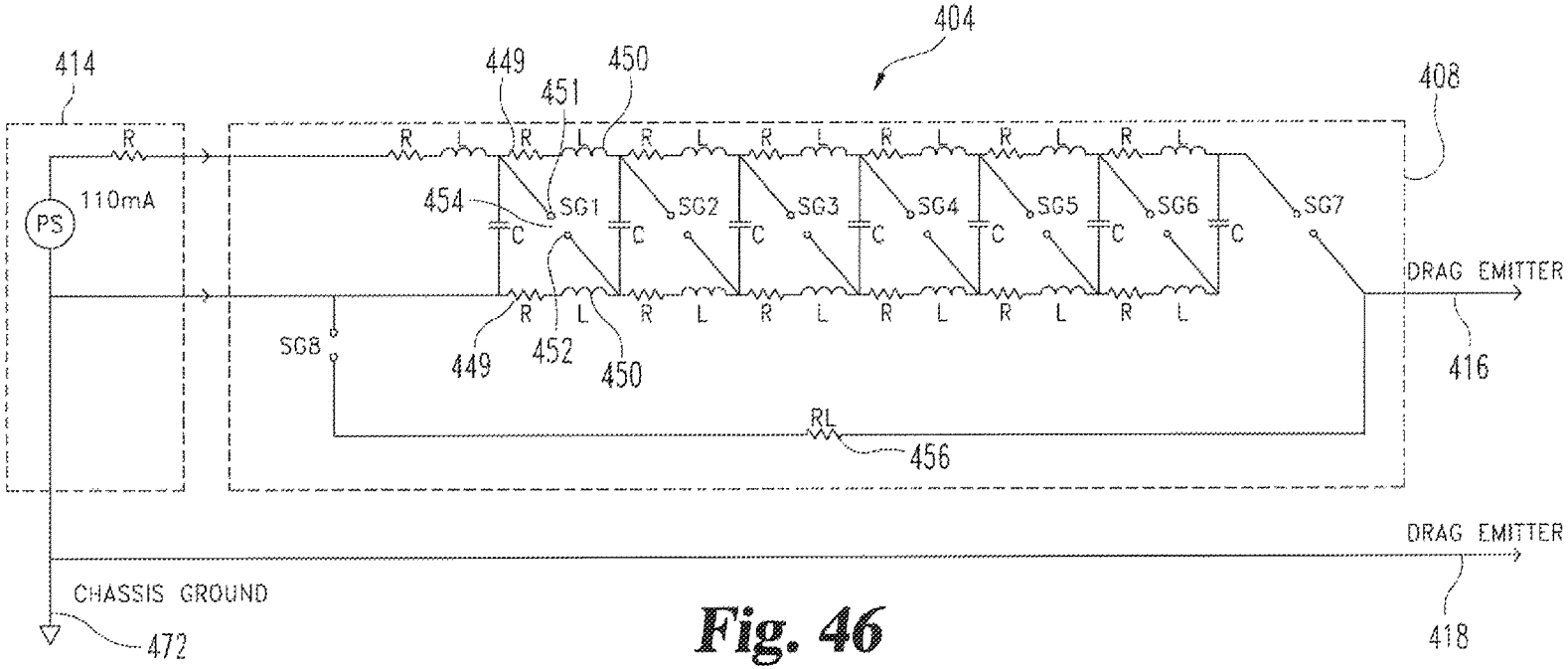
FIG. 46 is an electrical schematic of the FIG. 39 system.

Referring to FIG. 46, an electric schematic of and individual module 404 is provided including a Marx generator similar to what is shown in FIGS. 17-18, capacitors 246 are connected in parallel defining capacitor groups 247 and resistors 248 are connected in parallel defining resistor group 249. Capacitor groups 447, resistor groups 449, inductors 450 and electrodes 451 and 452 are arranged as a multi-stage Marx generator (with electrodes 451 and 452 defining spark gaps 454). The output of this Marx generator is electrically coupled directly to emitter 416 with emitter 418 electrically coupled to chassis ground 472. Load resistor 456 is electrically coupled between emitter 416 and the low power side of the Marx generator. The illustrated system can be configured with power supply 414 providing a nominal 54 J to 81 J of output power used to charge seven capacitors in high voltage module 408 to generate approximately 224 kV output applied to emitter 416.

Figure 47:
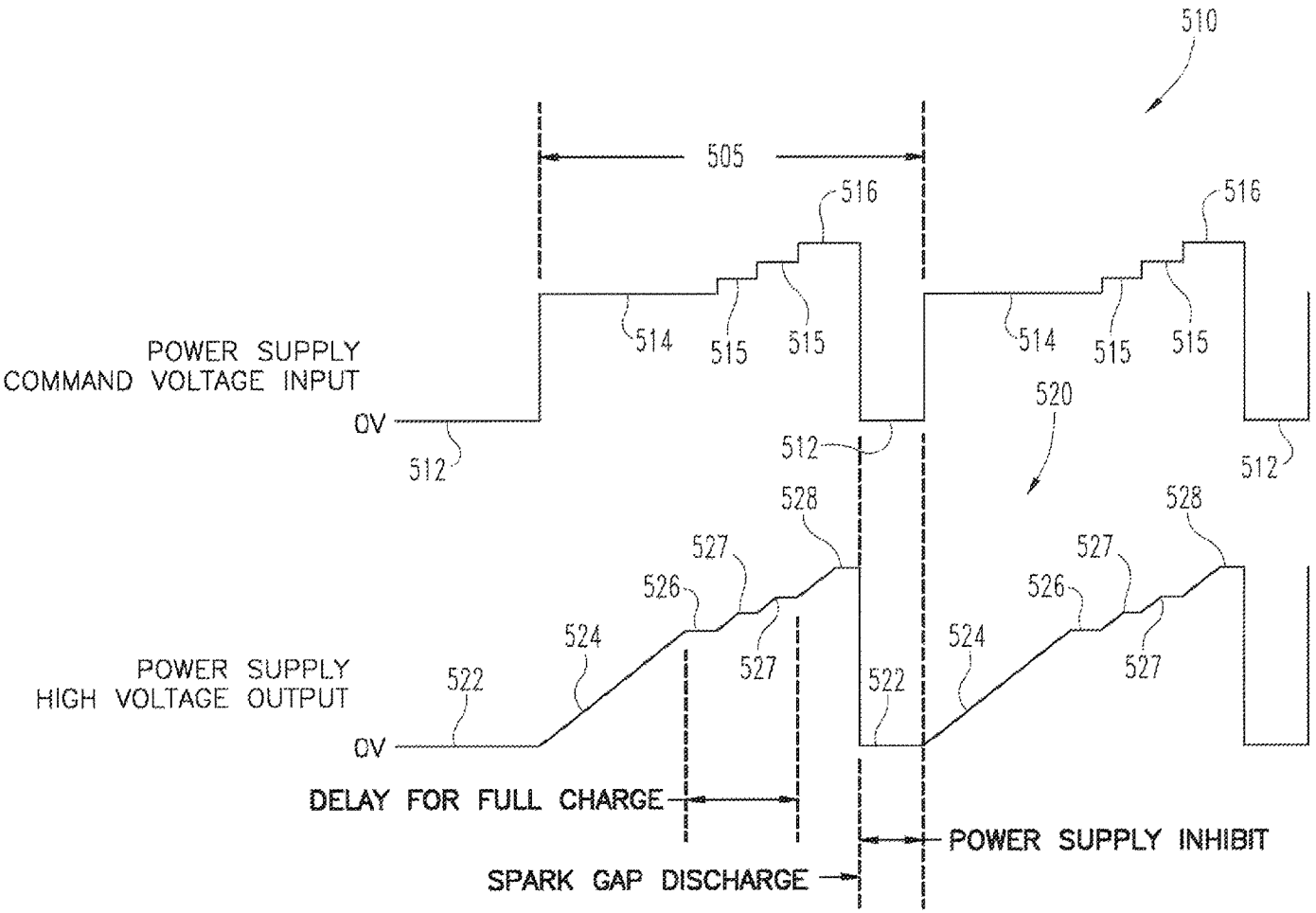
FIG. 47 is a timing diagram illustrating a power supply command voltage input and a power supply high voltage output along a common timeline during operation of one embodiment of the FIG. 39 system.

Referring now to FIG. 47, power supply command voltage input waveform 510 and power supply output voltage waveform 520 are shown. Power supply command voltage input waveform 510 represents the electrical control signal provided by system control unit 411 to an individual power converter 466. Power supply command voltage input waveform 310 includes inhibit output 512, charging output 514, step charge increases 515 and break over output 516. Charging output 514 and break over output 516 are a scaled voltage signal provided to power converter 466 indicating the relative voltage that power converter 466 is commanded to produce. Charging output 514 may be set below the break over voltage of all spark gaps 454 in a Marx generator while break over output 516 may be configured to be above the break over voltage of all spark gaps 454. In one embodiment, power converter 466 outputs between 0 V and 40 kV with charging output 514 being approximately 30 kV, break over output 516 being approximately 40 kV with spark gaps 454 having a break over voltage of approximately 32 kV, although the break over voltage could be set between 25 kV and 38 kV, as desired.

Power supply output voltage waveform 520 shows the voltage output of power converter 466 when controlled by power supply command voltage input waveform 510. Power supply output voltage waveform 520 includes inhibited output 522, charging output 524, charged output 526, stepped output 527 and overcharge output 528. Power converter 466 is a current limited voltage controlled power converter, so when power converter 466 receives the signal to provide charging output 514, the ability of power converter 466 to actually provide the requested voltage is limited by the power output of power converter 466 compared to the applied load. In system 400, the load is capacitor groups 447, inductors 450 and resistor groups 449. Thus, charging output 524 represents the voltage output of power converter 466 while capacitor groups 447 are being charged up to charging output 514. Charged output 526 represents a period when capacitor groups 447 are fully charged to charging output 514.

Stepped output 527 represents the voltage output of power converter 466 in response to each step charge increase 515. Overcharge output 528 represents the voltage output of power converter 466 while capacitor groups 447 are charging to break over output 516. At some point, the voltage across capacitors 447 will exceed the break over voltage of spark gaps 454, initiating a comparatively rapid discharge of capacitor groups 447 as described above. (In this regard, capacitor groups 447 do not discharge instantaneously. However, the time it takes for capacitor groups 447 to discharge can be measured in microseconds, which is much quicker than the illustrated waveforms with millisecond timing can distinguish.)

Power converter 466 includes a feedback signal to system control unit 411 that indicates when the voltage output of power converter 466 drops. Upon discharge, system control unit 411 signals inhibit output 512 until delay 505 has elapsed. The time when power converter 466 is inhibited allows the Marx generator to substantially completely discharge through emitter 416. The inhibit time may also be used to increase the amount of time available to resistor groups 449 and load resistor 456 to cool down between discharges.

In system 400, high voltage modules 408, power converter 210, system control unit 411 and power source 212 operate together, as described above, to define a source of pulsed electrical potential. Power converter 410 and high voltage modules 208 operate together, as described above, to define a pulsed voltage converter.

Similar to emitters 116 and 216 described above, emitters 416 may be configured as cathode emitters directly coupled to the output of a Marx generator. Emitters 418 may be configured as anode emitters coupled to either the input of a Marx generator or to a relative vehicular ground such as the chassis of vehicle 402. Emitters 416 and 418 may include an emitter surface on the surface facing the earth. In the illustrated embodiments, emitters 416, and 418 are dragged along the earth in direct contact with the earth. However, in other embodiments, emitters 416 and/or 418 can be suspended above the earth in close proximity to the earth as described above with regard to emitters 116, 118, 216 and/or 218.

Similar to systems 100 and 200, system 400 is constructed and arranged to move emitters 416 and 418 across the ground. One possible use of this apparatus is to scan an area for explosive devices, for example, Improvised Explosive Devices (IEDs), CBRNE devices or land mines. System 400 produces an electrical potential sufficiently high to transfer that electrical potential through substances normally considered non-conductive such as air, soil and coatings on wires.

Figure 48:
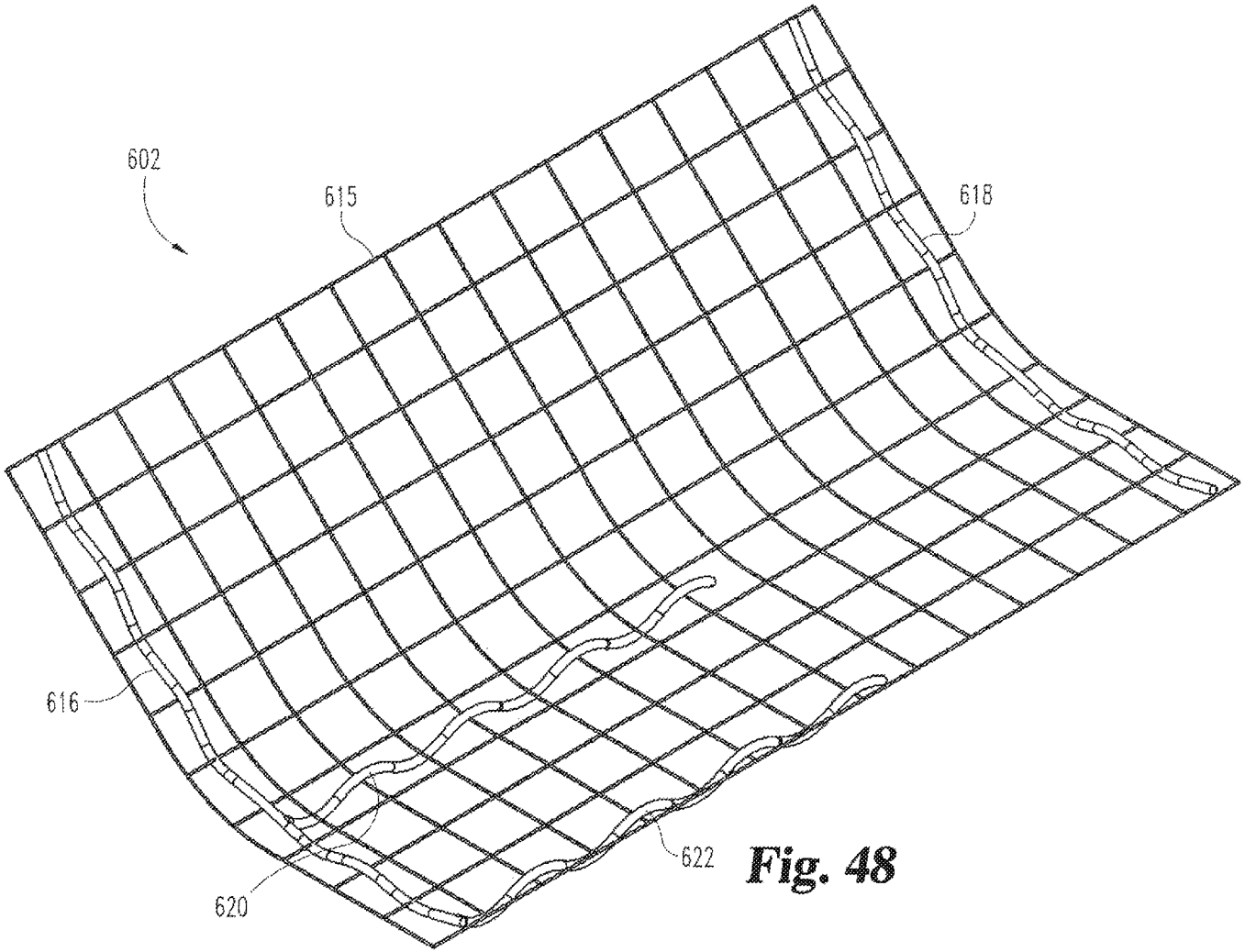
FIG. 48 is a perspective view of an alternative emitter layout.
Figure 49:
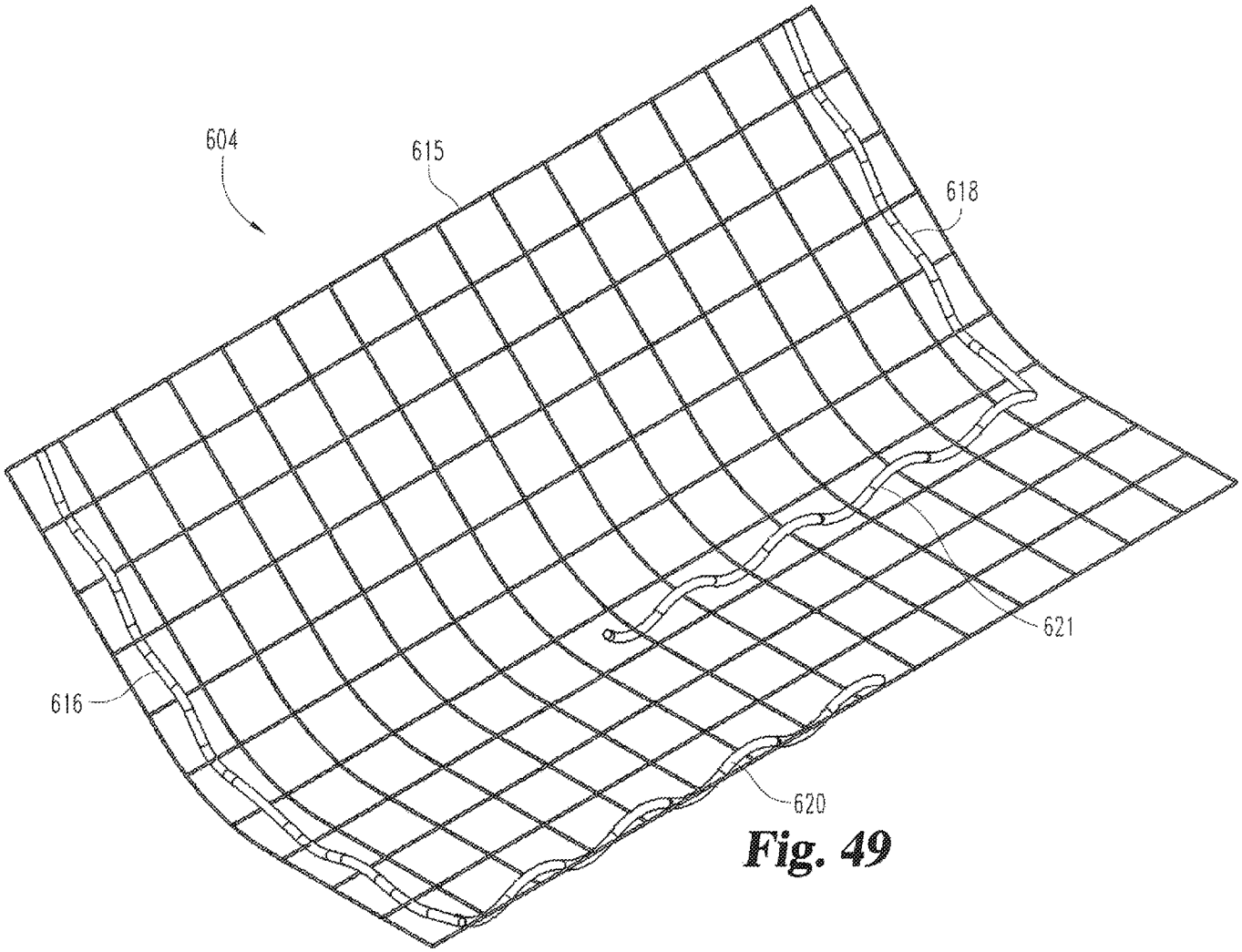
FIG. 49 is a perspective view of a second alternative emitter layout.
Figure 50:
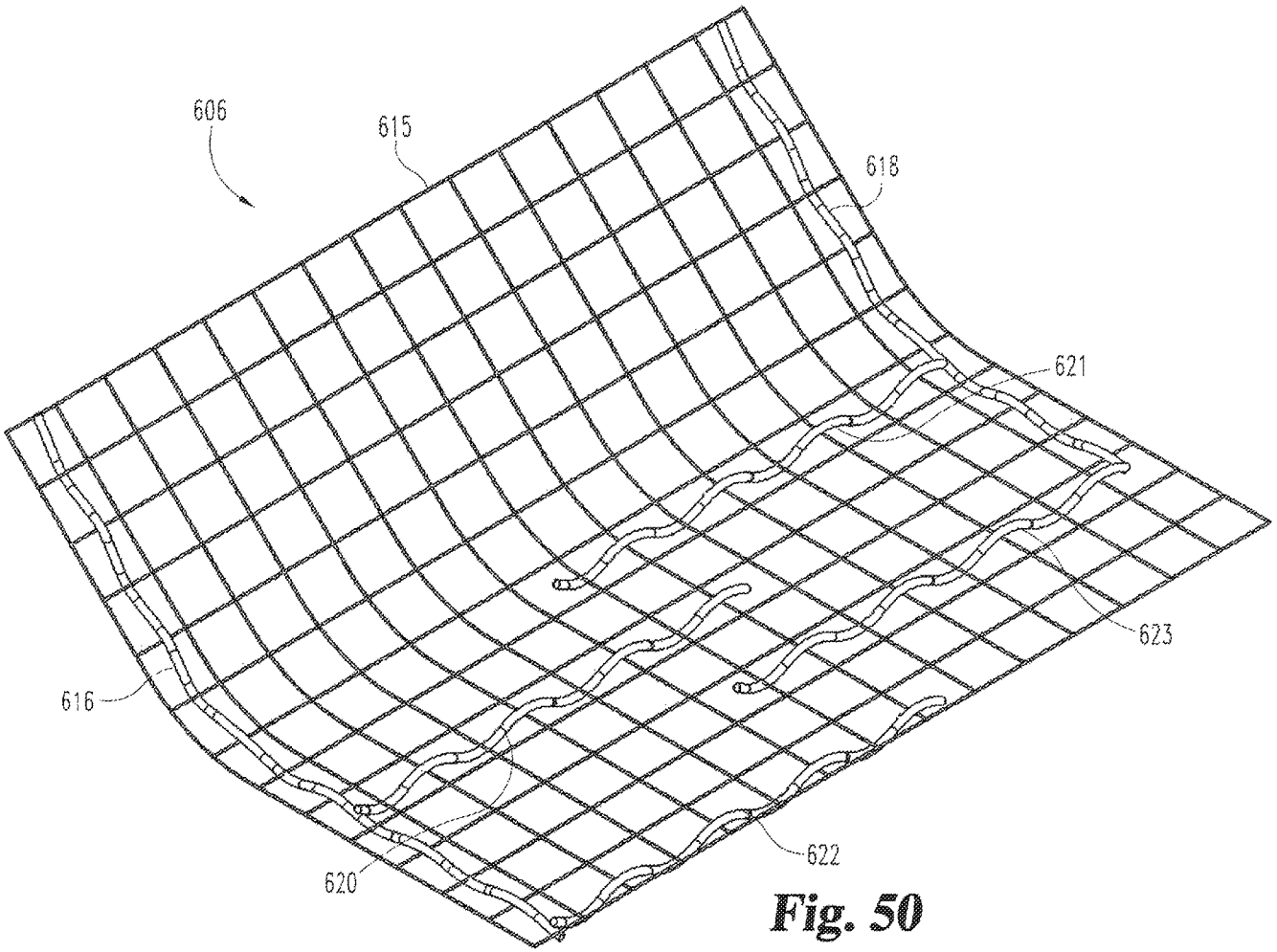
FIG. 50 is a perspective view of a third alternative emitter layout.

Referring now to FIGS. 48-50, alternative emitter layouts 602, 604 and 606 are shown. Emitter layout 602, as shown in FIG. 48 includes mesh support 615, emitters 616 and 618 and lateral extensions emitters 620 and 622 extending from emitter 616. Emitters 616, 618, 620 and 622 are interwoven in mesh support 615. Mesh support may be attached to system 100, 200 or 400 described above, replacing emitters 116, 118, 216, 218, 416 or 418. Lateral extension emitters 620 and 622 generate an electromagnetic field that is oriented approximately 90 degrees from the electromagnetic field generated around emitter 616 when emitter 616 is charged with current from a high voltage emitter such as high voltage emitter 108, 208 or 408. As described above, the current induced by a changing magnetic flux is proportional to the degree of perpendicularity of the conductor compared to the magnetic field with the highest induced current being generated in conductors perpendicular to the magnetic field and almost no current being generated in conductors parallel to the magnetic field. Emitting through perpendicular emitters such as emitters 616 and 620 ensures that a conductor will experience some degrees of induced current because an individual conductor cannot be parallel to both emitter 616 and emitter 620.

Emitter layout 604, as shown in FIG. 49, includes mesh support 615, emitters 616 and 618 and lateral extension emitter 620 extending from emitter 616 and lateral extension emitter 621 extending from emitter 618. Emitter layout 606, as shown in FIG. 50, includes mesh support 615, emitters 616 and 618 and lateral extension emitters 620 and 622 extending from emitter 616 and lateral extension emitters 621 and 623 extending from emitter 618.

Emitters 616, 620 and 622 can also be viewed as transmitting antenna with potential target conductor, such as command wires, pressure plates, and remote control devices acting as relay antenna that both receive and transmit the radiating energy.

Figure 51:
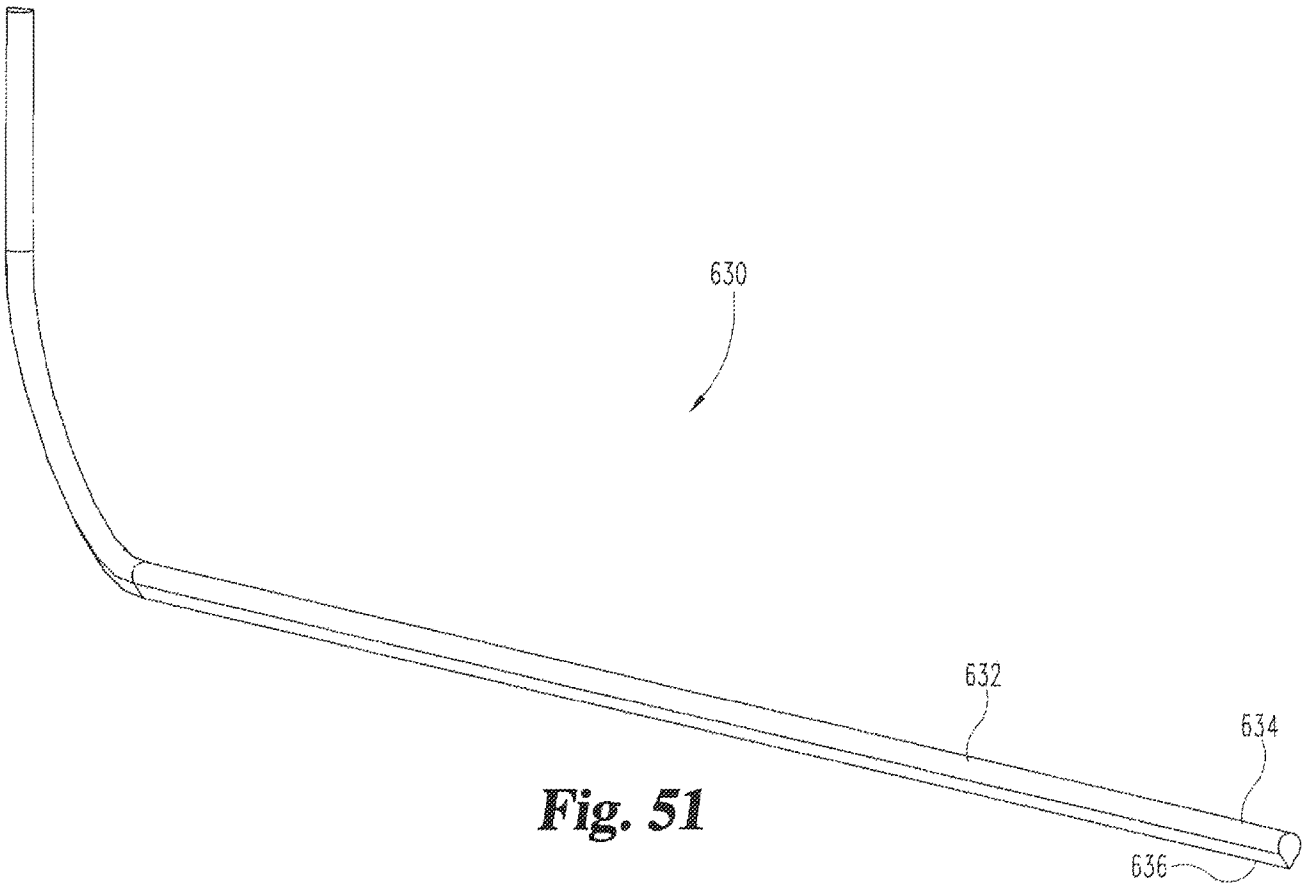
FIG. 51 is a perspective view of an alternative emitter configuration.

Referring to FIG. 51, emitter 630 is illustrated. Emitter 630 include drop profile emitter 632 defining rounded top surface 634 and pointed bottom surface 636. Emitter 630 may focus emitter electromagnetic energy downward through pointed bottom surface 636. Emitter 630 may optional be substituted for any emitter disclosed herein, including, but not limited to emitters 116, 216, 416, 616, 118, 218, 418 and 618. Emitter 630 may be rigid or flexible.

Figure 52:
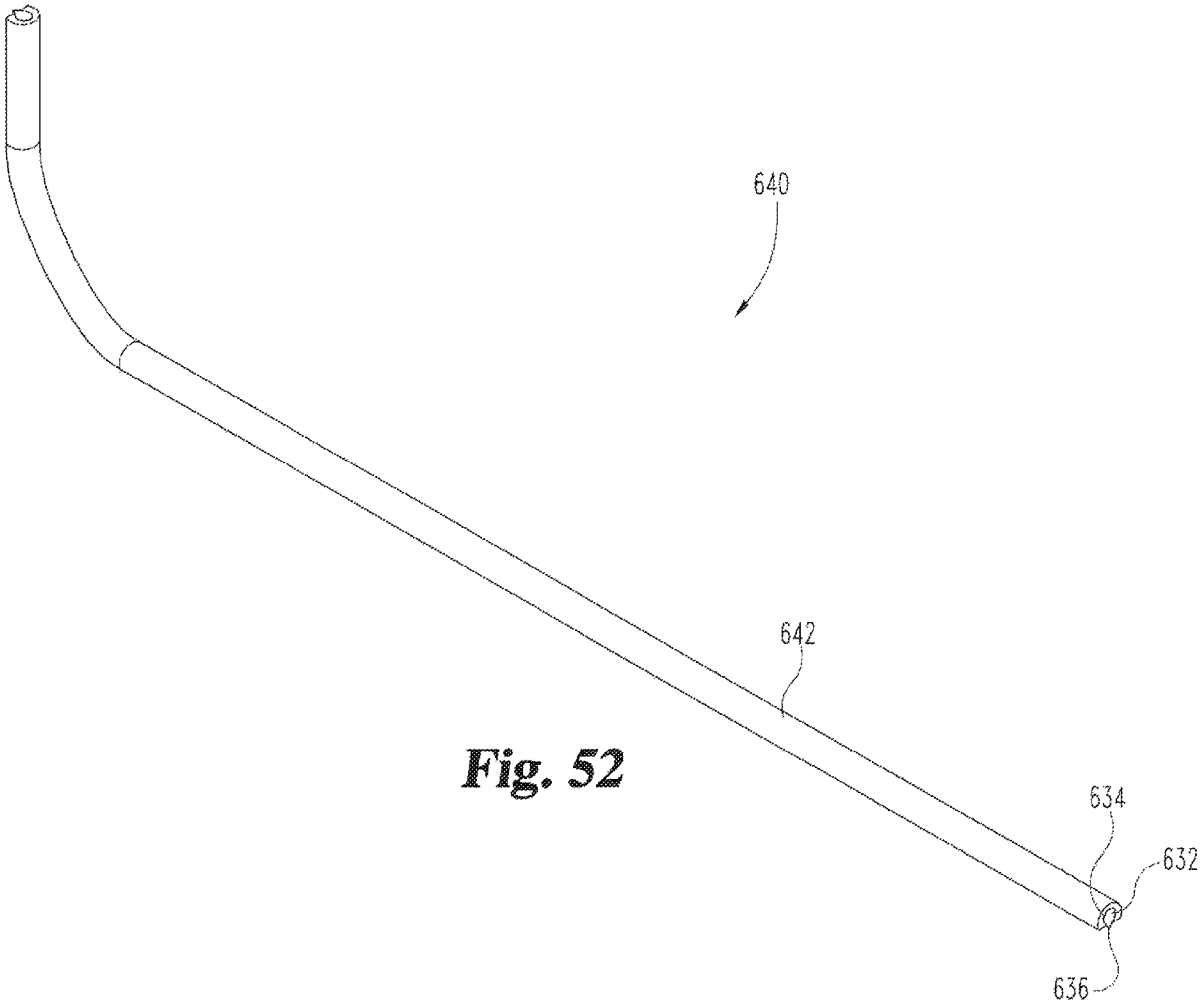
FIG. 52 is a perspective view of a second alternative emitter configuration.

Referring to FIG. 52, emitter 640 is illustrated. Emitter 640 includes drop profile emitter 632 substantially covered with dielectric 642 on rounded top surface 634. Dielectric 642 may provide some insulation against upwardly oriented discharges. Dielectric 642 may also provide some wear protection for drop profile emitter 632 when emitter 640 is used in direct contact with the ground.

Figure 53:
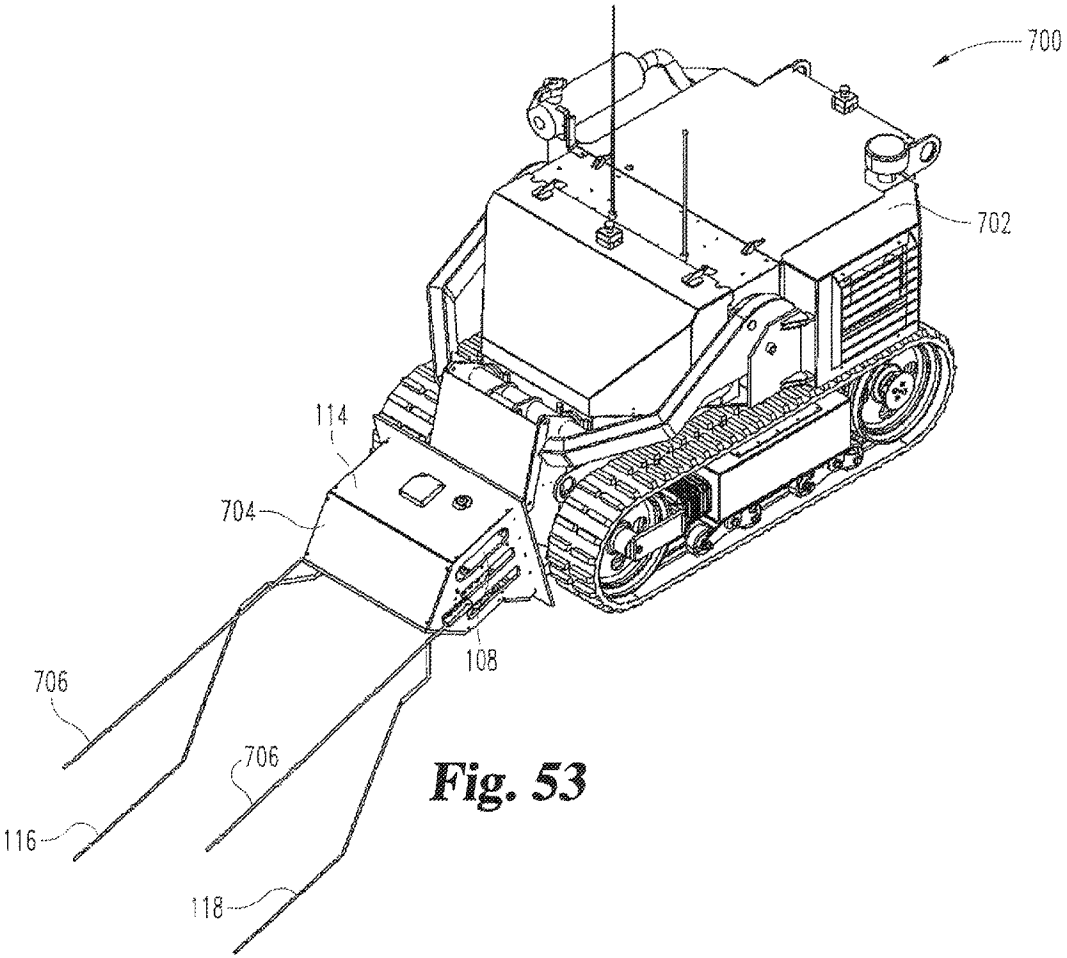
FIG. 53 is a perspective view of an alternative embodiment of a robotically mounted electrical discharge system.

Referring to FIG. 53 an alternative embodiments of robotically mounted electrical discharge systems is illustrated as system 700. System 700 includes vehicle 702, housing 704 and supports 706 supporting emitters 116 and 118. Vehicle 702 is a Mesa Technologies ACER Robot, although other robotic platforms could be used. Vehicle 702 includes tracks 708 and 709. Housing 704 contains module 108 and controls 114 as described above. Supports 706 are connected to emitters 116 and 118 and allow the standoff distance between emitters 116 and 118 and housing 704 to be increased. In addition, tracks 708 and 709 may be constructed of a conductive material and electrically connected to the output of module 108 with track 708 configured as a cathode emitter and track 709 configured as an anode emitter. The electrical output from module 108 may be connected to tracks 708 and 709 by any means desired, including, but not limited to, conduction through the drive train, wheels or a conductive brush in contact with tracks 708 and 709.

Figure 54:
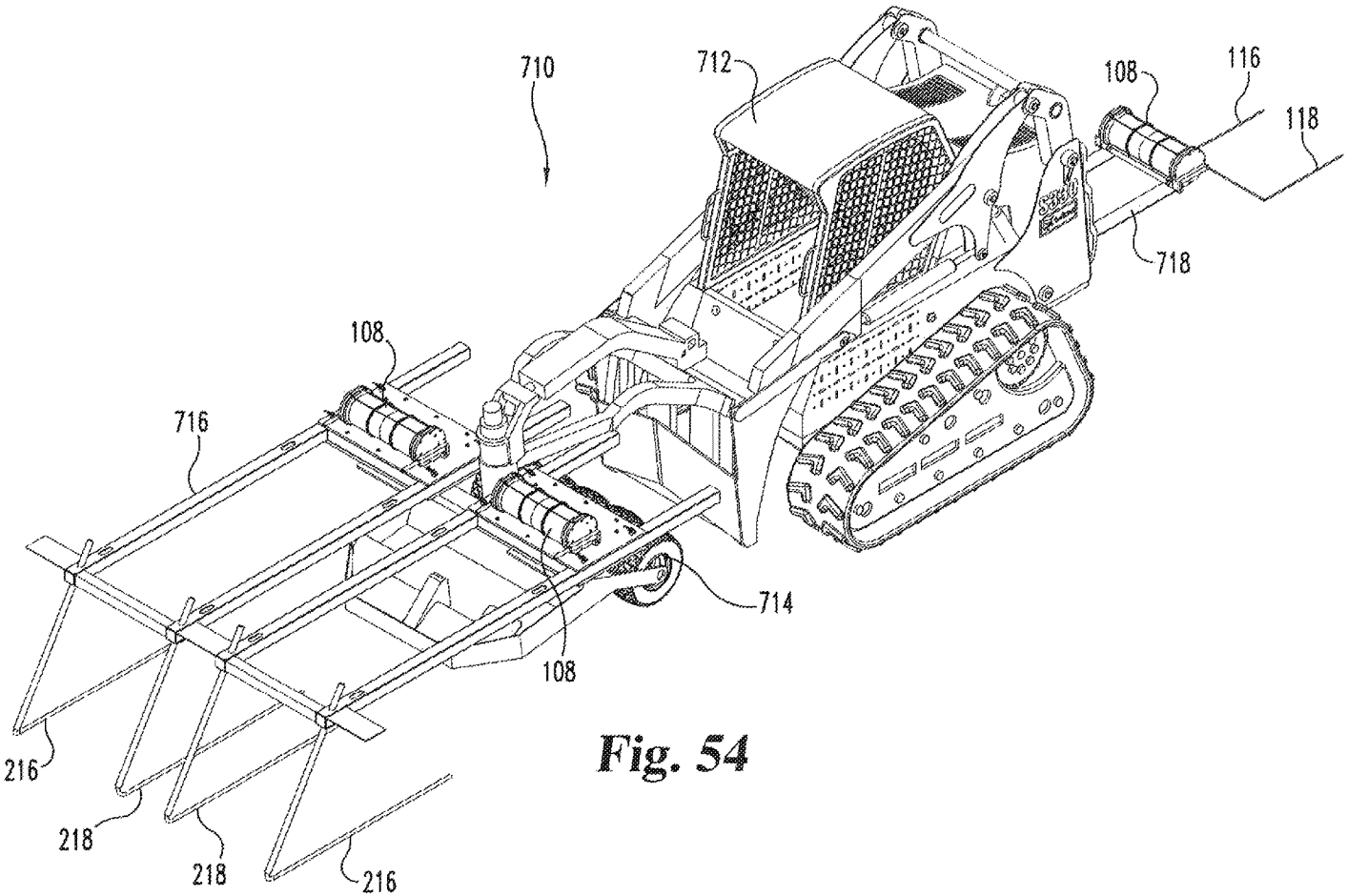
FIG. 54 is a perspective view of a second alternative embodiment of a robotically mounted electrical discharge system.

Referring to FIG. 54, a second alternative embodiments of robotically mounted electrical discharge systems is illustrated as system 710. System 710 includes vehicle 712, mine roller 714, supports 716 and 718, high voltage modules 108 and emitters 216, 218, 116 and 118. Vehicle 712 is a robot controlled Bobcat track loader. Mine roller 714 is a Minotaur Mine Roller. Support 716 holds a pair of high voltage modules 108 and two emitter pairs 216 and 218, each connected to one high voltage module 108. Emitters 216 and 218 are extended in front of mine roller 714 by support 716. Support 718 holds high voltage module 108 and emitters 116 and 118 trailing behind vehicle 712.

Figure 55:
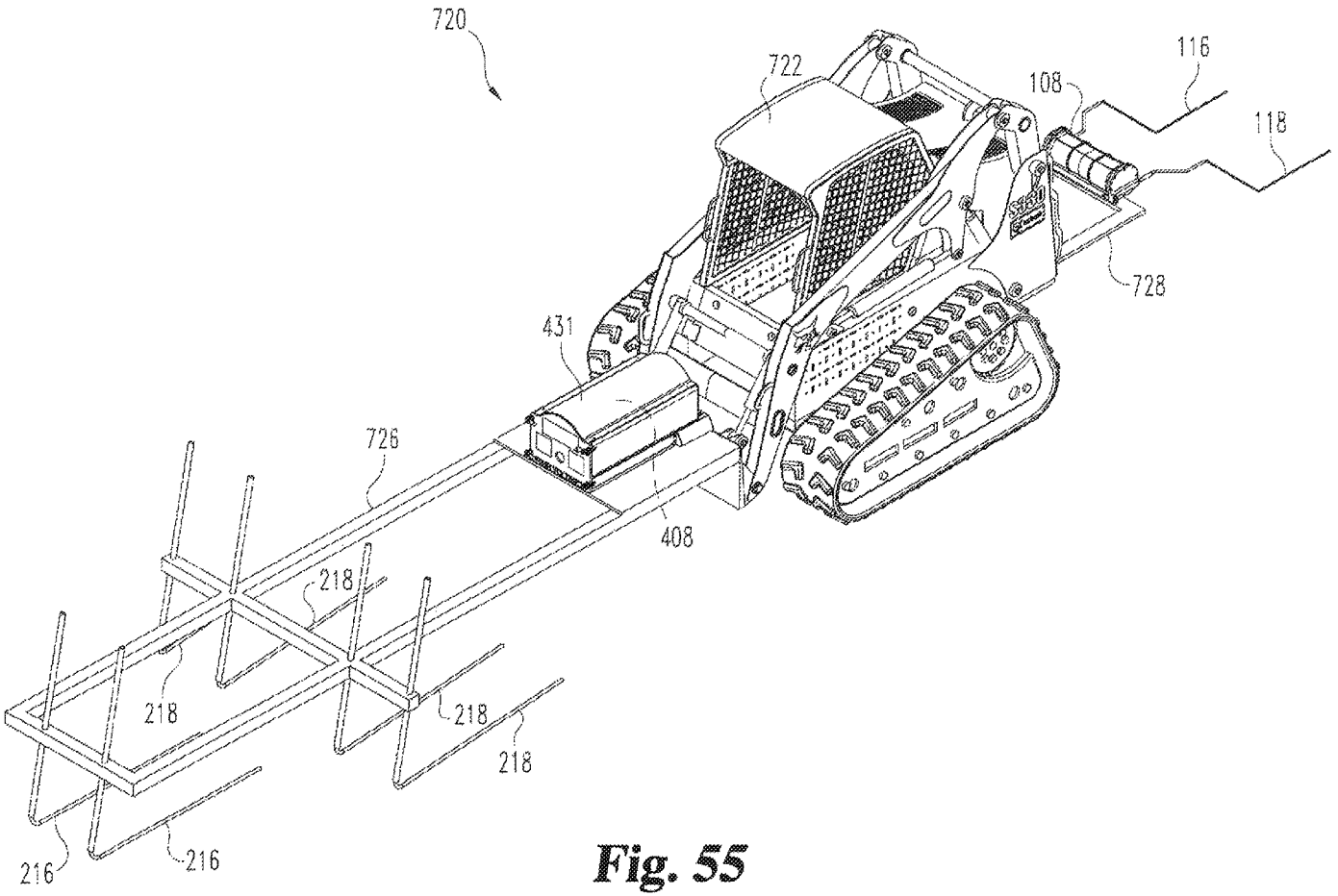
FIG. 55 is a perspective view of a third alternative embodiment of a robotically mounted electrical discharge system.

Referring to FIG. 55, a third alternative embodiments of robotically mounted electrical discharge systems is illustrated as system 720. System 720 includes vehicle 722, supports 726 and 728, casing 431 containing high voltage module 408, high voltage module 108 and emitters 216, 218, 116 and 118. Vehicle 722 is a robot controlled Bobcat track loader. Support 726 holds casing 431 containing high voltage module 408, two spaced emitters 216 on the forward end of support 726 and four spaced emitters 218 behind emitters 216. Support 728 holds high voltage module 108 and emitters 116 and 118 trailing behind vehicle 722. High voltage module 408 is connected to both emitters 216. As describe above, emitters 218 may be connected to a vehicular ground or to the low voltage side of high voltage module 408.

Figure 56:
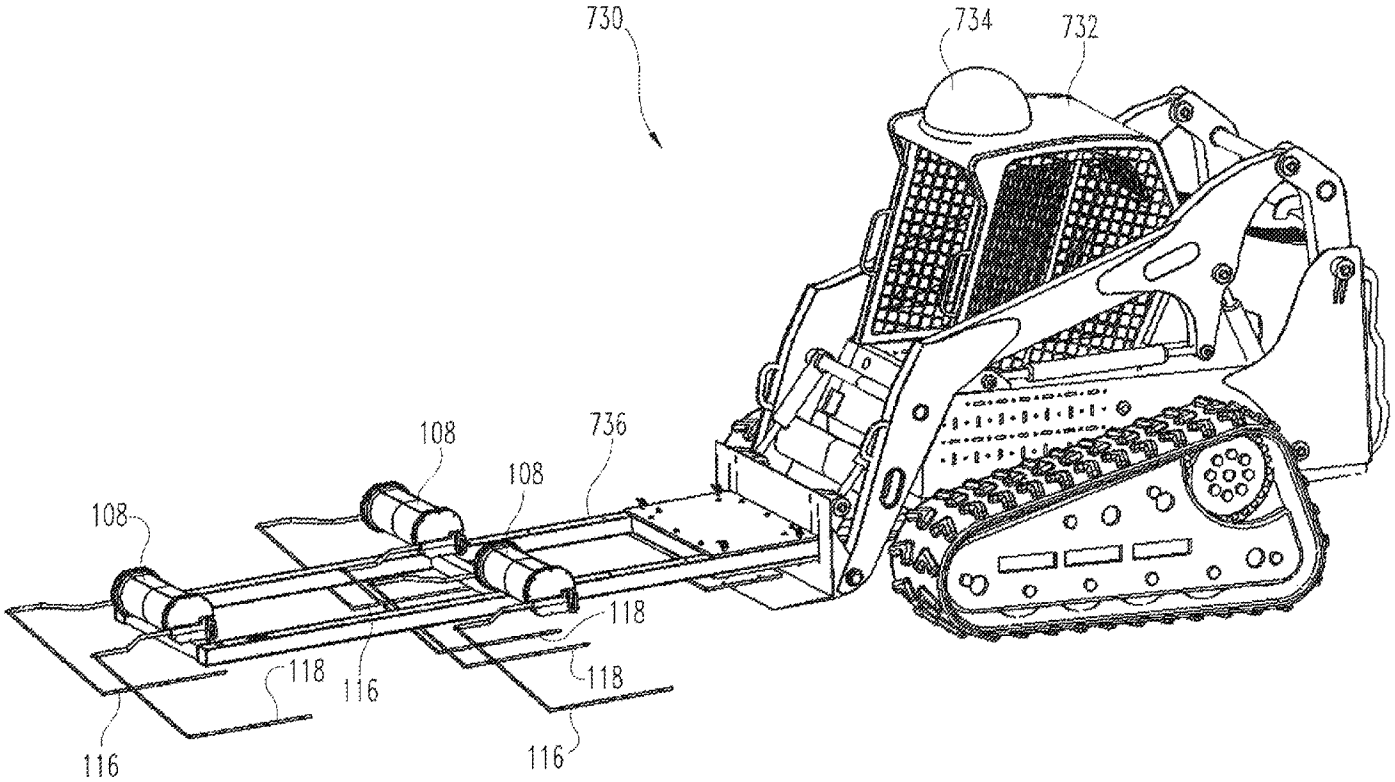
FIG. 56 is a perspective view of a fourth alternative embodiment of a robotically mounted electrical discharge system.

Referring to FIG. 56, a fourth alternative embodiments of robotically mounted electrical discharge systems is illustrated as system 730. System 730 includes vehicle 732, remote control system 734, support 736, three high voltage modules 108 and three sets of emitters 116 and 118. Vehicle 732 is a robot controlled Bobcat track loader. Remote control system 734 is a QinetiQ remote control system with a camera mounted on top of vehicle 732. Support 716 holds three high voltage modules 108 and three emitter pairs 116 and 118, each connected to one high voltage module 108.

Referring to FIG. 57, a fifth alternative embodiment of a robotically mounted electrical discharge system is illustrated as system 740. System 740 includes vehicle 742 having tracks 744 and 745 and wheels 746 and containing high voltage module 748 (not illustrated). High voltage module 748 may be configured using any of the design options discussed above for various high voltage modules disclosed herein. Tracks 744 and 745 are constructed of a conductive material and are electrically connected to the output of high voltage module 748 with one of tracks 744 or 745 configured as a cathode emitter and the other track 744 or 745 configured as an anode emitter. The electrical output from high voltage module 748 may be connected to tracks 744 and 745 by any means desired, but not limited to, conduction through the drive train, wheels 746 or a conductive brush in contact with tracks 744 and 745.

Referring to FIG. 58, emitter 717 is illustrated. Emitter 717 includes a plurality of emitter conductors 719 attached at angles to emitter 717 near to the earth. Emitter 717 is configured to be connected as a single anode or cathode electrode and could be substituted for any other emitter disclosed herein. Emitter 717 may increase the effective area covered by a single emitter 717 compared to other linear emitters such as emitters 116 or 118 as illustrated in FIG. 59.

Referring to FIG. 59, sled 750 is illustrated. Sled 750 includes emitters 116 and 118 and supports 752 and 754. Supports 752 and 754 are constructed of a dielectric material. Supports 752 and 754 may aid in preventing emitters 116 and 118 from touching.

Figure 60:
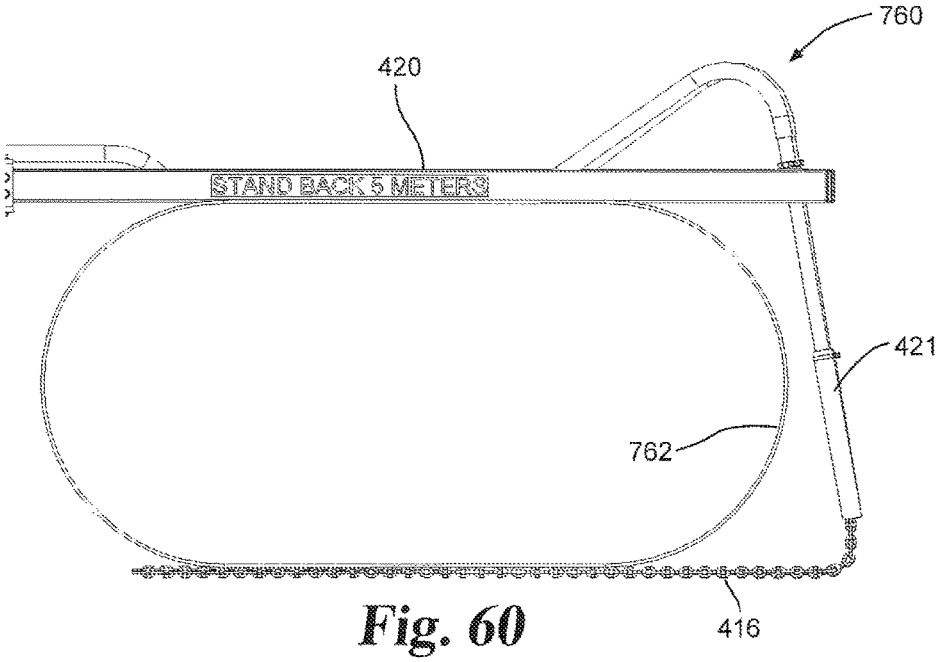
FIG. 60 is a side view of an alternative embodiment of an emitter assembly.

Referring to FIG. 60, emitter assembly 760 is illustrated. Emitter assembly 760 includes rigid support 420, flexible support 421, emitter 416 and loop 762. Rigid support 420, flexible support 421 and emitter 416 substantially correspond to the structures described above with the same reference numbers. Loop 762 is a flexible loop positioned between rigid support 420 and emitter 416 that supplies a suitable biasing force to keep emitter 416 substantially in contact with the earth during forward motion. Loop 762 may also assist in keeping emitter 416 substantially linear and substantially in-line with rigid support 420 during use. Loop 762 is conducted of a dielectric material that can be elastically deformed. Loop 762 may decrease the amount of time that emitter 416 is out of contact with the earth when a non-flat feature is encountered, such as a bump. Loop 762 may also decrease any tendency for emitter 416 to whip side-to-side during use.

Figure 61:
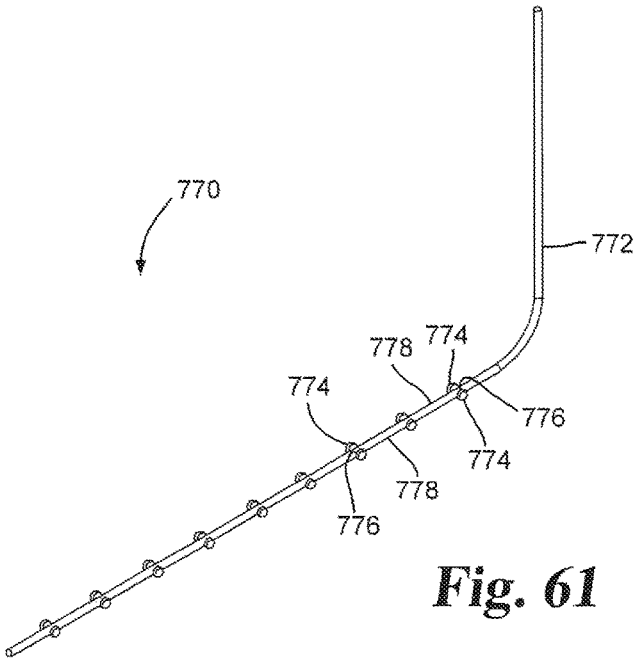
FIG. 61 is a perspective view of a wheeled emitter.

Referring to FIG. 61, wheeled emitter 770 is illustrated. Wheeled emitter 770 includes emitter 772, wheels 774, joints 776 and emitter segment 778. Emitter segments 778 may be rigid or flexible segments of emitter as described above. Joints 776 may permit emitter segments 778 to pivot relative to one another in a vertical plain to follow an earth contour. Wheels 774 may be constructed of a dielectric material or of a conductive material. If a conductive material is used, a sharp edge may provide an increased electrical field along the edge during discharge which may increase field strength around the wheel which may promote plasma discharge from wheels 774.

Figure 62:
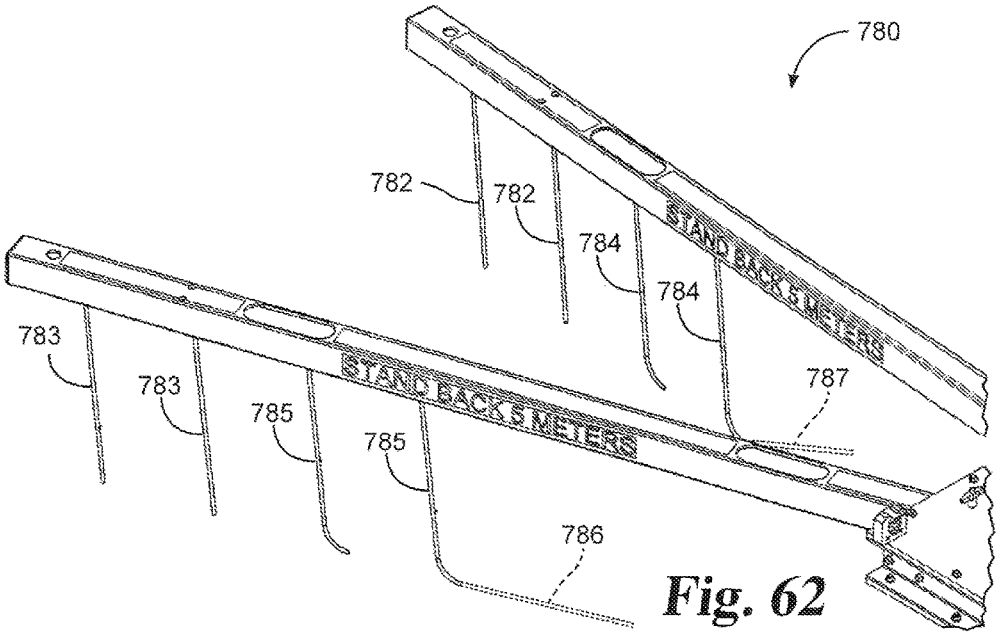
FIG. 62 is a perspective view of a brush emitter assembly.

Referring to FIG. 62, brush emitters 780 are illustrated. Brush emitters 780 include probes 782, 783, 784 and 785, with probes 782 and 784 configured as anode emitters and 783 and 785 configured as cathode emitters. Probes 782, 783, 784 and 785 may be ridge, semi-rigid or flexible. Probes 782 and 783 are configured in the illustrated configuration as rigid rake type probes while probes 784 and 785 are configured as semi-rigid rods with flexible drag emitters at the ground level. Probe extension 786 and/or 787 may be included to increase the contact area with the ground. Probes 782, 783, 784 and 785 may be inserted through dielectric tubes until contact with the earth (not illustrated). Such tubes may provide support to probes 782, 783, 784 and 785 and may reduce electric losses through the atmosphere. As illustrated in FIG. 62, probes 782, 783, 784 and 785 are all oriented vertically.

Figure 63:
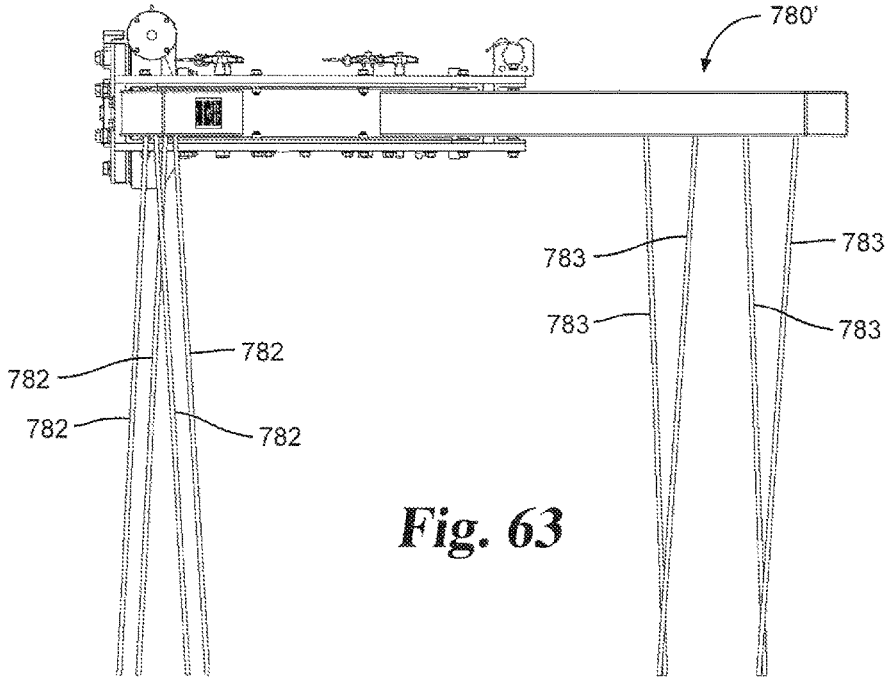
FIG. 63 is a front view of an alternative embodiment of a brush emitter assembly.

Referring to FIG. 63, brush emitters 780' are illustrated. Brush emitters 780' is an alternate configuration of brush emitters 780. Brush emitters 780' include only probes 782 and 783 and probes 782 and 783 are alternatively angled from a vertical orientation. It should be understood that any combination of probes 782, 783, 784 and 785 may be used and that any number of probes 782, 783, 784 and 785 may be used to define an emitter. Probes 782, 783, 784 and 785 may be oriented vertically or may be angle away from vertical.

Figure 64:
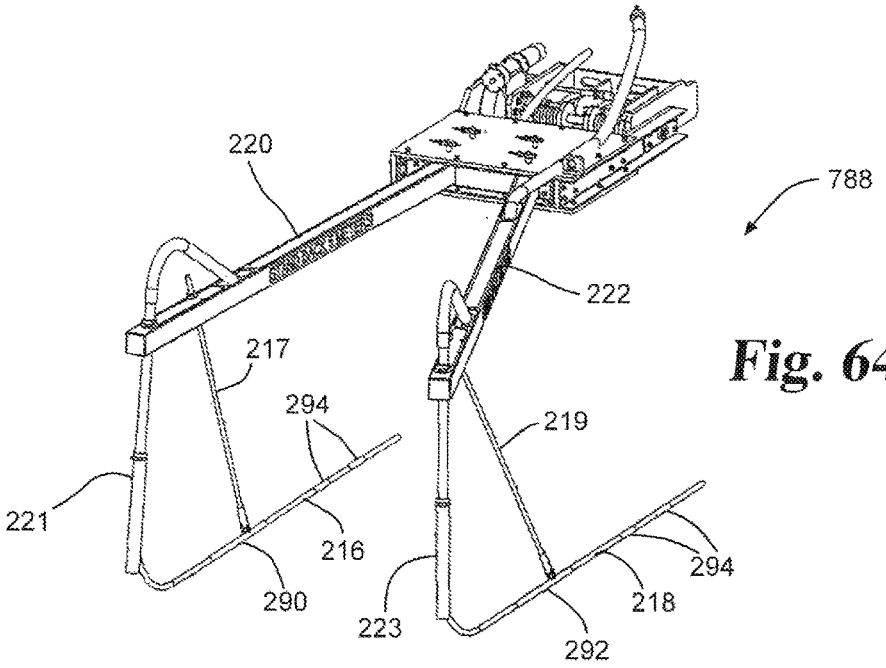
FIG. 64 is a perspective view of an alternative embodiment of an emitter assembly.

Referring to FIG. 64 emitter assembly 788 is illustrated. Emitter assembly 788 includes emitters 216 and 218, rigid supports 220 and 222 and flexible supports 221 and 223. Emitters 216 and 218 as illustrated are flexible metal cables. Emitter 216 includes rigid tubes 290 and 294 attached to the outside surface of emitter 216. Emitter 218 includes rigid tubes 292 and 294 attached to the outside surface of emitter 218. Tubes 290, 292 and 294 may decrease the overall flexibility of cable emitters 216 and 218 and may also increase the usable lifespan of cable emitters 216 and 218 by providing additional material that can be worn off and supporting the circumference of cable emitters 216 and 218. Emitter assembly 788 also includes stabilizing rods 217 and 219 positioned between rigid supports 220 and 222 and emitters 216 and 218 with stabilizing rod 217 attached to tube 290 and stabilizing rod 219 attached to tube 292. Stabilizing rods 217 and 219 may help keep emitters 216 and 218 in contact with the earth and may help prevent emitters 216 and 218 from crossing due to potential whipping during forward movement.

Figure 65:
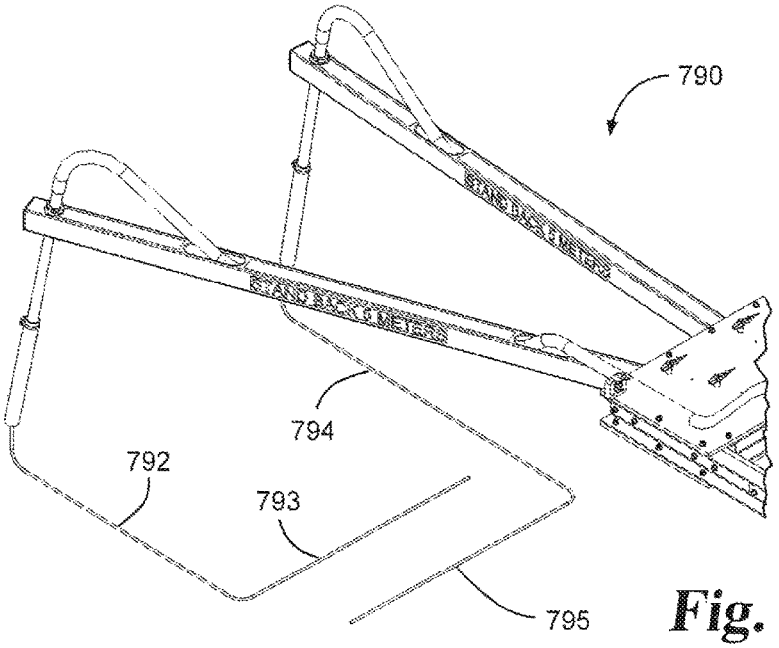
FIG. 65 is a perspective view of an alternative embodiment of an emitter assembly.

Referring to FIG. 65 emitter assembly 790 is illustrated. Emitter assembly 790 includes emitters 792 and 794 with emitter 792 including angled extension 793 and emitter 794 includes angled extension 795. Emitter 792 and extension 793 define an multi-axis emitter and emitter 794 and extension 795 define another multi-axis emitter. As discussed above, emitters oriented in multiple axes may be more capable of inducing current flow in a conductor (such as a command wire) oriented substantially parallel to one of the emitters. Emitters oriented in multiple axes may also cover more area when used, potentially increasing the likelihood of discharging energy directly into devices. In either case (direct discharge or induced current flow) sufficient energy may be transmitted into a target explosive device to detonate or dud the device. Emitter assembly 790 provides an alternative structure to generate a multi-axis electromagnetic field.

Figure 66:
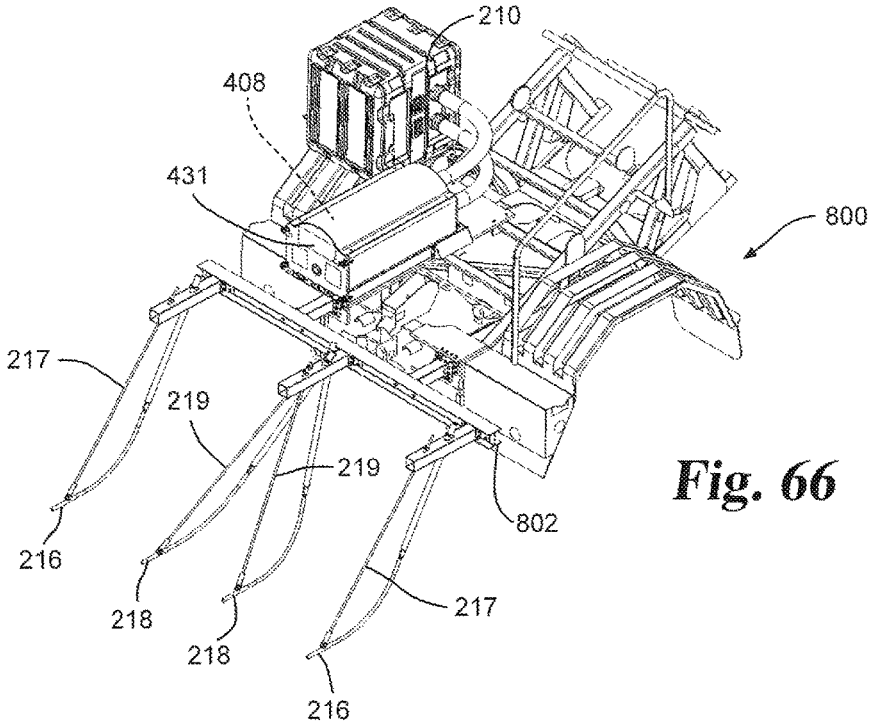
FIG. 66 is a perspective view of an alternative embodiment of an emitter assembly.

Referring to FIG. 66, emitter assembly 800 is illustrated. Emitter assembly 800 includes frame 802, power converter 210, casing 431 containing module 408, emitters 216 and 218 and stabilizing rods 217 and 219. Emitter assembly 800 is configured to be mounted behind a vehicle for emitters 216 and 218 to be drug behind the vehicle. Of note, emitters 216 are commonly wired to module 408 as cathode emitters and emitters 418 are commonly wired to module 408 as anode emitters.

Figure 67:
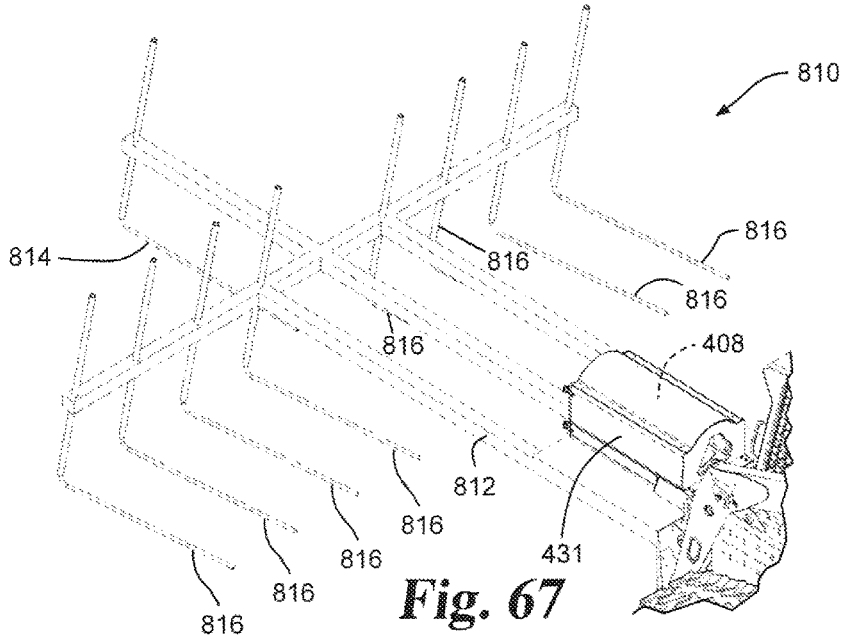
FIG. 67 is a perspective view of an alternative embodiment of an emitter assembly.

Referring to FIG. 67, emitter assembly 810 is illustrated. Emitter assembly 810 includes frame 812, casing 431 containing module 408 and emitters 814 and 816. One of emitters 814 or 816 are commonly wired to module 408 as cathode emitter(s) and the other one of emitters 814 or 816 are commonly wired to module 408 as anode emitter(s). Note that emitter 814 is positioned forward of emitters 816 relative to the direction of travel. This configuration may extend the field of coverage compared to connecting a single pair of emitters to a high voltage module.

Figure 70:
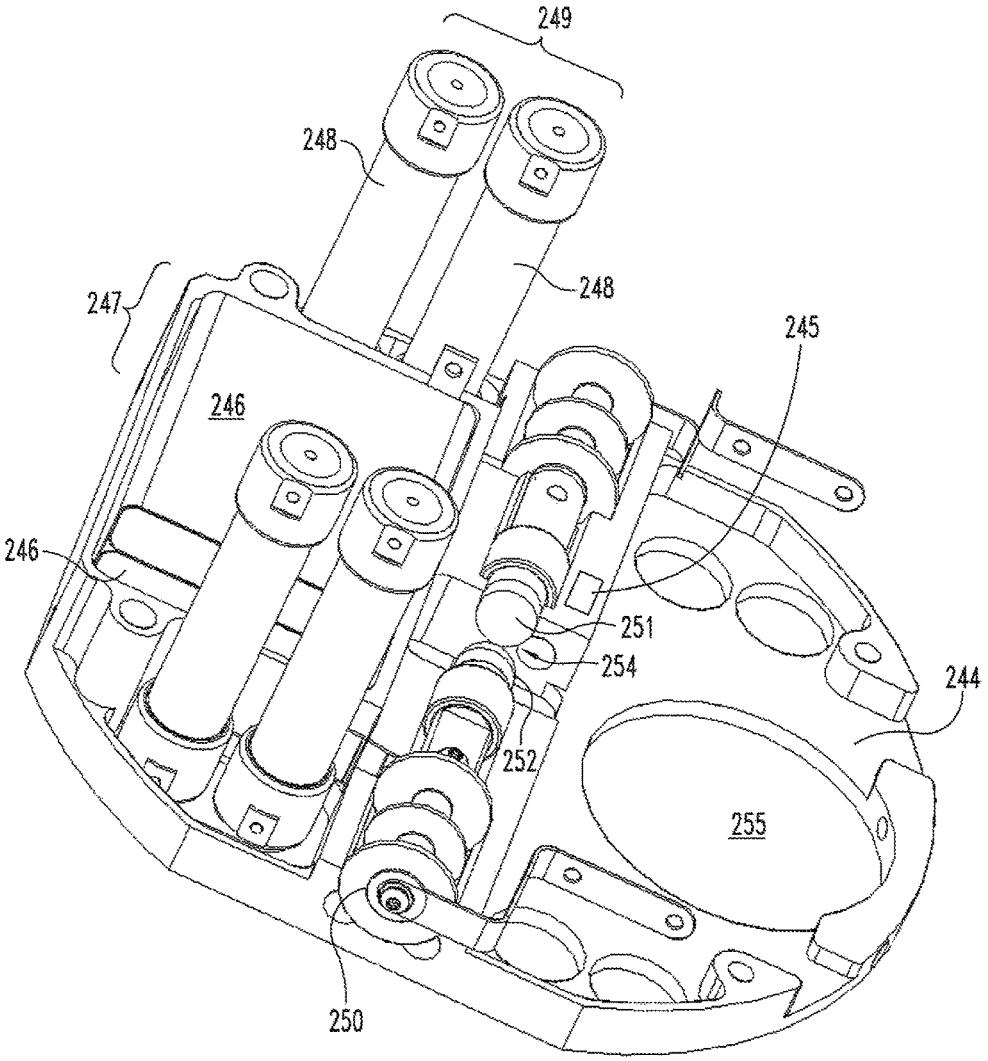
FIG. 70 is a perspective view of an alternative embodiment of a Marx generator frame component incorporating an adjustable spark gap mechanism.

Referring to FIG. 70 an alternative embodiment of frame component 244 is illustrated as frame component 244'. Frame component 244' includes capacitors 246, resistors 248, inductors 250, electrodes 251 and 252 defining spark gaps 254 and spark gap adjustment mechanism 245. Capacitors 246 are connected in parallel defining capacitor groups 247 and resistors 248 are also connected in parallel in groups defining resistor groups 249. Spark gap adjustment mechanism 245 allows the position of electrode 251 to be adjusted relative to electrode 252. This allows spark gap 254 to be set wider or narrower, yielding a higher or lower voltage requirement for spark gap 254 to trigger. In this regards, frame component 244' may be selectively used for a trigger spark gap in a Marx generator as described above. A variety of manual or remotely adjustable mechanisms could be used for spark gap adjustment mechanism 245 including a manual screw, an electric solenoid, a hydraulic cylinder, a pneumatic cylinder, a hydraulic driven screw, a pneumatic driven screw, a piezoelectric actuator, a electro-mechanical actuator or a linear motor, for example.

Spark gap adjustment mechanism 245 may be included as part of an automatic voltage control system. Voltage meter 380 may be used to detect discharge voltage. The breakdown voltage of the spark gaps can be determine by dividing the detected voltage by the number of stages in the Marx generator. If the breakdown voltage varies outside of a predetermined range, then spark gap adjustment mechanism 245 could be used to adjust the spark gap of the triggering spark gap. This adjustment could be automated as a closed loop or an open loop system.

It should be understood that the system disclosed herein can be configured to generate and emit a positive and/or negative polarity electrical potential. Emitters are labeled in the claims as cathode emitters and anode emitters, referring to by convention for discharging components, with the cathode emitters referring to the emitter in which electrons flow out of (positive polarity) and the anode emitters referring to the emitter in which the current flows into (negative polarity). If a positive potential is generated, then the cathode emitter is electrically coupled to the electrical power supply and the anode emitter may be coupled to a chassis ground and/or to the other side of the electrical power supply. If a negative potential is generated, then the anode emitter is electrically coupled to the electrical power supply and the cathode emitter may be coupled to a chassis ground and/or to the other side of the electrical power supply. Furthermore, it is possible to configure an electrical power supply to generate both a positive and a negative potential, for example, ±200 kV. In that case, the cathode emitter is electrically coupled to the positive output of the electrical power supply and the anode emitter is electrically coupled to the negative output of the electrical power supply.

It should be understood that the Marx generators disclosed herein are designed to run for potentially hundreds of hours without maintenance in an unsealed environment while discharging into an unknown load (each discharge could be into a high impedance environment, a low impedance environment, or anything in-between).

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

We claim:

1. An apparatus comprising:

an electrical power supply providing a pulsed electrical potential above 30,000 volts with at least 30 Joules of energy per pulse;

a cathode emitter constructed and arranged to be moved along the earth in direct contact with the earth, wherein the cathode emitter is electrically coupled to the electrical power supply and wherein the cathode emitter is constructed and arranged to discharge the pulsed electrical potential into the earth; and, a vehicle constructed and arranged to move the cathode emitter along the earth in direct contact with the earth.

2. The apparatus of claim 1, further comprising a velocity sensor configured to determine the velocity of the vehicle and a processor constructed and arranged to determine a pulse rate for the electrical power supply based at least in part on the determined velocity of the vehicle.

3. The apparatus of claim 1, further comprising a voltage meter constructed and arranged to detect the voltage of the cathode emitter.

4. The apparatus of claim 1, further comprising a current sensor constructed and arranged to detect the current between the electrical power supply and the cathode emitter.

5. The apparatus of claim 1, further comprising a vehicle constructed and arranged to carry and move the cathode emitter along the earth in close proximity to the earth, wherein the vehicle includes wheels and/or tracks and wherein the wheels and/or tracks are constructed of a conductive material and are electrically coupled to the pulsed electrical potential provided by the electrical power supply.

6. The apparatus of claim 1, wherein the cathode emitter includes a plurality of interconnected conductors oriented on different axes.

7. The apparatus of claim 1, further comprising:

an anode emitter, and a separator constructed of a dielectric material coupled between the cathode emitter and the anode emitter, wherein the separator substantially maintains a spacing between the anode and cathode emitters.

8. The apparatus of claim 1, further comprising an emitter support structure constructed and arranged to maintain the position of the cathode emitter in close proximity to the earth.

9. The apparatus of claim 8, wherein the emitter support structure is constructed and arranged to bias the cathode emitter toward the earth.

10. The apparatus of claim 8, wherein the emitter support structure comprises a wheel coupled to the cathode emitter.

11. The apparatus of claim 1, further comprising a rigid support connected to a flexible support connected to the cathode emitter and a stabilizing rod connected between the cathode emitter and the rigid support, wherein the rigid support is constructed of a dielectric material.

12. An apparatus comprising:

an electrical power supply providing a pulsed electrical potential above 30,000 volts with at least 30 Joules of energy per pulse;

a cathode emitter constructed and arranged to be moved along the earth in close proximity to the earth, wherein the cathode emitter is electrically coupled to the electrical power supply and wherein the cathode emitter is constructed and arranged to discharge the pulsed electrical potential into the earth; and a detector constructed and arranged to detect an electrical discharge from the electrical power supply.

13. The apparatus of claim 12, wherein the electrical power supply further comprises a spark gap and the detector further comprises a luminance meter constructed and arranged to detect a luminance of spark discharges across the spark gap.

14. The apparatus of claim 13, further comprising a fiber optic cable constructed and arranged to transmit light emitted from spark discharges across the spark gap to the luminance meter.

15. The apparatus of claim 12, further comprising a unidirectional antenna and a first RF receiver constructed and arranged to detect electromagnetic emissions.

16. The apparatus of claim 15, wherein the unidirectional antenna is oriented toward the cathode emitter.

17. The apparatus of claim 15, wherein the unidirectional antenna is oriented away from the cathode emitter.

18. The apparatus of claim 15, further comprising a omnidirectional antenna and a second RF receiver constructed and arranged to detect electromagnetic emissions.

19. An apparatus comprising:

an electrical power supply providing a pulsed electrical potential above 30,000 volts with at least 30 Joules of energy per pulse;

a cathode emitter constructed and arranged to be moved along the earth in close proximity within 8 cm to the earth, wherein the cathode emitter is electrically coupled to the electrical power supply and wherein the cathode emitter is constructed and arranged to discharge the pulsed electrical potential into the earth; and a plurality of anode emitters constructed and arranged to receive pulsed electrical potential from the cathode emitter.

* * * * *